US008995865B2

(12) United States Patent
Tamaki et al.

(10) Patent No.: US 8,995,865 B2
(45) Date of Patent: Mar. 31, 2015

(54) IMAGE FORMING APPARATUS

(71) Applicant: Canon Kabushiki Kaisha, Tokyo (JP)

(72) Inventors: Masayuki Tamaki, Abiko (JP); Jiro Ishizuka, Moriya (JP); Toshinori Nakayama, Kashiwa (JP); Taichi Takemura, Abiko (JP); Kazuhisa Kemmochi, Suntou-gun (JP); Hikaru Osada, Kamakura (JP); Keisuke Abe, Yokohama (JP); Tsutomu Miki, Komae (JP)

(73) Assignee: Canon Kabushiki Kaisha, Tokyo (JP)

( * ) Notice: Subject to any disclaimer, the term of this patent is extended or adjusted under 35 U.S.C. 154(b) by 48 days.

(21) Appl. No.: 13/913,895

(22) Filed: Jun. 10, 2013

(65) Prior Publication Data

US 2013/0336671 A1 Dec. 19, 2013

(30) Foreign Application Priority Data

Jun. 15, 2012 (JP) ..... 2012-135499

(51) Int. Cl.

*G03G 15/00* (2006.01)
*G03G 15/20* (2006.01)
*G03G 15/22* (2006.01)

(52) U.S. Cl.

CPC ..... *G03G 15/22* (2013.01); *G03G 15/2028* (2013.01); *G03G 15/2053* (2013.01); *G03G 15/2064* (2013.01); *G03G 2215/2035* (2013.01); *G03G 2215/2074* (2013.01)

USPC ..... 399/85; 399/68

(58) Field of Classification Search

CPC ... G03G 15/22; G03G 15/50; G03G 15/2064; G03G 15/2078; G03G 2215/2035; G03G 2215/2074

USPC ..... 399/67, 68, 85

See application file for complete search history.

(56) References Cited

U.S. PATENT DOCUMENTS

| | | | | |
|---|---|---|---|---|
| 6,363,229 | B1 * | 3/2002 | Shiraishi et al. | 399/68 |
| 7,344,816 | B2 | 3/2008 | Matsumura et al. | |
| 7,729,650 | B2 | 6/2010 | Tamaki | |
| 8,019,261 | B2 | 9/2011 | Tamaki | |
| 8,577,230 | B2 * | 11/2013 | Yamashina | 399/15 |
| 2005/0142478 | A1 | 6/2005 | Matsumura et al. | |
| 2011/0182607 | A1 | 7/2011 | Takemura | |
| 2011/0318036 | A1 * | 12/2011 | Abe et al. | 399/67 |

FOREIGN PATENT DOCUMENTS

| | | | |
|---|---|---|---|
| JP | 2004-295144 | A | 10/2004 |
| JP | 2005-195670 | A | 7/2005 |
| JP | 2005-195674 | A | 7/2005 |

* cited by examiner

*Primary Examiner* — Hoang Ngo
(74) *Attorney, Agent, or Firm* — Fitzpatrick, Cella, Harper & Scinto

(57) ABSTRACT

An image forming portion of an image forming apparatus is configured to form a toner image on a recording medium such that a relationship of $M \leq \rho\pi L/(30\sqrt{3})$ is satisfied, where a volume average particle size of toner is L (μm), density of the toners is ρ (g/cm$^3$), and a maximum toner laid quantity per unit area of a single color toner image on a recording medium is M (mg/cm$^2$). The toner image formed by the image forming portion is fixed on the recording medium by a fixing nip portion by being heated and applied a force in a direction of a plane of the recording medium.

9 Claims, 46 Drawing Sheets t1

LARGE TONER QUANTITY

SIDE VIEW
PERSPECTIVE VIEW
(BEFORE MELTING TONER)
PLAN VIEW
(AFTER MELTING TONER)

LOW TONER QUANTITY

P
DENS
DENSITY OF TONERS
SPARSE
SMALL GAPS BETWEEN TONERS
LARGE t1

LOW TONER QUANTITY
t2
SIDE VIEW
PERSPECTIVE VIEW
PLAN VIEW
α
β
PLAN VIEW (TRANSMISSION CONDITION)
γ

WHEN PACKED WITHOUT GAP
P

LARGE GAPS BETWEEN TONERS SMALL
SPARSE DENSITY OF TONERS DENS
t1
SMALL TONER QUANTITY

SIDE VIEW
PERSPECTIVE VIEW
PLAN VIEW (AFTER MELTING TONER)
(BEFORE MELTING TONER)
PACKED WITHOUT GAP IN ONE LAYER

P

Fig.12E (PLAN VIEW)

Fig.12B (PLAN VIEW)

Fig.12C P (SIDE VIEW)

Fig.12F P (SIDE VIEW)

NORMAL FIXING
SLIP FIXING

MAGENTA TONER
YELLOW TONER
PLAN VIEW
OF NON-FIXED STATE

SECTION VIEW
OF NON-FIXED STATE
RECORDING MEDIUM
FIX

SECTION VIEW
AFTER FIXING

PLAN VIEW
AFTER FIXING
TONER OVERLAP DIRECTION

FIX

TONER OVERLAP DIRECTION

NORMAL FIXING

SLIP FIXING

IMAGE OF SINGLE COLOR LINE

IMAGE OF SINGLE COLOR LINE

IMAGE MODE
- LETTER/MAP MODE
- PICTURE MODE

IMAGE FORMING APPARATUS

BACKGROUND OF THE INVENTION

1. Field of the Invention

The present invention relates to an image forming apparatus such as a copier, a facsimile, a printer, and a multi-function printer configured to form a toner image on a recording medium by utilizing an electro-photographic process and others and having a fixing apparatus configured to fix the toner image on the recording medium, and more specifically to an image forming apparatus having a low toner laid quantity system configured to consume less toner quantity.

2. Description of the Related Art

With the late development of electro-photographic technique and the increase of demands of the market, a method for visualizing image information through an electrostatic latent image is now being utilized in various fields such as a copier and a printer. In particular, technology for reducing toner consumption has become very important with the increasing demands from the aspects of responses to environment and of lowering costs. This technology for reducing the toner consumption is important also from the aspect of cutting energy generated during a process of fixing toner on the recording medium. This technology has come to play an important role also from the demand on energy saving in the office-oriented image forming apparatus using the electro-photography in particular.

Meanwhile, with the development of digitization and colorization, the electro-photographic image forming apparatus has come to be applied also to a part of the printing field. Such image forming apparatus has come to be practically used remarkably in the fields of graphic arts such as photographs and posters and of short-run printing including on-demand printing. In view of entering to the POD (Print On Demand) market, the electro-photographic system has a feature of on-demand quality as a plate-less printing.

However, the electro-photographic prints have numbers of problems yet to seek market value as output products in terms of a color reproducing range, texture, stability of image quality, correspondency to media or the like.

While accommodating to such problems, the technology for cutting toner consumption is increasingly becoming important with the increase of the consciousness for cutting costs as described above and from the aspect of cutting costs per one sheet of output.

Then, concerning a low toner laid quantity system which is a toner consumption reducing technology, the following proposals have been made for example. Japanese Patent Application Laid-open No. 2004-295144 has proposed a configuration of setting an absolute value of charge electric potential of a photoconductor in a lower condition of 350 to 550 V and of using toner having high tinting strength of 0.3 to 0.7 $mg/cm^2$ so that required image density after fixing an image is assured by toner quantity transferred to a recording medium.

Japanese Patent Application Laid-open Nos. 2005-195670 and 2005-195674 propose a configuration of cutting a maximum single-color toner laid quantity to be less than 0.35 $mg/cm^2$.

It is possible to cut toner consumption by increasing a quantity of pigments within toner and by reducing a total toner laid quantity to that extent. However, if the toner laid quantity is cut, such phenomena that toners cannot closely contact with each other and that a sheet having an irregular surface cannot be masked well by the toner in particular because the toner quantity is cut in a single-color solid image.

Cutting the toner laid quantity also poses such problems that when a color (secondary color) is to be formed by superimposing two layers of toners, colorfulness (coloring property) of the secondary color drops and a color reproducing range is narrowed, because areas where the different colors of toners overlap is decreased.

SUMMARY OF THE INVENTION

The present invention provides an image forming apparatus including an image forming portion configured to form a toner image such that a relationship of $M \leq \rho\pi L/(30\sqrt{3})$ is satisfied, where a volume average particle size of a toner is L (μm), density of the toners is ρ ($g/cm^3$), and a maximum toner laid quantity per unit area of a single color toner image on a recording medium is M ($mg/cm^2$), a heating member that heats the toner image formed on the recording medium by the image forming portion, a nip forming member that comes in contact with the heating member and forms a fixing nip portion configured to fix the toner image on the recording medium by heating and pressing the toner image which has been formed on the recording medium passing through the fixing nip portion, a force applying portion capable of applying a force to the toner image on the recording medium passing through the fixing nip portion in a direction of a plane of the recording medium, and a control portion configured to execute first and second modes in which spreads of the toner image widened in the direction of the plane of the recording medium are different from each other, and to control the force applying portion such that the spread of the toner image widened in the direction of the plane of the recording medium in the first mode is greater than the spread of the toner image widened in the direction of the plane of the recording medium in the second mode.

Further features of the present invention will become apparent from the following description of exemplary embodiments with reference to the attached drawings.

BRIEF DESCRIPTION OF THE DRAWINGS

FIG. 12B is a plan view showing a condition in which a yellow toner in a lower layer is positioned in a gap formed among three neighboring toners of magenta toners forming an upper layer.

FIG. 12C is a side view of FIG. 12B.

FIG. 12E is a plan view showing a condition in which the magenta toner that forms the upper layer is placed on a gap formed among the three neighboring yellow toners of the under layer.

FIG. 12F is a side view of FIG. 12E.

DESCRIPTION OF THE EMBODIMENTS

First Embodiment

A first embodiment of the present invention will be described below with reference to FIGS. 1 through 27. Firstly, a schematic structure of an image forming apparatus of the present embodiment will be described with reference to FIG. 1.

[Image Forming Apparatus]

Figure 1:
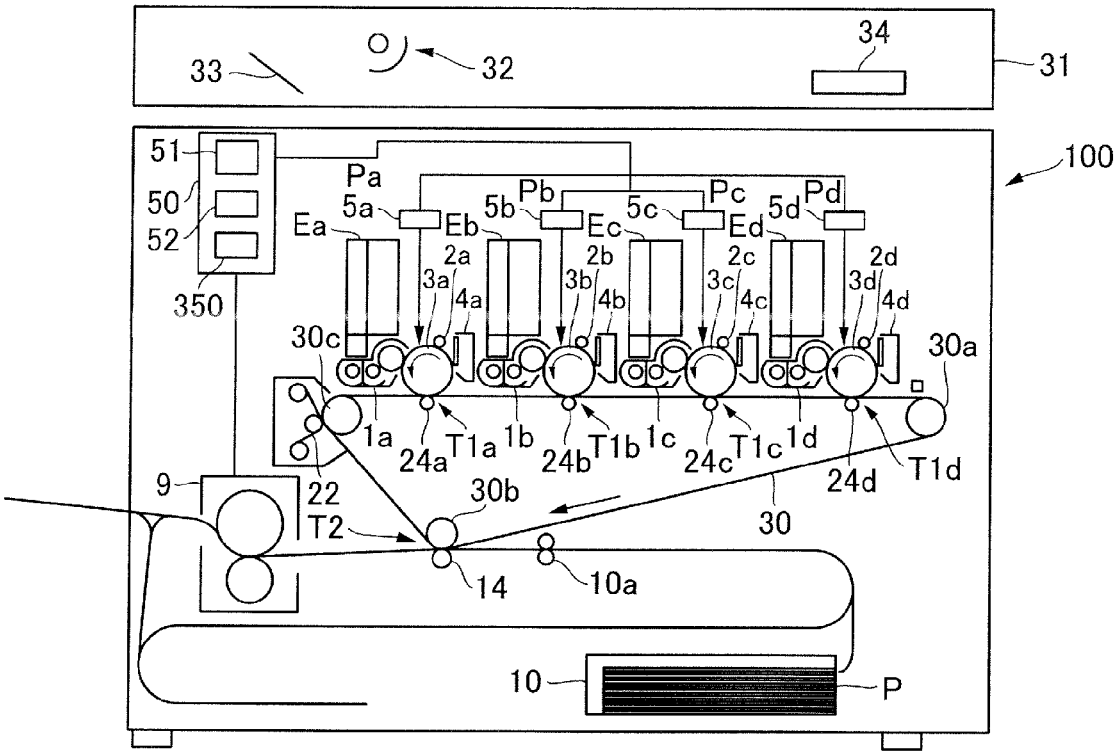
FIG. 1 is a schematic structural section view of an image forming apparatus of a first embodiment of the invention.

The image forming apparatus 100 shown in FIG. 1 is provided with first, second, third and fourth image forming units Pa, Pb, Pc and Pd respectively forming toner images of different colors while going through processes of forming latent images and developing and transferring the images. The image forming units Pa, Pb, Pc and Pd have their own dedicated electro-photographic photoconductive drums (each referred to as a "photoconductive drum" hereinafter) 3*a*, 3*b*, 3*c* and 3*d* in the present embodiment, and form the toner images of respective colors on the respective photoconductive drums 3*a*, 3*b*, 3*c* and 3*d*. An intermediate transfer belt 30 is provided adjacent the respective image forming units Pa, Pb, Pc and Pd. Each of the toner images formed on photoconductive drums 3*a*, 3*b*, 3*c* and 3*d* is transferred primarily on the intermediate transfer belt 30 due to a primary transfer bias applied to each of primary transfer rollers 24*a*, 24*b*, 24*c* and 24*d*, i.e., primary transfer members. The intermediate transfer belt 30 corresponds to the image carrier that carries the toner images, and the image forming units Pa, Pb, Pc and Pd and the primary transfer rollers 24*a*, 24*b*, 24*c* and 24*d* correspond to a toner image forming part that form the toner images on the image carrier in the present embodiment. Still further, a structure including these image carrier, toner image forming part, and parts such as secondary transfer rollers 14 described later that transfer the toner images from the intermediate transfer belt 30 to the recording medium corresponds to an image forming portion that forms the toner images on the recording medium.

The toner images carried on the intermediate transfer belt 30 are transferred secondarily on the recording medium P in a secondary transfer portion T2. That is, the toner images on the intermediate transfer belt 30 are transferred to the recording medium P due to a secondary transfer bias applied to the secondary transfer roller 14, i.e., a transfer portion. The recording medium P on which the toner images have been transferred are heated and pressed by a fixing apparatus 9 to fix the toner images. The recording medium P is then discharged out of the apparatus as a printed sheet.

Provided around the photoconductive drums 3*a*, 3*b*, 3*c* and 3*d* are charging rollers 2*a*, 2*b*, 2*c* and 2*d*, i.e., charge portions, developers 1*a*, 1*b*, 1*c*, 1*d*, the primary transfer rollers 24*a*, 24*b*, 24*c* and 24*d*, and cleaners 4*a*, 4*b*, 4*c* and 4*d*, respectively.

Exposure units 5*a*, 5*b*, 5*c* and 5*d* including light sources, polygon mirrors and others are provided above those devices.

Each of the charging rollers 2*a*, 2*b*, 2*c* and 2*d* is disposed adjacent to or in contact with each of the photoconductive drums 3*a*, 3*b*, 3*c* and 3*d*, and applies a predetermined charge electric potential to charge each surface of the photoconductive drums 3*a*, 3*b*, 3*c* and 3*d* with the predetermined potential. Each surface of the photoconductive drums 3*a*, 3*b*, 3*c* and 3*d* charged with the predetermined potential is then exposed by laser light emitted from each of the exposure units 5*a*, 5*b*, 5*c* and 5*d*.

That is, each of the exposure units 5*a*, 5*b*, 5*c* and 5*d* exposes each image by scanning the laser light emitted from the light source by rotating a polygon mirror, deflecting a luminous flux of the scanned light by the reflection mirror and collecting the luminous flux on each generating line of the photoconductive drums 3*a*, 3*b*, 3*c* and 3*d* by a fθ lens. Thereby, a latent image corresponding to an image signal is formed on each of the photoconductive drums 3*a*, 3*b*, 3*c* and 3*d*.

The developers 1*a*, 1*b*, 1*c* and 1*d* are filled respectively with a predetermined amount of respective color toners of yellow, magenta, cyan and black as developing powders from supplying units Ea, Eb, Ec and Ed. The developers 1*a*, 1*b*, 1*c* and 1*d* develop the latent images on the photoconductive drums 3*a*, 3*b*, 3*c* and 3*d* and visualize as a yellow toner image, a magenta toner image, a cyan toner image and a black toner image, respectively.

The yellow toner image, i.e., a first color, formed and carried on the photoconductive drum 3*a* is transferred primarily to the intermediate transfer belt in a process in which the intermediate transfer belt 30 passes through a nip portion (primary transfer portion T1*a*) between the photoconductive drum 3*a* and the intermediate transfer belt 30. That is, the toner image is primarily transferred to an outer circumferential surface of the intermediate transfer belt 30 when the intermediate transfer belt 30 passes through the primary transfer portion T1*a* by an electric field and pressure generated by a primary transfer bias applied by the primary transfer roller 24*a*. In succession, the magenta, cyan and black toner images are primarily transferred such that the toner images are superimposed on the intermediate transfer belt 30 at the respective primary transfer portions T1*b*, T1*c* and T1*d* in the same manner with the yellow toner image. Thus, a composite color toner image corresponding to a target color image is formed on the intermediate transfer belt 30.

The intermediate transfer belt 30 is suspended around a plurality of suspension rollers 30*a*, 30*b* and 30*c*, and is rotationally driven in a direction of an arrow shown in FIG. 1 with the equal circumferential speed with the photoconductive drums 3*a*, 3*b*, 3*c* and 3*d*. The suspension roller 30*b* and the secondary transfer roller are disposed so as to sandwich the intermediate transfer belt 30 in the secondary transfer portion T2. The secondary transfer roller 14 is arranged to be in contact with a lower surface of the intermediate transfer belt 30 by bearing in parallel correspondingly with the intermediate transfer belt 30. A desirable secondary transfer bias is applied to the secondary transfer roller by a secondary transfer bias source. The composite color toner image transferred and superimposed on the intermediate transfer belt 30 is transferred to the recording medium P as follows. That is, the recording medium P is fed to the secondary transfer portion T2 from a sheet feeding cassette 10 through a registration roller 10*a* and a transfer pre-guide with predetermined timing and in the same time, secondary transfer bias is applied to the secondary transfer portion. The composite color toner image is transferred from the intermediate transfer belt 30 to the recording medium P by this secondary transfer bias.

Transfer residual toners remaining on the photoconductive drums 3*a*, 3*b*, 3*c* and 3*d* which have finished the primary transfer are cleaned and removed by cleaners 4*a*, 4*b*, 4*c* and 4*d* to be ready to form next latent images successively. Toners and other contaminations remaining on the intermediate transfer belt 30 are wiped by abutting a cleaning web (non-woven cloth) 22 to the surface of the intermediate transfer belt 30.

Toners using polyester resin are used as the toners of each different color in the present embodiment. While a toner manufactured by a crushing method, a polymerization method such as suspension polymerization, interfacial polymerization, and dispersion polymerization in which toner is manufactured directly within medium or the like may be used, the toner manufactured by the crushing method is used in the present embodiment. It is noted that the component and manufacturing method of the toner are not limited to those described above.

Figure 2:
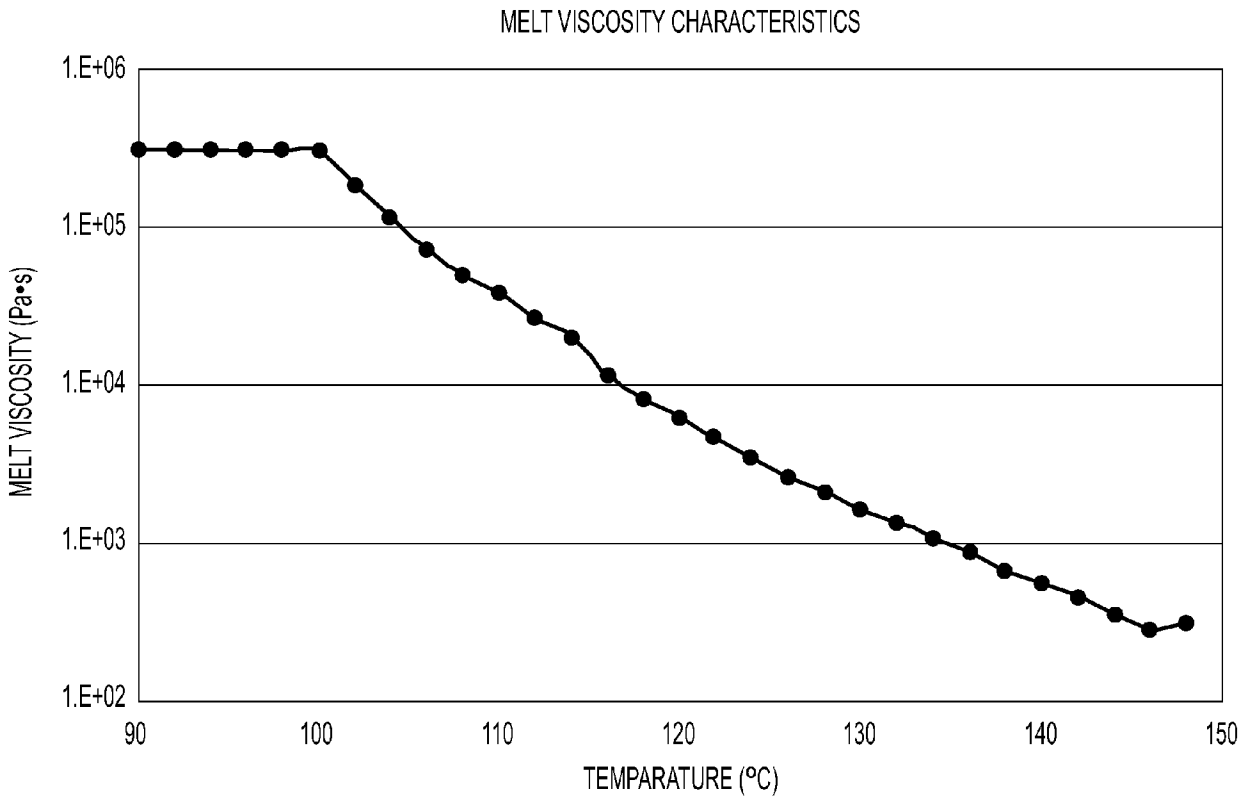
FIG. 2 is a graph of characteristics of viscosity with respect to temperature of toner used in the first embodiment.

It is also possible to use toners of respective colors composed of transparent thermoplastic resins containing the respective color pigments. Coloring toners using polyester having such a relationship between temperature and viscous characteristics as shown in FIG. 2 is used as a binder in the present embodiment. Still further, the toner having 1.1 ($g/cm^3$) of density ρ and 6.0 (μm) of volume average particle size L is used in the present embodiment.

FIG. 1 also shows an image reading portion 31. The image reading portion 31 is configured to irradiate light from a light source 32 to a document (not shown) placed on an upper surface of the portion and to read an image of the document by inputting the light reflected from the document to a CCD 34 via a mirror 33. The data (signals) read from the light inputted to the CCD 34 is image-processed by an image processing unit 51 within a control portion 50 that controls the image forming apparatus 100, and is input to the exposure units 5*a*, 5*b*, 5*c*, and 5*d* via image control portion 52.

The image control portion 52 converts color separation image signals of red, green and blue (R, G and B) input from the CCD 34 into digital signals by an A/D converter, and corrects a light quantity distribution and unevenness of sensitivity of the CCD 34 by a shading correction circuit. Next, the image control portion 52 converts from brightness signals RGB to density signals of cyan, magenta and yellow (C, M, and Y) by a density converting circuit. Then, the image control portion 52 generates a black signal (K) from the CMY signals by a masking and UCR circuit, and executes masking calculation and under color removal (UCR) for color correction. After processing the obtained CMYK signals by a filtering circuit and γ correction circuit, the image control portion 52 outputs signals of the respective colors to the exposure units 5*a*, 5*b*, 5*c* and 5*d*.

The exposure units 5*a*, 5*b*, 5*c* and 5*d* expose based on the input signals from the image control portion 52. It is noted that while there is a case when an image signal is input to the exposure units 5*a*, 5*b*, 5*c* and 5*d* from a personal computer (PC, see FIG. 7), the exposure units 5*a*, 5*b*, 5*c* and 5*d* are adapted to expose based on the input signal form the PC in this case in the present embodiment.

[Details of Image Forming Unit]

Figure 3:
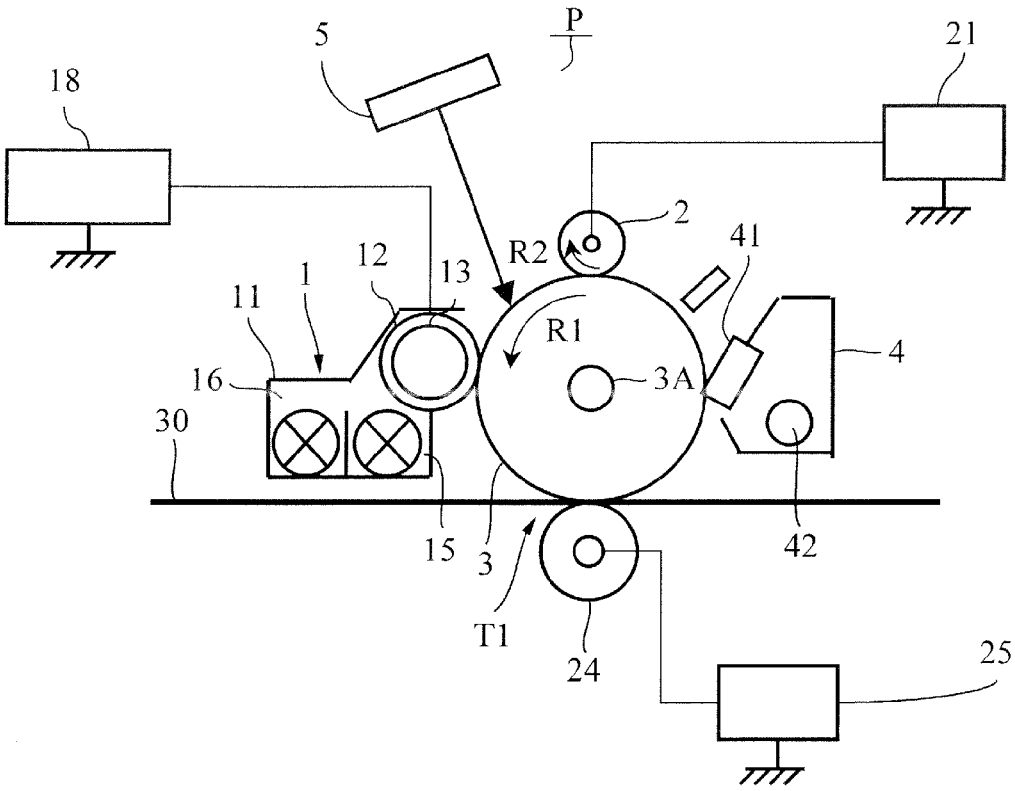
FIG. 3 is a schematic structural view of an image forming unit.

Next, each of the image forming units Pa through Pd will be detailed with reference FIG. 3. It is noted that because the basic structure of the respective image forming units are the same, the following explanation will be made by omitting suffixes (a, b, c and d) that indicate structures of the respective image forming units.

The image forming unit P includes the photoconductive drum 3 rotatably axially supported. The photoconductive drum 3 is a cylindrical OPC photoconductor which is basically composed of a conductive base such as aluminum and a photoconductive layer formed around an outer circumference of the conductive base. The photoconductive drum 3 has a drum spindle 3A at a center of the drum on a drum rotational axis, receives power for rotating in a direction of an arrow R1 centering on the spindle from a drive portion not shown through a decelerating portion and others, and rotates with preset process speed (peripheral velocity). The process speed of the image forming apparatus of the embodiment is 245 mm/s, which permits to print 50 sheets per minute.

The charge roller 2, i.e., the charging portion, is disposed above the photoconductive drum 3. The charge roller 2 is disposed in contact with the surface of the photoconductive drum 3, and charges the surface of the drum uniformly with a potential of a predetermined polarity. The charge roller 2 is formed into a shape of a roller as a whole. The charge roller 2 is constructed such that a conductive core metal is provided at its center and a low resistant conductive layer and an intermediate resistant conductive layer are formed around the core metal. The charging roller 2 is rotatably supported by bearings not shown provided on both ends of the roller and is disposed in parallel with the rotational axis of the photoconductive drum 3. The bearings on the both ends of the roller are biased in a direction of pressing the photoconductive drum 3 with an adequate pressure by an elastic member not shown such as a spring. The charge roller 2 rotates in a direction of an arrow R2 following the rotation of the photoconductive drum 3 in the direction of the arrow R1 due to the contact pressure. Charging bias voltage is applied to the charge roller 2 by a power source 21 to uniformly charge the surface of the photoconductive drum 3.

Provided on a downstream side of the charge roller 2 in terms of the rotational direction of the photoconductive drum 3 is the exposure unit 5, i.e., an exposing portion. The exposure unit 5 scans and exposes the electrically charged surface of the photoconductive drum 3 while turning OFF/ON a laser light based on image information for example and forms an electrostatic latent image corresponding to the image information by removing electrical charges of exposed parts.

The developing device 1 having a developer container 11 containing binary developer is disposed on the downstream side of the exposure unit 5. A developing sleeve 12 is rotatably provided within an opening facing to the photoconductive drum 3 of the developer container 11. A magnet roller 13 that causes the development sleeve to carry the developer is fixedly disposed within the development sleeve 12 non-rotationally as against the rotation of the development sleeve 12. Provided above the development sleeve 12 of the developing device 1 is a restricting blade that restricts the developer carried on the development sleeve 12 to form a thin developer layer. Parted also within the developer container 11 are a developing chamber 15 and an agitating chamber 16. When the developer formed into the thin developer layer is conveyed to a developing area facing to the photoconductive drum 3, the developer spikes out by magnetic force of a developing main pole positioned in the developing area of the magnet roller 13 and a magnetic brush of the developer is formed. Magnitude of the developing main pole of the magnet roller 13 is 1000 [G]. The surface of the photoconductive drum 3 is brushed by this magnetic brush and the developing bias voltage is applied to the development sleeve 12 by the power source 18. Thereby, toners adhering to carriers composing spikes of the magnetic brush adhere to and develop the exposed parts of the electrostatic latent image, and a toner image is formed on the photoconductive drum 3.

The primary transfer roller 24 is disposed on the downstream side of the developing device 1 and under the photoconductive drum 3. The primary transfer roller 24 is composed of a core metal to which a bias is applied from a power source 25 and a conductive layer cylindrically formed on an outer circumferential surface thereof. The primary transfer roller 24 is biased toward the photoconductive drum 3 by an elastic member not shown such as springs disposed on both ends of the roller 24. Thereby, the conductive layer of the primary transfer roller 24 comes into pressure contact with the surface of the photoconductive drum 3 with a predetermined pressure through the intermediary of the intermediate transfer belt 30, and the primary transfer portion (primary transfer nip portion) T1 is formed between the photoconductive drum 3 and the intermediate transfer belt 30. The intermediate transfer belt 30 is nipped in the primary transfer portion T1, and the transfer bias voltage having a polarity reversed from a polarity of the toner is applied to the intermediate transfer belt 30 by the power source 25. Thereby, the toner image on the photoconductive drum 3 is transferred (primary transfer) to the surface of the intermediate transfer belt 30.

Non-transferred residual toner and others adhering on the surface of the photoconductive drum 3 are removed by the cleaner (cleaning unit) 4 after transferring the toner image. The cleaner 4 has a cleaner blade 41 and a conveying screw 42. The cleaner blade 41 is caused by a pressurizing portion not shown to abut the photoconductive drum 3 with predetermined angle and pressure to recover the toner and others remaining on the surface of the photoconductive drum 3. The recovered residual toner and others are discharged by the conveying screw 42 and stored in a waste toner box. The waste toner box stores the waste toner discharged per process unit and the waste toner produced by a cleaning web 22 through conveying paths not shown. When the waste toner box is filled up, a maintenance worker or a user replaces and cleans the box. It is noted that the electricity of the photoconductive drum 3 may be removed at this time to erase the electrostatic latent image left on the photoconductive drum 3 by exposing the entire surface of the photoconductive drum 3 by a predetermined time while charging by the charge roller 2.

[Full Color Mode and Monochrome Mode]

The image forming apparatus 100 of the present embodiment is capable of selectively executing a full color mode of forming an image by a plurality of colors of toners and a monochrome mode of forming an image by a single-color toner. That is, the image is formed in the full color mode by operating all of the image forming units Pa, Pb, Pc and Pd. The image is formed in the monochrome mode by using only one image forming unit among the image forming units Pa, Pb, Pc and Pd.

In the full color mode, an image using at least two types of toner images among yellow, magenta, cyan, and black toner images is formed on a recording medium, and a highly coloring image is required. Meanwhile, an image using one type of toner among the yellow, magenta, cyan, and black toner images is formed on the recording medium in the monochrome mode, and reproducibility of a line image and letter image (thin line in particular) is highly required. Images of one color of the black toner such as written documents are more often made in general, so that the reproducibility of the line image and others is required. Accordingly, the full color mode is a coloring preceding mode and the monochrome mode is a line image preceding mode in the present embodiment. The coloring preceding mode and the line image preceding mode will be described later.

In the full color mode, the four colors of toner images are superimposed and transferred on the recording medium P as described above. Meanwhile, only the image forming unit Pd of black is driven and the other image forming units Pa, Pb, and Pc halt in the monochrome mode (image forming process of only black color is illustrated here). At this time, although the photoconductive drum of the image forming units Pa, Pb, and Pc rotate, no toner image is formed on the photoconductive drums since the photoconductive drums are not charged and exposed, and the developing devices do not rotate. Then, the black toner image formed on the image forming unit Pd is transferred onto the recording medium P.

[Selection of Mode]

Figure 4:
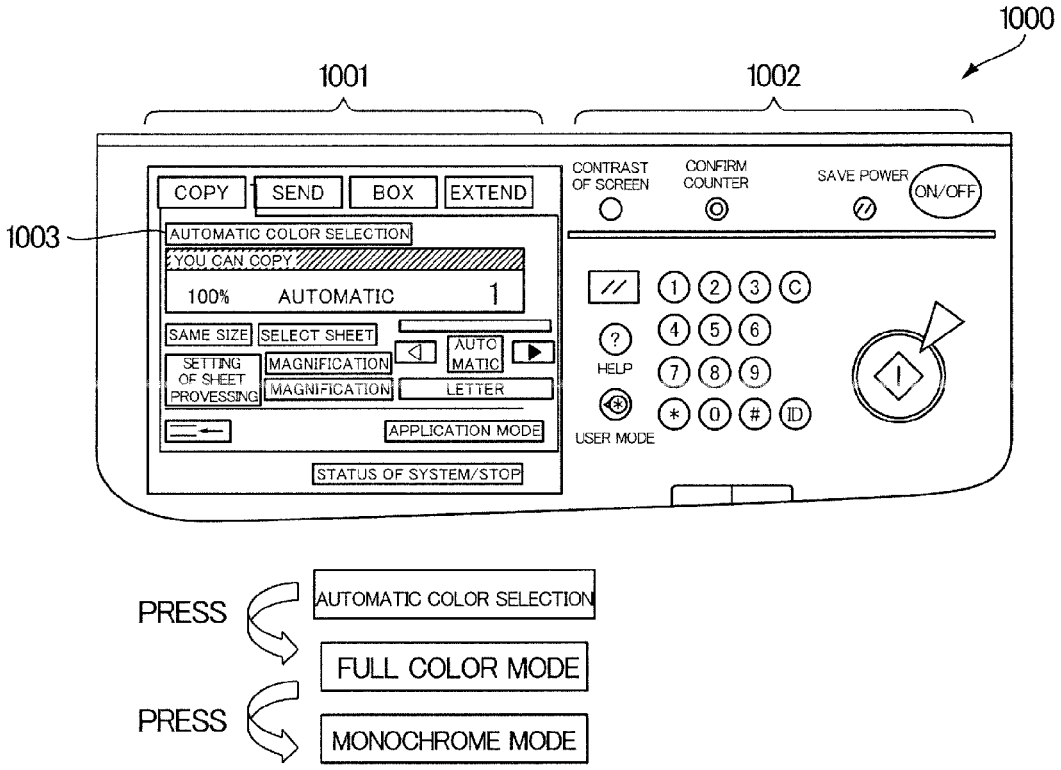
FIG. 4 illustrates one exemplary manipulation portion (control panel) of the first embodiment.

Next, a method for selecting the full color mode and the monochrome mode will be explained. FIG. 4 shows a control panel 1000 which is a manipulating portion of the image forming apparatus 100. The control panel 1000 has a touch panel 1001 and a key input portion 1002. The operation for reading and copying a document by the image reading portion 31 is carried out by manipulating the control panel 1000 of the image forming apparatus 100. The selection of the mode at this time is made by pressing an automatic color selection button 1003 of the touch panel 1001. The automatic color selection button 1003 is configured such that the modes are switched among the automatic color selection mode, the full color mode and the monochrome mode every time when the button is pressed. When the automatic color selection button is not pressed, the automatic color selection mode is selected.

Figure 5:
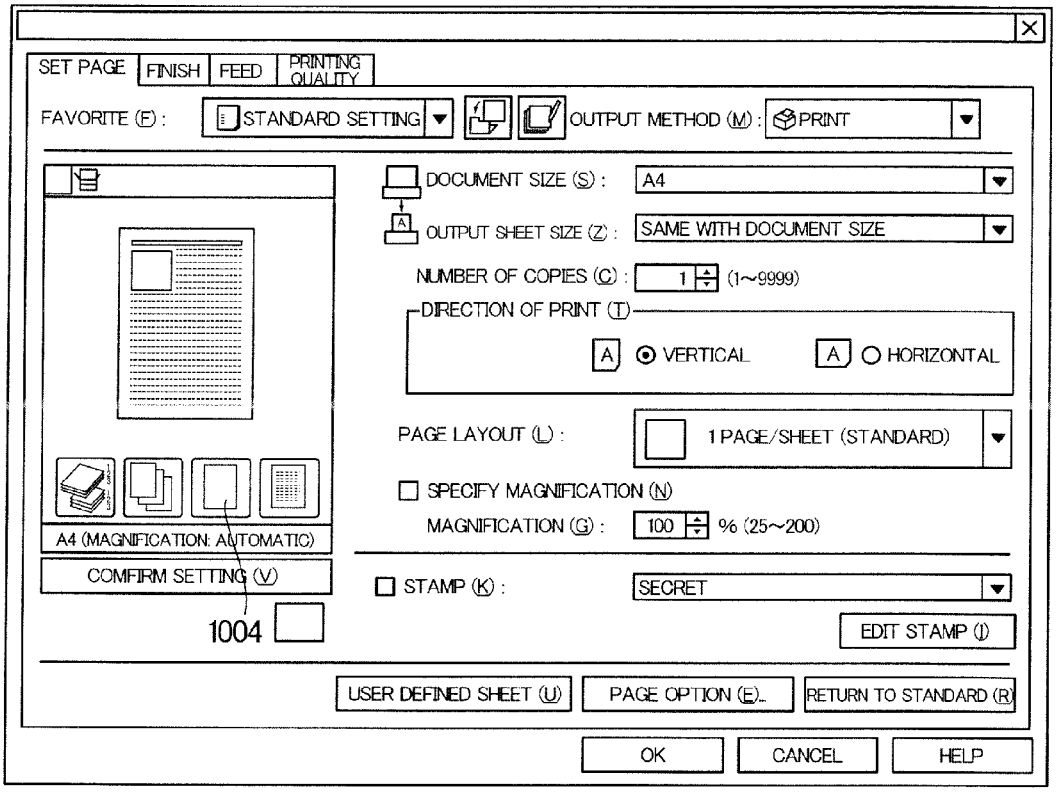
FIG. 5 illustrates one exemplary screen for selecting a mode in the first embodiment.

When an image is to be printed by sending image information from a personal computer, the manipulation for selecting the mode is made on the personal computer. FIG. 5 shows an exemplary screen displayed on the personal computer in selecting the mode. The selection of the mode can be made by clicking a select button 1004 shown in FIG. 5. The select button 1004 is configured to switch the mode among the automatic color selection mode, the full color mode and the monochrome mode every time when it is clicked. When the select button is not clicked at this time, the automatic color selection mode is selected.

Figure 6:
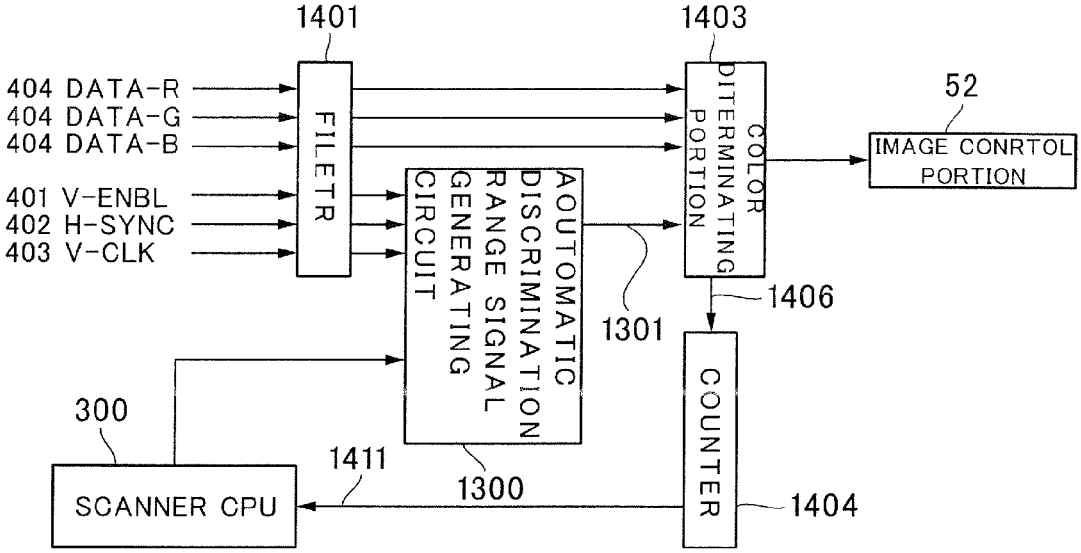
FIG. 6 is a block diagram showing a detailed configuration for discriminating a full-color mode and a monochrome mode.

A method for automatically discriminating monochrome and color in copying an image will be described with reference to FIG. 6. FIG. 6 is a block diagram for explaining a configuration of automatic color selection. A configuration of an automatic color select portion provided within the image reading portion 31 will now be explained with reference to FIG. 6. Here, the automatic color selection (referred to simply as "ACS" hereinafter) is an operation of judging whether a document is a color image or a monochrome image. That is, determination of the color is made by obtaining chromaticness per pixel and by detecting how many pixels whose chromaticness is greater than a certain threshold value exist.

However, a large number of color pixels exists microscopically around an edge of a document, even if the document is monochrome, due to various influences such as MTF, and it is hard to make the ACS determination simply in the unit of pixels. Although the ACS method is provided in various ways, the following explanation will be made by a typical method because the ACS may be made by any method in the present embodiment.

Because the large number of color pixels exists microscopically even in the monochrome image as described above, it is necessary to determine whether or not the subject pixel is really a color pixel by information of color pixels around the subject pixel. In FIG. 6, a filter 1401 refers to the surrounding pixels with respect to the subject pixel, and to that end, takes a structure of FIFO (First-In and First-Out). A scanner CPU 300 determines an area to which the ACS is applied with respect to a reading range.

An automatic discrimination area signal generating circuit 1300 prepares an automatic discrimination area signal 1301 that indicates the area to which the ACS is applied from the scanner CPU 300. A color determination portion 1403 refers to the peripheral pixels within a memory of the filter 1401 with respect to the subject pixel to determine whether the subject pixel is a color pixel or a monochrome pixel, and outputs a color determination signal 1406.

More specifically, the color determination portion 1403 operates in an area where the automatic discrimination area signal 1301 generated in the automatic discrimination area signal generating circuit 1300 is in effective level. The color determination portion 1403 defines the chromaticness by an absolute value of a difference in two values obtained by subtracting a minimum value of one component among red component data (DATA-R), green component data (DATA-G), and blue component data (DATA-B), read out of the document, from the other two components. Then, the color determination portion 1403 outputs a count-up signal (color determination signal) 1406 only when specific continuity of pixels whose chromaticness is larger than a certain threshold value is confirmed with respect to the subject pixel. A counter 1404 counts a number of color determination signals 1406 output by the color determination portion 1403.

After scanning, the scanner CPU 300 reads a counter value of the counter 1404 through a route 1411 and determines whether the document is color or monochrome from the counter value of the counter 1404.

Figure 7:
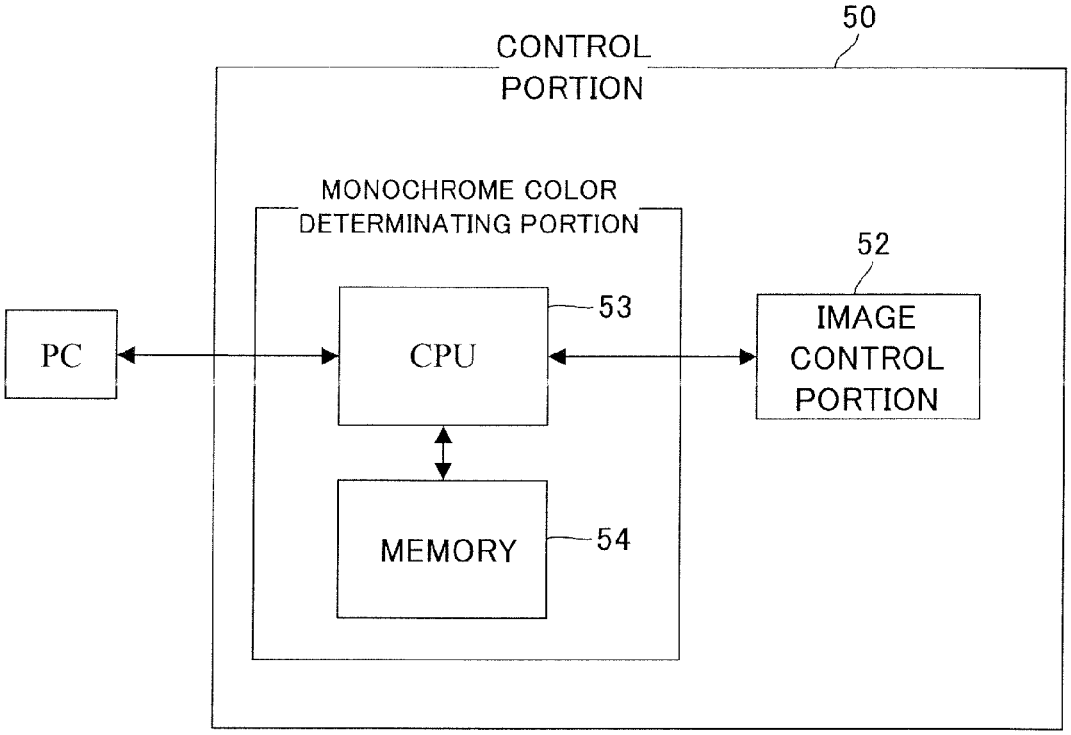
FIG. 7 is a block diagram schematically showing a configuration for discriminating the full-color mode and the monochrome mode in receiving a print job from a PC.

Next, a method for automatically discriminating monochrome and color during printing an image will be described with reference to FIG. 7. In the case of printing, the image forming apparatus that receives a print job from a personal computer as shown in FIG. 7 performs image developing processing (RIP) and stores the image after the RIP to a semiconductor memory 54 within a control portion 50 per unit of page and color components (CMYK). The determination of color/monochrome of the stored image is made by a CPU 53 within the control portion 50. The determination is made by detecting whether the component (CMY components) other than black (K) exists in each sample point within the semiconductor memory 54. If there is even one color (CMY) component within the sampling point in the page at this time, that page is a color image. Accordingly, the determination of color/monochrome of that page is stopped at that moment to fasten speed of the process, and an image control portion 52 processes the page as a color page. When there exists no color (CMY) component at all in the sampling point within the page in contrary, the image control portion 52 processes that page as a monochrome page.

[Low Toner Laid Quantity System]

The image forming apparatus 100 of the present embodiment adopts a low toner laid quantity system that reduces a toner laid quantity of a toner image to be formed on a recording medium. That is, each of the image forming units forms an image such that the following condition is satisfied. That is, a toner image is formed such that a relationship of $M \leq \rho\pi L/(30\sqrt{3})$ is satisfied, where a volume average particle size of toner is L (μm), density of the toners is ρ (g/cm$^3$), and a maximum toner laid quantity per unit area of a single-color toner image formed by each image forming unit on a recording medium is M (mg/cm$^2$).

The low toner laid quantity system will be described below with reference to FIGS. 8 through 17. At first, a phenomenon that disables a recording medium (sheet) to be masked by toners when a toner laid quantity is small will be explained. Firstly, a relationship between a toner quantity and a sheet masking condition in a case of single color will be explained.

Figures 8A, 8B, 8C, 8D:
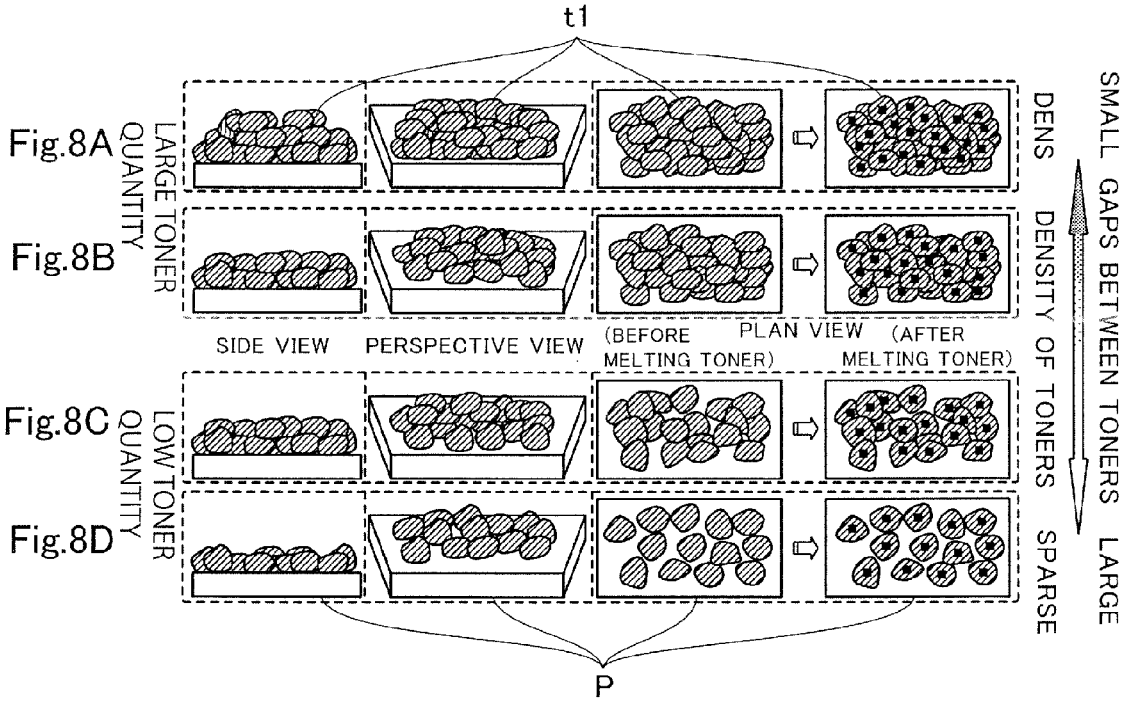
FIG. 8A are side, perspective and plan views before and after toner melts schematically showing a relationship between a toner quantity and a sheet masking condition when the toner quantity is largest among cases shown in FIGS. 8A through 8D.
FIG. 8B are side, perspective and plan views before and after toner melts schematically showing a relationship between a toner quantity and a sheet masking condition when the toner quantity is large next to that of the case shown in FIG. 8A.
FIG. 8C are side, perspective and plan views before and after toner melts schematically showing a relationship between a toner quantity and a sheet masking condition when the toner quantity is smaller than that of the case shown in FIG. 8B.
FIG. 8D are side, perspective and plan views before and after toner melts schematically showing a relationship between a toner quantity and a sheet masking condition when the toner quantity is even smaller than that of the case shown in FIG. 8C.

FIGS. 8A through 8D illustrate the relationship between the toner quantity and the sheet masking conditions, i.e., differences of the respective conditions of forming a toner layer on the recording medium (sheet) P when the quantity of monochrome toner t1 is large and small. In order to observe overlapping conditions of the toners, FIGS. 8A through 8D respectively include side and perspective views showing the toner layer seen from the side and plan views showing the sheet masking conditions masked by the toners. FIGS. 8A through 8D show changes of conditions when the toner quantity is reduced gradually in order of FIG. 8A, FIG. 8B, FIG. 8C and FIG. 8D. As it can be seen from the plan view after melting the toners in FIGS. 8A and 8B showing the conditions when the toner quantity is large, the sheet is fully masked by the toners. It can be seen that the sheet is steadily masked by the toners from the beginning from that there exists no gap between the neighboring toners even in the non-fixed state (before melting the toners).

Meanwhile, it can be seen from FIG. 8C showing a case when the toner quantity is small that parts of the sheet where there exist gaps are visible even after melting the toners, even through parts of the sheet where the toners overlap or adjoin in plane with each other are masked after melting the toners. It can be seen from FIG. 8D showing a case when the toner quantity is even smaller that the sheet is masked less after melting the toners because there exists no overlap of the toners. It can be also seen, however, that masking of the sheet advances more or less in parts of the sheet where the gaps between the toners are small, even if there exist the gaps in the non-fixed state, because the toner layer is a single layer and the toners melt and expand after melting the toners. However, the larger the inter-toner gap, the lower the sheet masking rate by the toners is.

Figures 9A, 9B, 9C, 9D:
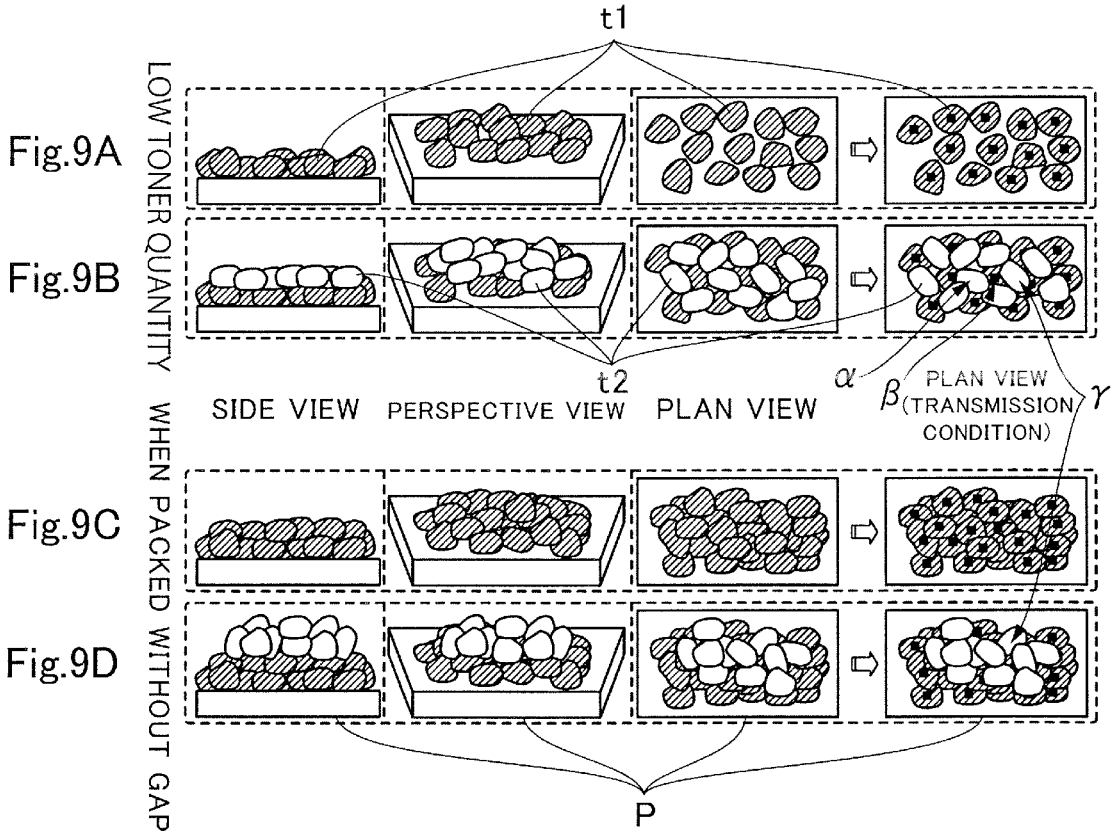
FIG. 9A are side, perspective and plan views before and after toner melts schematically showing a relationship between a toner quantity and a single-color toner layer forming condition when the toner quantity is small.
FIG. 9B are side, perspective and plan views before and after toner melts schematically showing a relationship between a toner quantity and a secondary color toner layer forming condition when the toner quantity is small.
FIG. 9C are side, perspective and plan views before and after toner melts schematically showing a relationship between a toner quantity and a single-color toner layer forming condition when the toner quantity is large.
FIG. 9D are side, perspective and plan views before and after toner melts schematically showing a relationship between a toner quantity and a secondary color toner layer forming condition when the toner quantity is large.

Next, a relationship between a toner quantity in forming a secondary color layer (overlapping two colors of toner layers) and a condition of forming the secondary color layer will be explained. FIGS. 9A through 9D illustrate the relationship between the toner quantities and the "conditions of forming the monochrome and secondary color toner layers". FIGS. 9A through 9D indicate toners t2 of a second color (magenta in the explanation) in addition to the monochromatic toners t1 (yellow in the explanation). Among FIGS. 9A through 9D, FIG. 9A shows the conditions in forming the monochrome toner layer when the toner quantity is small, FIG. 9B shows the conditions in forming the secondary color toner layer, FIG. 9C shows the conditions in forming the monochrome toner layer when the toner quantity is large, i.e., when the toners are arrayed without gap, and FIG. 9D shows the conditions in forming the secondary color toner layer.

When the toner quantity is small, it can be seen that there exist many gaps in a lower layer of the yellow toners t1 as shown FIG. 9A, and it can be seen that the magenta toners t2 of an upper layer that turns out to be a second color are laid between the gaps formed by the yellow toners t1 as shown in FIG. 9B. It is needless to say that when particle substances such as toners form a layer, particles laid above fall into gaps between particles laid under the upper particles. Thus, the magenta toners t2 of the upper layer are laid on the gaps formed by the yellow toners t1 of the lower layer. Therefore, the following point can be seen when the toners are made transmissive as shown FIG. 9B (transmission condition). That is, parts α where only the magenta toners t2 of the upper layer exist, parts β where only the yellow toners t1 of the lower layer exist, and parts γ where the magenta toners t2 of the upper layer overlap with the yellow toners t1 of the lower layer are formed.

Meanwhile, when the toner quantity is large, i.e., the toners are arrayed without gap, it can be seen that most of the sheet is masked because the yellow toners t1 of the lower layer are in contact with each other as shown in FIG. 9C. Still further, the magenta toners t2 of the upper layer that turns out to be the second color are laid on the gaps formed by the yellow toners t1 as shown in FIG. 9D similarly to the case of FIG. 9B. It can be also seen that the magenta toners t2 laid on the magenta toners t2 are laid also in gaps formed by the magenta toners t2. While the sheet is steadily masked in the monochrome condition in FIG. 9C, the magenta toners t2 positioned in the upper layer also mask the lower layer steadily. Therefore, as it can been from a transmissive state shown in FIG. 9D, many parts where the magenta toners t2 exist turn out to be overlap parts γ where the magenta toners t2 of the upper layer overlap with the yellow toners t1 of the lower layer, differing from the transmissive state shown in FIG. 9B when the toner quantity is small.

While the many parts turn out to be the overlap parts γ where the secondary color layer is favorably formed when the toner quantity is large, the smaller the toner quantity, the more the monochrome parts (α and β) increase in the respective gaps of the upper and lower layers when the toner quantity is small. Then, because the overlap parts γ where the secondary color is favorably formed decrease, coloring of the secondary color drops if the toner quantity is reduced from the conventional toner quantity. In the same time, the sheet is masked less and a reproducing range of color gamut extremely drops also in monochrome toner layer forming parts.

Figures 10A, 10B, 10C, 10D, 10E:
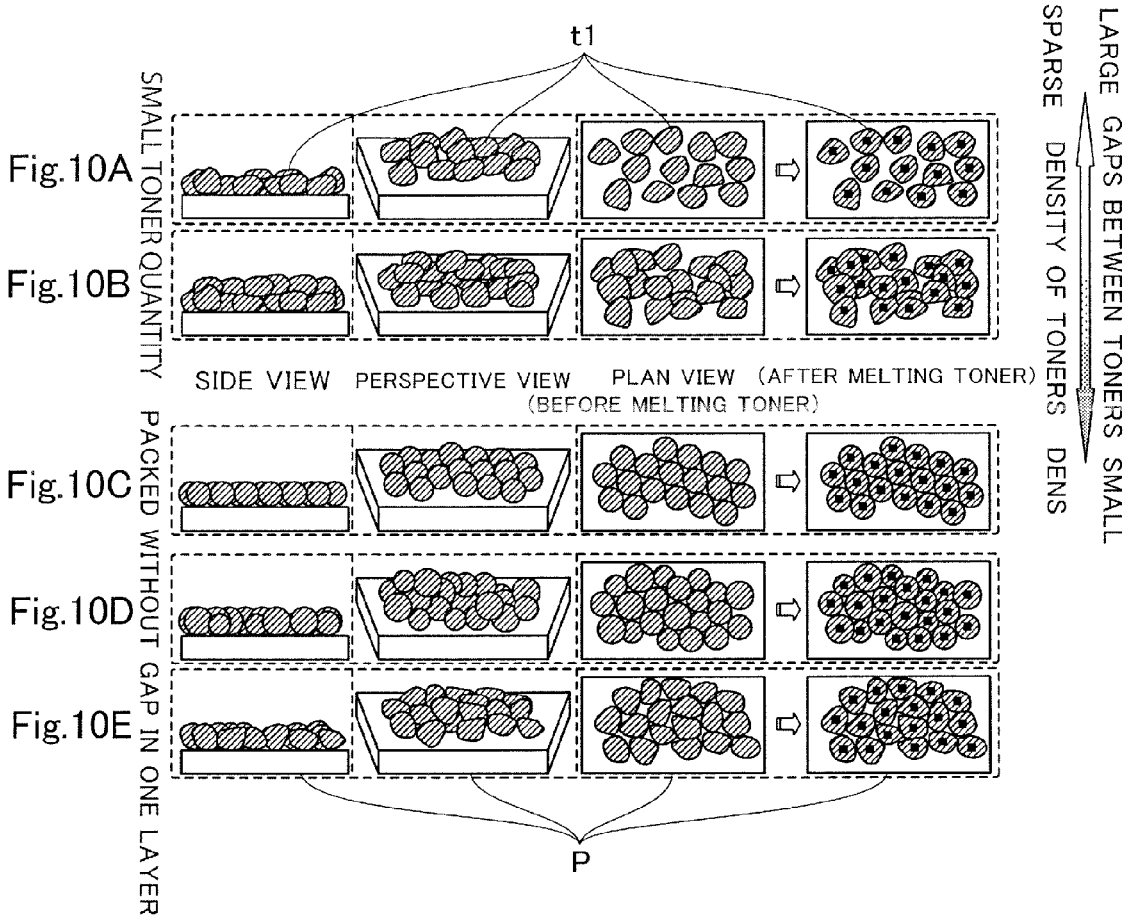
FIG. 10A are side, perspective and plan views before and after toner melts schematically showing toner layer forming conditions when the toner quantity is small (when gaps exist).
FIG. 10B are side, perspective and plan views before and after toner melts schematically showing toner layer forming conditions in a case when the toner quantity has increased slightly more than case in FIG. 10A.
FIG. 10C are side, perspective and plan views before and after toner melts schematically showing toner layer forming conditions when perfect globular toner particles are arrayed in a closest packing condition.
FIG. 10D are side, perspective and plan views before and after toner melts schematically showing toner layer forming conditions when various sizes of perfect globular toner particles are distributed.
FIG. 10E are side, perspective and plan views before and after toner melts schematically showing toner layer forming conditions when toner particles having irregular shapes are ideally arrayed.

Here, an ideal condition for forming a toner layer having less number of gaps with a small toner quantity will be explained. FIGS. 10A through 10E illustrate toner layer forming conditions when the toner quantity is small (there exist gaps) and when one layer is formed by arraying the toners without gap. FIG. 10A show a case when an absolute toner quantity is small with respect to a plane, and thus many gaps are created inevitably. Even when the toner quantity is increased more or less from the case of FIG. 10A as shown in FIG. 10B, the sheet is masked less and it becomes hard to obtain a favorable overlap condition in forming the secondary color if there exist parts where the toners overlap stereoscopically and parts where the gaps are produced.

Here, a case when the toner particles are planely and ideally arrayed as shown in FIG. 10E will be considered. Then, it can be seen that although a number of gaps is reduced as compared to the array condition shown in FIG. 10B, there exist parts having large gaps even if the toners are in close contact with each other because shapes of the toner particles vary. In the same manner, gaps are inclined to increase even when perfect globular toner particles having a particle size distribution are used as shown in FIG. 10D if the toner particles that enter and are arrayed under the particles having large particle size are taken into account.

That is, the toners can be arrayed most efficiently on a plane by packing perfect globular toner particles having the same particle size closely as shown in FIG. 10C. It is needless to say that the sheet can be masked most by particles having the same cubic content because all of adjacent toners come into contact with each other in this condition. For instance, although it is conceivable to achieve a high masking rate more than case shown in FIG. 10C by arraying elliptical globular toners are well arranged in a major axis direction, the masking rate drops as compared to the case shown in FIG. 10C if they are arrayed in a minor axis direction. Therefore, an average array of the elliptical globular toners is considered, it is needless to say that the masking rate is lowered after all as compared to the case of arraying the perfect globular toner particles.

Figures 11A, 11B, 11C, 11D:
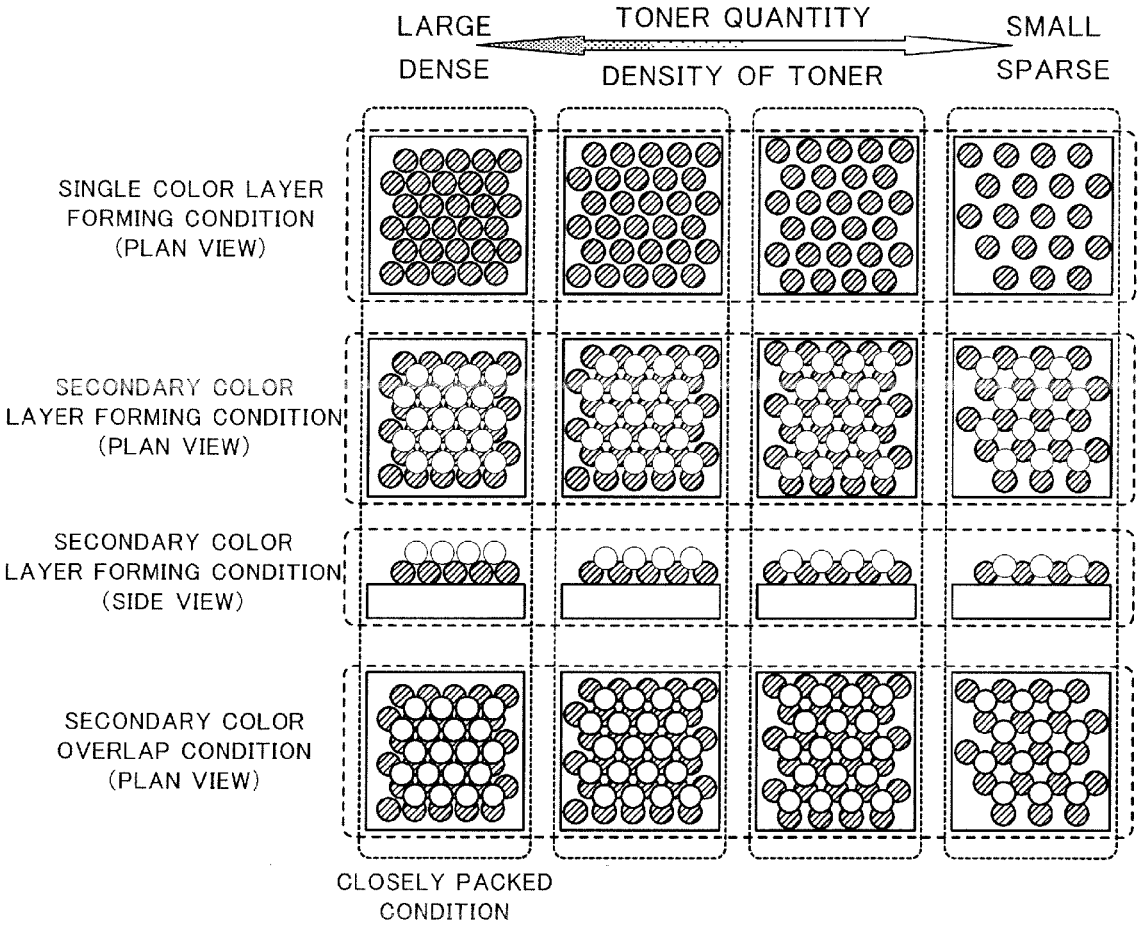
FIG. 11A are a plan view schematically showing a single-color toner layer forming condition in a closest packing condition, plan and side views schematically showing a secondary color toner layer forming condition, and a plan view showing an overlapping condition of the secondary color.
FIG. 11B are a plan view schematically showing a single-color toner layer forming condition when a toner quantity is reduced to be less than case in FIG. 11A, plan and side views schematically showing a secondary color toner layer forming condition, and a plan view showing an overlapping condition of the secondary color.
FIG. 11C are a plan view schematically showing a single-color toner layer forming condition when a toner quantity is reduced to be less than case in FIG. 11B, plan and side views schematically showing a secondary color toner layer forming condition, and a plan view showing an overlapping condition of the secondary color.
FIG. 11D are a plan view schematically showing a single-color toner layer forming condition when a toner quantity is reduced to be less than case in FIG. 11C, plan and side views schematically showing a secondary color toner layer forming condition, and a plan view showing an overlapping condition of the secondary color.

Next, a condition of forming a toner layer with respect to a quantity (toner density) of perfect globular toner particles having the same particle size capable of forming this ideal array condition will be explained. FIGS. 11A through 11D illustrate the toner layer forming conditions with respect to the quantity (density) of the perfect globular toner particles having the same cubic volume. When the conditions of forming the monochrome layers are compared, it can be seen that while there exist least gaps because the neighboring toners are in contact with each other in the closest packed condition as shown in FIG. 11A, gaps increase along with decrease of the toner quantity in order of FIGS. 11B, 11C and 11D.

It can be seen from the conditions of forming the secondary color in the plan views that the toners on the upper layer which turn out to be the secondary color are laid between the gaps formed by the toners of the lower layer regardless of the toner quantity. It can be seen also from the conditions of forming the secondary color in the side views that the toners of the upper layer enter between the gaps of the toners of the lower layer more and more as the toner quantity decreases. Then, while the toners of the upper layer are laid on the toners of the lower layer in the condition of FIG. 11A, the toners on the upper layer are caught, not laid, between the gaps as the gaps are widened in order from FIGS. 11B, 11C and 11D. Still further, the toners of the upper layer are located at lower position as the gaps are widened. That is, it can be seen that the toners of the upper layer enter between the toners of the lower layer. Thus, it can been seen well in term of a positional relationship that the toners of the upper layer enter between the toners of the lower layer as the gaps are widened in the non-fixed state.

Figure 12A:
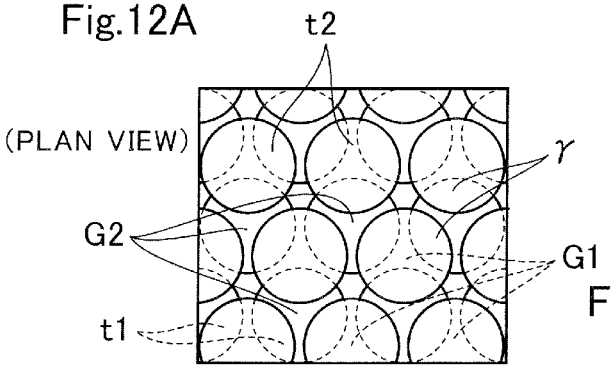
FIG. 12A is a plan view showing overlaps of the toners.
Figure 12D:
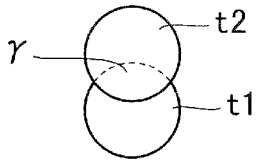
FIG. 12D is a schematic diagram showing the overlap of the magenta toner with the yellow toner.
Figure 12D:
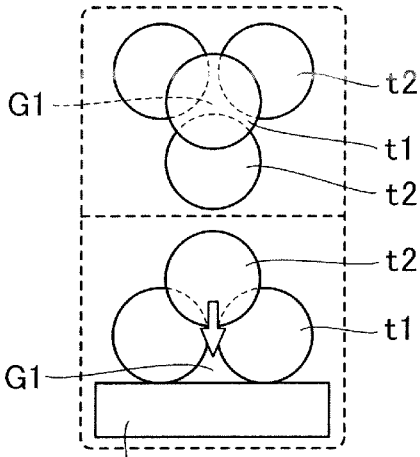
Figure 12D:
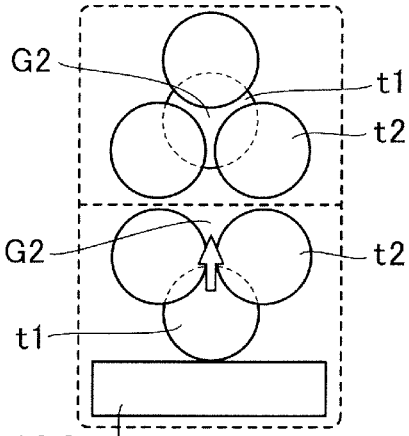

The transmissive state will now be explained. In the explanation, the overlap conditions will be observed in detail with reference to FIGS. 12A through 12F. As shown in FIG. 12A, each magenta toner t2 of the upper layer is laid on a gap G1 formed by three neighboring yellow toners t1 of the lower layer. It can be also seen that each yellow toner t1 of the lower layer is located between a gap G2 formed by three neighboring magenta toners t2 forming the upper layer. When the toner layers are melted in such condition, the magenta toner t2 of the upper layer enters the gap G1 formed by the yellow toners t1 of the lower layer in a direction of a downward arrow as shown in FIGS. 12E and 12F. Still further, as shown in FIGS. 12B and 12C, each yellow toner t1 of the lower layer enters the gap G2 formed by the magenta toners t2 of the upper layer in a direction of an upward arrow. This produces the respective monochrome parts (α and β) and blocks spread of the favorable overlap part γ (see FIG. 12D), so that coloring of the secondary color drops. Because the smaller the toner quantity, the more the gaps increase as shown in FIGS. 11B, 11C and 11D, the spread of the overlap part γ is blocked further.

Figure 13:
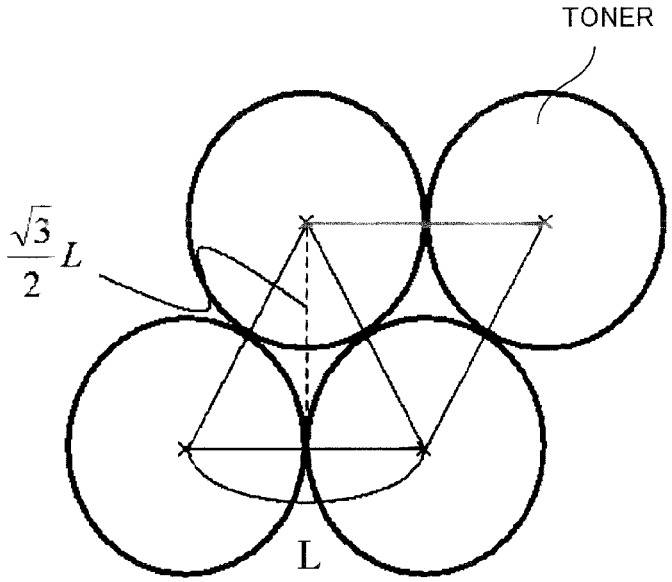
FIG. 13 is a diagram illustrating an ideal array condition of toners.

Next, various parameters in the ideal array condition will be explained. FIG. 13 illustrates the various parameters in the ideal array condition. When a volume average particle size of the toner (diameter of the toners) is L μm, a cubic volume of the toner is V $\mu m^3$, a planar toner projection area is S1 $\mu m^2$, and a unit area in which one toner is contained is S2 $\mu m^2$, the following equations 1 through 3 hold:

$$V = \frac{4}{3}\pi\left(\frac{L}{2}\right)^3 \quad [\mu m^3] \tag{1}$$

$$S1 = \pi\left(\frac{L}{2}\right)^2 \quad [\mu m^2] \tag{2}$$

$$S2 = \frac{\sqrt{3}}{2}L^2 \quad [\mu m^2] \tag{3}$$

From these equations, a toner laid quantity H μm (cubic volume per unit area=average height) of a single layer (one color) when the toners are packed closest is calculated from the following equation 4:

$$H1 = \frac{V}{S2} = \frac{4}{3}\pi\left(\frac{L}{2}\right)^3 \cdot \frac{2}{\sqrt{3}L^2} = \frac{\pi L}{3\sqrt{3}} \quad [\mu m] \tag{4}$$

Figure 14:
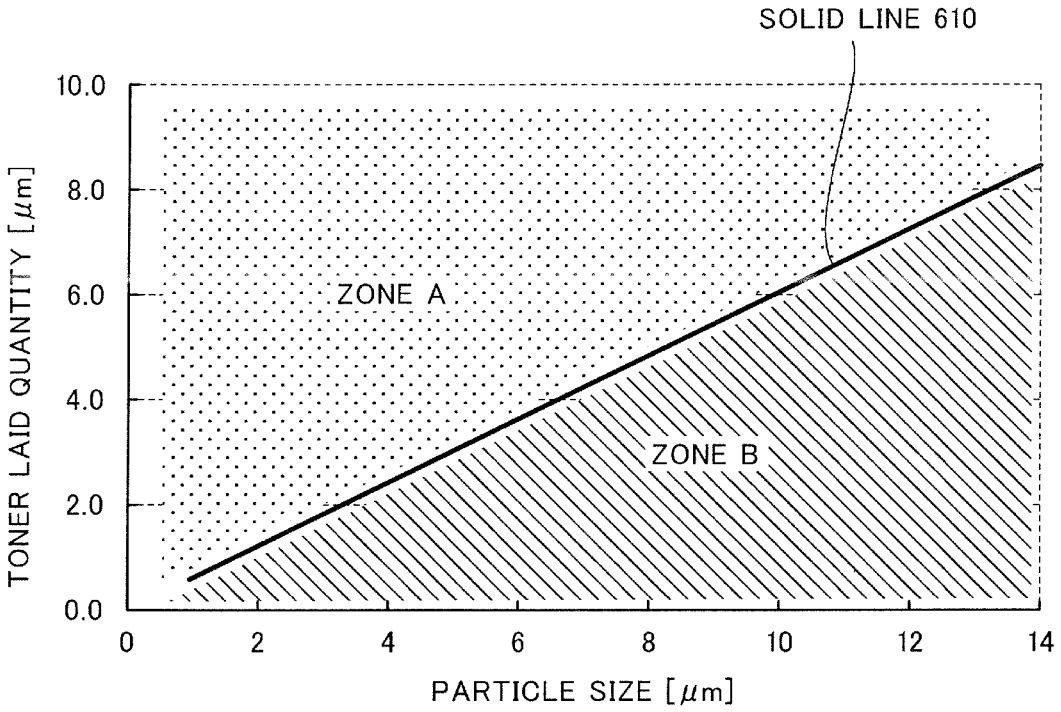
FIG. 14 is a graph explaining a relationship between particle size of the toners and toner laid quantity.

FIG. 14 is a graph explaining a relationship between particle size of the toners and toner laid quantity (average height) in the ideal array condition derived from the above relational expressions. In the graph, a solid line 610 indicates the ideal array condition, a zone A is a range in which the toner quantity per unit area is larger than that in the ideal condition, and a zone B is a range in which the toner quantity per unit area is smaller than that in the ideal condition. That is, the zone B indicates a range in which the toner quantity is insufficient with respect to a sheet, thus producing gaps.

Here, the gaps produced in the ideal array condition, i.e., a rate T1 (%) of the gaps (quantity of gaps per unit area) when the toners are packed closely, can be calculated from the following equation:

$$T1 = \left(1 - \frac{S1}{S2}\right) \times 100 = \left(1 - \pi\left(\frac{L}{2}\right)^2 \cdot \frac{2}{\sqrt{3}L^2}\right) \times 100 \approx 9.31 \quad [\%] \tag{5}$$

This means that the rate is always 9.31% with the toner particle size and toner laid quantity (average height) in the ideal array condition (on the solid line 610 in the graph) shown in FIG. 14. In other words, the rate of the gaps produced in the ideal array condition is 9.31% regardless of the toner quantity.

Figure 15A:
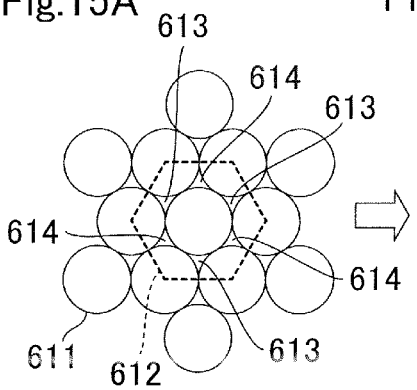
FIG. 15A is a diagram explaining a condition in which the toners are layered most closely, wherein the toners in a first layer are arrayed most closely.
Figure 15B:
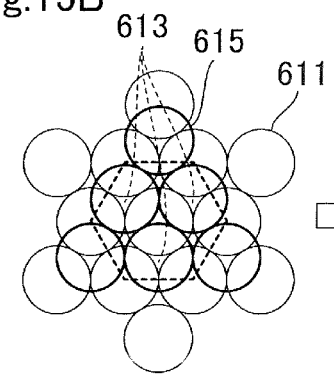
FIG. 15B is a diagram explaining a condition in which the toners are layered most closely, wherein the toners are placed on a second layer.
Figure 15C:
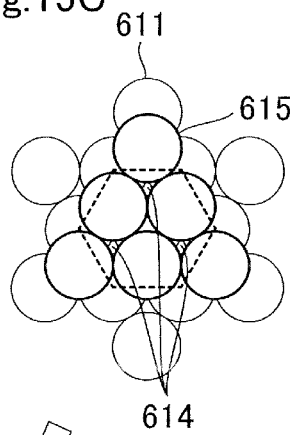
FIG. 15C is a diagram explaining a condition in which the toners are layered most closely, wherein the toners are placed on the second layer.
Figure 15D:
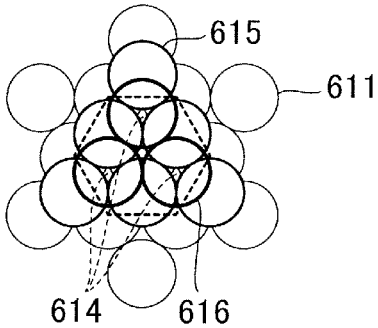
FIG. 15D is a diagram explaining a condition in which the toners are layered most closely, wherein the toners are placed on a third layer.
Figure 15E:
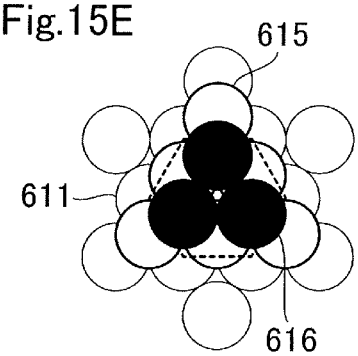
FIG. 15E is a diagram explaining a condition in which the toners are layered most closely, wherein the toners are placed on the third layer.

Here, the case when the toner quantity is larger than that in the ideal array condition will be explained. FIGS. 15A through 15D illustrate conditions in closely layering the toners when the toner quantity is increased more than that of the ideal array condition. FIG. 15A illustrate a condition in which toners 611 in a first layer are closely arrayed. A hexagon 612 indicates one unit area, and a condition in which gaps A613 and B614 within the hexagon are invisible leads to a toner laid quantity when the sheet is masked by 100%. A rate of the gaps A613 and B614 existing per unit area is 9.31% in FIG. 15A. FIGS. 15B and 15C show conditions in which toners 614 of a second layer are laid on the first layer and are masking the gaps A613. FIGS. 15D and 15E show conditions in which toners 616 on a third layer are laid, and it can be seen that the gaps B614 are masked and that the sheet is masked by 100%.

Figure 16:
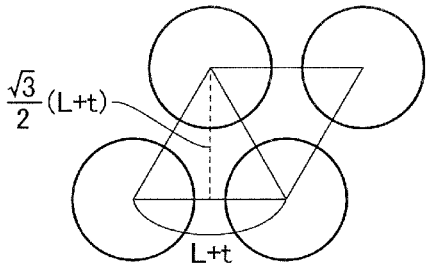
FIG. 16 is a diagram showing a condition in which a toner quantity is less than toner ideal array condition.

Next, the various parameters when a toner quantity is smaller than that in the ideal array condition will be explained. FIG. 16 illustrates the various parameters in a condition in which the toner quantity is smaller than that in the ideal array condition. Here, because a gap t μm is produced between toners, a unit area containing one toner is S3 $\mu m^2$, and may be expressed from the following equation 6:

$$S3 = \frac{\sqrt{3}}{2}(L+t)^2 \quad [\mu m^2] \tag{6}$$

From this equation, a toner laid quantity H2 μm of a single layer (one color) when the toners are arrayed uniformly with the gaps t μm (cubic volume per unit area=average height) can be calculated from the following equation 7:

$$H2 = \frac{V}{S3} = \frac{4}{3}\pi\left(\frac{L}{2}\right)^3 \cdot \frac{2}{\sqrt{3}(L+t)^2} = \frac{\pi L^3}{3\sqrt{3}(L+t)^2} \quad [\mu m] \tag{7}$$

The calculation result of the rate of gaps T2 % produced when the toners are arrayed uniformly with the gaps t μm (the quantity of gaps per unit area) can be consolidated by eliminating the gaps t μm between the toners by the equation described above as the following equation 8:

$$T2 = \left(1 - \frac{S1}{S3}\right) \times 100 = \left(1 - \pi\left(\frac{L}{2}\right)^2 \cdot \frac{2}{\sqrt{3}(L+t)^2}\right) \times 100 = \left(1 - \frac{3H2}{2L}\right) \times 100 \quad [\%] \tag{8}$$

Figure 17:
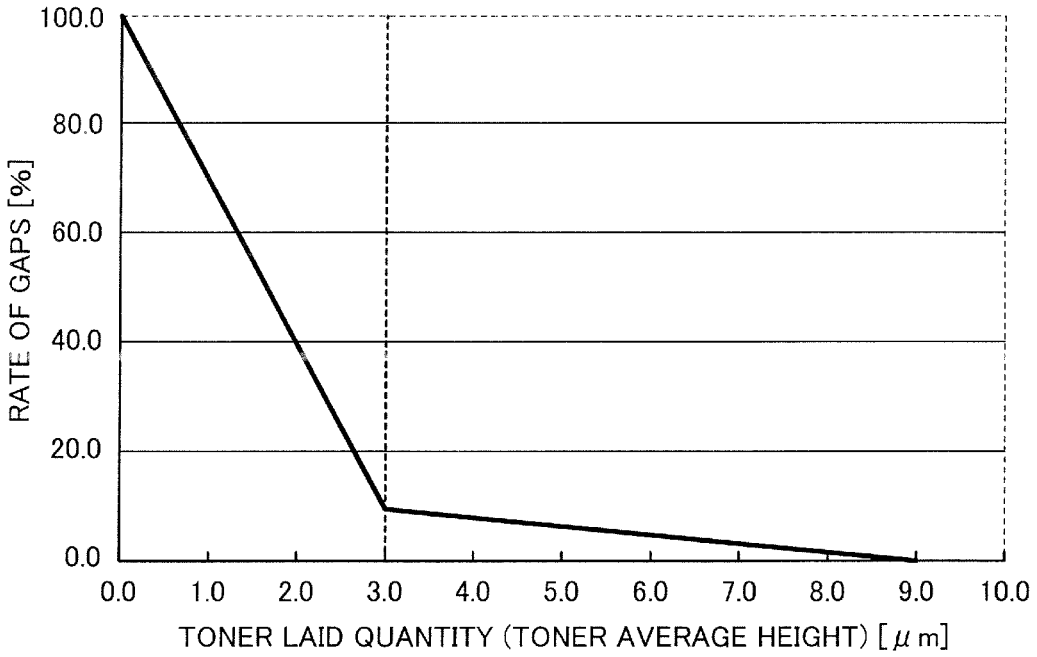
FIG. 17 is a graph showing a relationship between a toner laid quantity and a rate of gaps when the toner particle size is 6 μm.

FIG. 17 is a graph showing an exemplary relationship between the toner laid quantity (average height) when a toner particle size is 6 μm and the rate of gaps obtained from the relational expressions described above. In the graph, a boundary line indicated by a dot line indicates the toner laid quantity in the ideal array condition. A range where the toner quantity is smaller than that of the boundary line is a range where the gaps are produced, and is indicated by a part of a curve obtained based on the above equations. A range where the toner quantity is larger than that of the boundary line is a range where the gaps are zeroed (masking rate is 100%) when the three layers are laid in the ideal array condition as explained in connection with FIG. 15, and is indicated by another part of the curve. It can be seen from this curve that the gaps are widened sharply, i.e., the masking rate drops, when the toner laid quantity is reduced to be less than that of the ideal array condition (boundary line). It can be also seen that the reduction of gaps changes less (the masking rate is less improved) when the toner quantity exceeds that of the ideal array condition even when the toner quantity is increased to the range exceeding the boundary line.

While the condition when the toner particle size is 6 μm has been explained as one example here, the changes bordering on the boundary line are not limited to this case, and it is needless to say that the changes are applicable to all toner particle sizes within a normal use range.

An object of the present embodiment is the zone B in FIG. 14 or the range where the toner quantity is smaller than that of the boundary line in FIG. 17, i.e., the range where the toner quantity is smaller than the ideal array condition (most closely packed). The present embodiment also reproduces more adequate color, or more specifically, improves the masking rate of a monochrome sheet and coloring of a secondary color by favorably overlapping different toners even if there exist gaps between the toners that are produced in principle within such range.

Meanwhile, no coloring loss is caused by array of toners in the zone A in FIG. 14 and in the range in which the toner quantity is larger than that of the boundary line in FIG. 17, i.e., in the conventional case in which there exist enough toner quantity with respect to toner particle size, because the toner quantity is sufficient.

While the toner laid quantity has been described by the "toner cubic volume per unit area (μm)" (=average height) so far in considering the toner array condition, normally "weight per unit area ($mg/cm^2$) is used in measuring and controlling the toner laid quantity. When the density ρ [$g/cm^3$] is taken into account in conformity with that, the equation expressing the ideal array condition (the condition in which the perfect globular toners are closely packed) described above is transformed in terms of the toner laid quantity M [$mg/cm^2$] as the following equation 9 (1/10 included in the equation matches units):

$$M = \rho \times H1 = \rho \times \frac{1}{10} \times \frac{\pi L^3}{3\sqrt{3}L^2} = \frac{\rho\pi L}{30\sqrt{3}} \tag{9}$$

That is, in a condition in which the toner laid quantity M is smaller than a toner laid quantity of less than $\rho\pi L/(30\sqrt{3})$, a secondary color overlap condition remarkably drops and chromaticness of the secondary color drops in response to the drop of the toner laid quantity. Then, the present embodiment is configured to improve the chromaticness of the secondary color by spreading the toners also in a horizontal direction, other than a vertical direction, by applying a force in a direction oblique to the toner overlap direction (normal direction on the surface of the recording medium) in a process of fixing a non-fixed image. That is, when it is required to assure the chromaticness (coloring), the toners are spread in a slip direction by applying the force in the slip direction (a direction of a plane of the recording medium in the present embodiment) orthogonal to a direction in which the toners are laminated to the toner image passing through the fixing nip portion of the fixing apparatus.

Figure 18A:
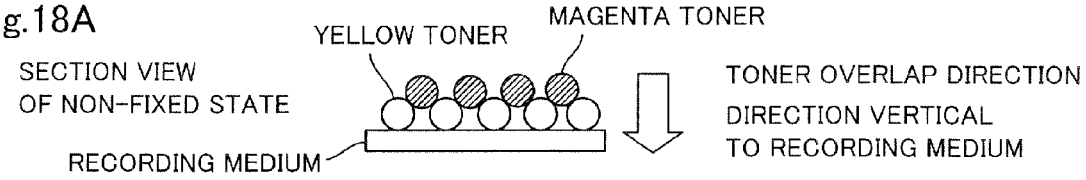
FIG. 18A is a section view in a non-fixed state when two color toners are superimposed on a recording medium.
Figure 18B:
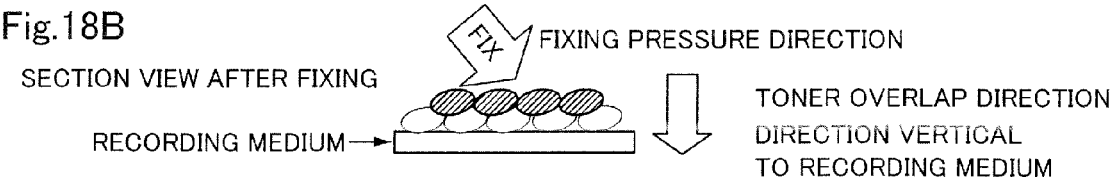
FIG. 18B is a section view after slip fixing when the two color toners are superimposed on the recording medium.

A fixing method of applying the force in the direction oblique to the toner overlap direction in the process of fixing a non-fixed image will be explained. FIG. 18A is a section view in the non-fixed state when two colors of toners, e.g., yellow and magenta toners, are superimposed on the recording medium such as a sheet by the image forming apparatus using the electro-photographic technique, and FIG. 18B is a section view after fixing the toners. As shown in FIGS. 18A and 18B, the toner overlap direction (lamination direction) is a direction in which the two colors of toners overlap in a direction vertical to the recording medium.

As described above, this fixing method of applying the force in the direction oblique to the toner overlap direction as shown in FIG. 18B improves the chromaticness by spreading the toners also in the horizontal direction, other than vertical direction on the recording medium. This fixing method will be called as a "slip fixing method" hereinafter.

While this fixing method of applying the force in the direction oblique to the toner overlap direction improves coloring, it may thicken a line as described above. Reasons why the coloring is improved and a line is thickened by applying the force in the direction oblique to the toner overlap direction in the process of fixing a non-fixed image will now be explained.

Figures 19A, 19B, 19C, 19D, 19E, 19F, 19G, 19H:
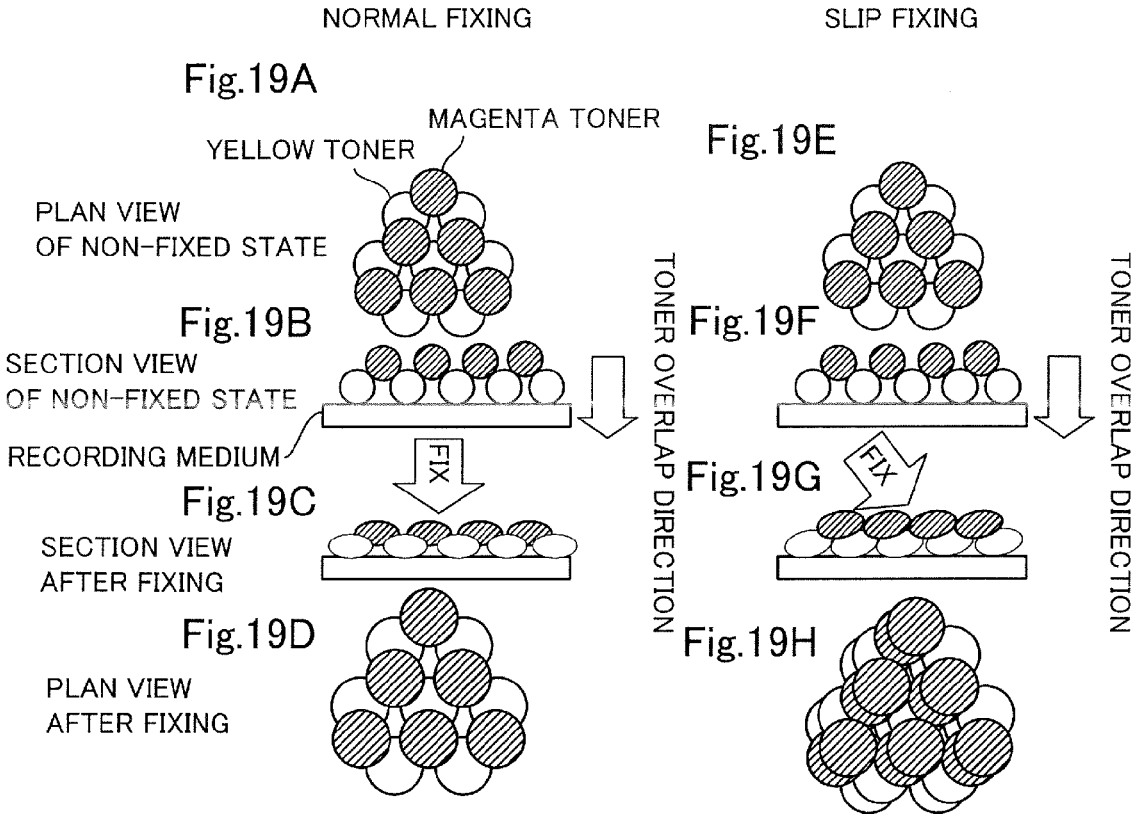
FIG. 19A is a plan view showing a toner image in a non-fixed state in normal fixing.
FIG. 19B is a section view showing the toner image in the non-fixed state in the normal fixing.
FIG. 19C is a section view showing the toner image after fixing in the normal fixing.
FIG. 19D is a plan view showing the toner image after fixing in the normal fixing.
FIG. 19E is a plan view showing the toner image in a non-fixed state in slip fixing.
FIG. 19F is a section view showing the toner image in the non-fixed state in the slip fixing.
FIG. 19G is a section view showing the toner image after fixing in the slip fixing.
FIG. 19H is a plan view showing the toner image after fixing in the slip fixing.

FIGS. 19A through 19H illustrate cases of forming a solid image of two colors, e.g., a yellow toner solid image and a magenta toner solid image, by an image forming apparatus using electro-photographic technique on a recording medium such as a sheet in the condition in which the toner laid quantity M is in the relationship equal or smaller than $\rho\pi L/(30\sqrt{3})$. FIGS. 19A and 19E are plan views in the non-fixed state, FIGS. 19B and 19F are section views in the non-fixed state, FIGS. 19C and 19G are section views after fixing the toners, FIGS. 19D and 19H are plan views after fixing the toners.

As shown in FIGS. 19A through 19D, a normal fixing operation is carried out by applying a force in the same direction with the toner overlap direction, so that there is no slip stress in a sheet horizontal direction and the toners are fixed without spreading so much in the horizontal direction of the recording medium. Due to that, as shown in FIGS. 19 through 19D, mixed color areas where the magenta toners overlap on the yellow toners are narrow. Therefore, the chromaticness is not enhanced so much and coloring is low. However, because the toners do not spread so much in the horizontal direction on the recording medium, a line is not thickened so much in the fixing process and reproducibility of a line is good.

Meanwhile, the slip fixing operation is carried out by applying a force obliquely with respect to the toner overlap direction, a slip stress in the sheet horizontal direction is generated and the toners are fixed on the recording medium by being deformed in the horizontal direction. Therefore, as shown in FIGS. 19E through 19H, there exist many color mixed areas where the magenta toners overlap on the yellow toners. Due to that, the chromaticness is enhanced and coloring is improved. However, because the toners spread widely in the horizontal direction of the recording medium, a line may thickened in the fixing process and reproducibility of a line is low.

Figure 20A:
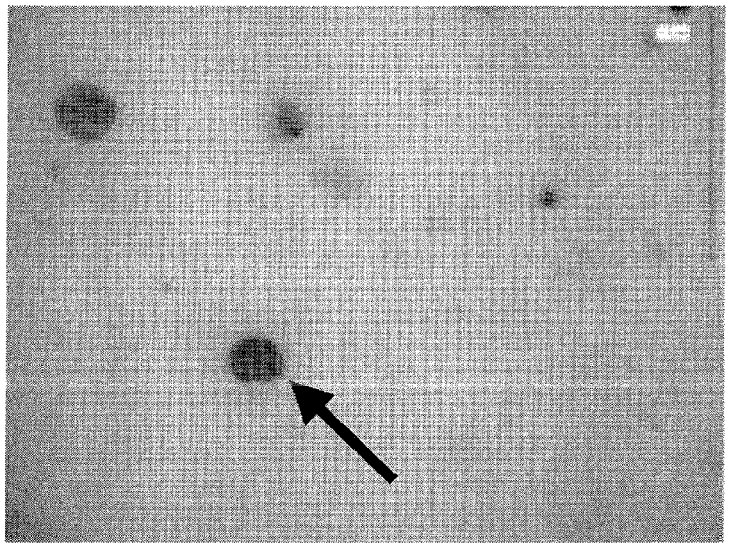
FIG. 20A is a picture, observed by a microscope, of a condition after fixing toners on a coated sheet by the normal fixing process.
Figure 20B:
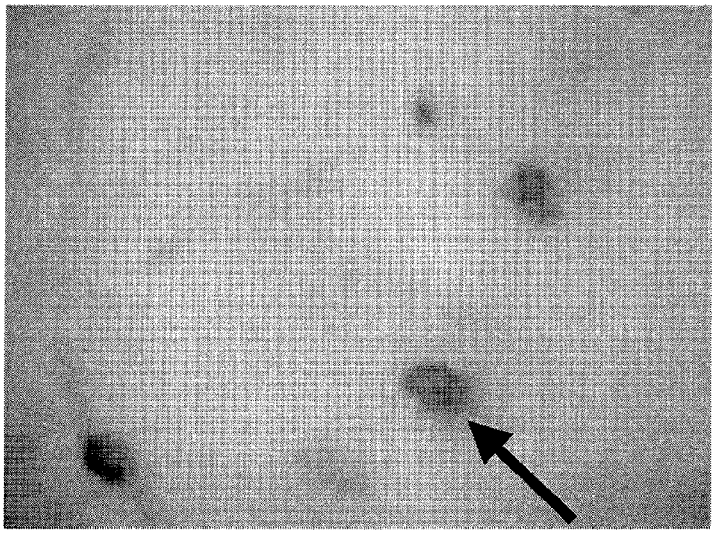
FIG. 20B is a picture, observed by the microscope, of a condition after fixing toners on a coated sheet by the slip fixing.

FIG. 20A is a picture, observed by a microscope, of a condition after fixing toners on a coated sheet by the normal fixing process and FIG. 20B is a picture, observed by the microscope, of a condition after fixing toners on a coated sheet by the slip fixing process. An arrowed dark point in the picture is a condition after fixing one toner. As shown in FIG. 20B, the toner is formed into a shape extending in an oblique direction (in a direction of an arrow) by slip stress in the sheet horizontal direction applied within the fixing nip portion and a resultant force in an advance direction in the slip fixing process. In contrary to that, the toner does not spread so much in the horizontal direction in the normal fixing process as shown in FIG. 20A because no slip stress in the sheet horizontal direction is applied and only pressure in the sheet vertical direction is applied.

As described above, the toner spread widely in the horizontal direction on the recording medium in the slip fixing process, so that the overlap of toners of the lower and upper layers increases, color mixture advances and the coloring is enhanced However, because the toner spread non-uniformly and widely in the horizontal direction, the reproducibility of a line drops.

Meanwhile, although the toner does not spread so much in the horizontal direction of the recording medium in the normal fixing process so that the overlap of the toners does not increase and coloring is not enhanced, the reproducibility of a line is good because the toner spreads narrowly and uniformly in the horizontal direction.

Table 1 summarizes advantages and disadvantages of the slip fixing and normal fixing processes when the toner consumption is low:

TABLE 1

| TONER CONSUMPTION | FIXING METHOD | ADVANTAGE | DISADVANTAGE |
|---|---|---|---|
| LOW TONER CONSUMPTION | SLIP FIXING | GOOD COLORING GOOD LINE | LINE THICKENED BAD COLORING |
| | NORMAL FIXING | | |

Advantages of implementing the slip fixing in the state in which the toner consumption is low are that the toners are mixed well and coloring is enhanced even if a toner quantity is small because one toner spreads widely in the horizontal direction. Disadvantages thereof are that a line width is widened, it becomes hard to reproduce a thin line, and printing quality of letters drops because the toner spread widely in the horizontal direction. Meanwhile, advantages of implementing the normal fixing when the toner consumption is low are that a line is not thickened so much and the reproducibility of a thin line is good because the toner does not spread widely in the horizontal direction. Disadvantages thereof are that the color toners are not mixed well and coloring is hampered because the toner does not spread in the horizontal direction.

[Fixing Apparatus]

In view of such circumstance, the fixing apparatus 9 is configured as follows in the present embodiment. The fixing apparatus 9 of the present embodiment will be described with reference to FIGS. 21 through 26.

Figure 21:
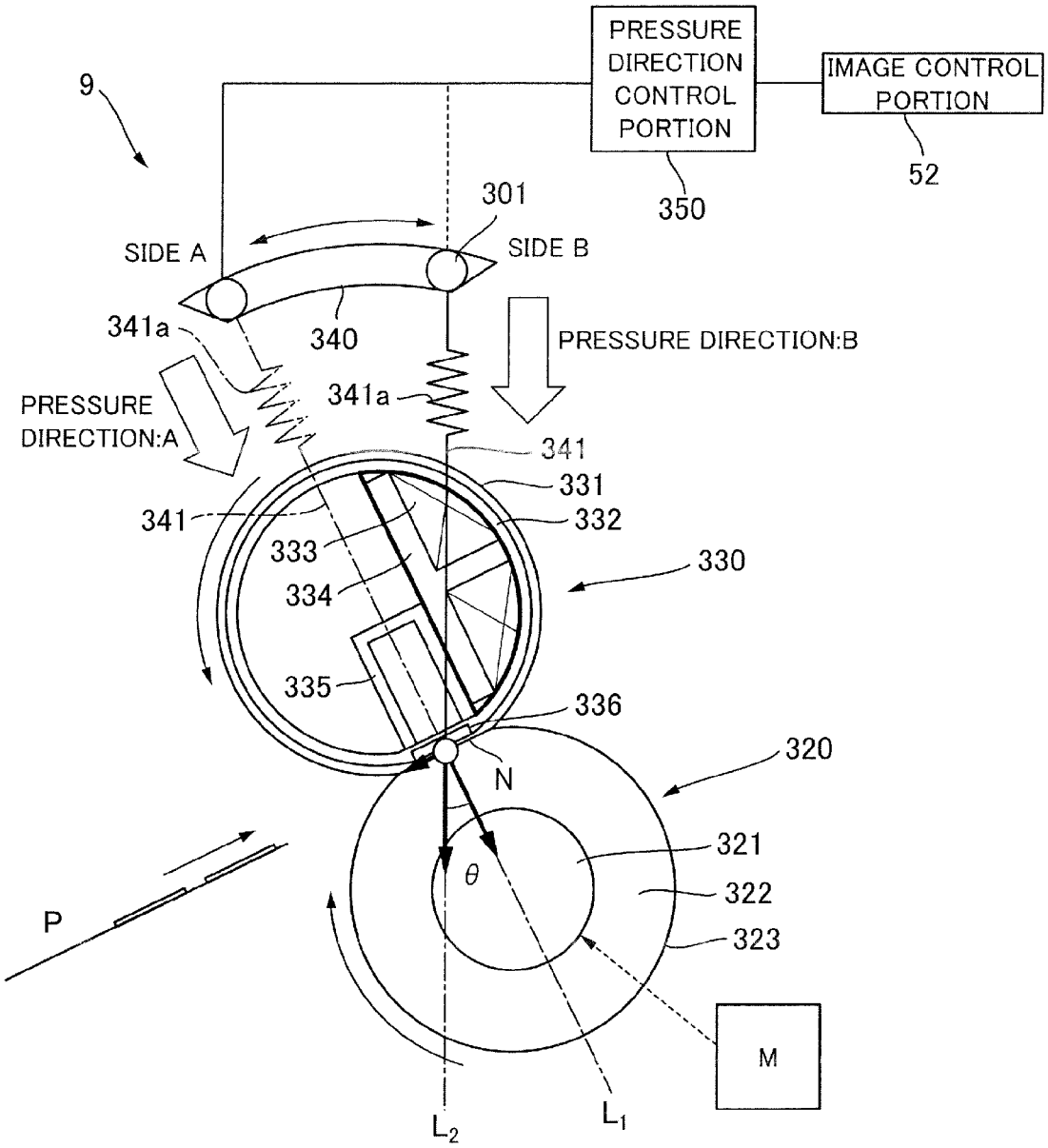
FIG. 21 is a section view schematically showing a configuration of a fixing apparatus of the first embodiment.

FIG. 21 is a schematic section view showing one example of the fixing apparatus 9 of the present embodiment. The fixing apparatus 9 is a belt heating type fixing apparatus using electromagnetic inductive heating. As shown in FIG. 21, the fixing apparatus includes a heating unit 330, i.e., a heating member (heating rotator) including a heater, a cylindrical fixing film 331, i.e., an electromagnetic inductive heating rotator having an electromagnetic inductive heating layer (conductor layer, magnetic layer and resistant layer), and a film guide member 332 around which the cylindrical fixing film 331 is loosely fitted. A magnetic field generating portion includes an exciting coil 333 disposed within the film guide member 332 and an E-type magnetic core (core member) 334. The fixing apparatus further includes a pressure roller 320 having elasticity as a nip forming member that forms a fixing nip portion N by coming in contact with the heating unit 330. The pressure roller 320 is in pressure contact with a sliding member 336 disposed on a lower surface of the film guide member 332 by sandwiching the fixing film 331 with a predetermined contact pressure force while forming the fixing nip portion N of a predetermined width. The heating unit 330 also includes a pressing rigid stay 335. The magnetic core 334 of the magnetic field generating portion is disposed such that it corresponds to the fixing nip portion N.

The pressure roller 320 is rotationally driven clockwise as indicated by an arrow by a motor M, i.e., a driving portion. As the pressure roller 320 rotates, a rotational force acts on the fixing film 331 by a frictional force between the pressure roller 320 and the fixing film 331. The fixing film 331 rotates by being guided by the film guide member 332 while adhering and sliding its inner surface with the sliding member 336 disposed at the under surface of the film guide member 332 at the fixing nip portion N. The fixing film 331 rotates counterclockwise as indicated by an arrow in FIG. 21 with circumferential velocity substantially corresponding to rotational circumferential velocity of the pressure roller 320 (pressure roller driving method). In this condition, the fixing film 331 rotates with certain degree resistance by friction of the sliding member 336 adhering on the inner surface thereof. Because the fixing film 331 that receives the rotational force rotates with the resistance, a shearing force is suitably and effectively applied on a toner image on the recording medium P between the film 331 and the pressure roller 320 on the driving side.

The film guide member 332 plays roles of pressing the fixing nip portion N, of supporting the exciting coil 333 and the magnetic core 334 as the magnetic field generating portion, of supporting the fixing film 331 and of keeping conveyance stability when the fixing film 331 rotates. An insulating member that does not hamper transmission of magnetic fluxes and can sustain a high load is used for the film guide member 332.

The exciting coil 333 generates alternating magnetic fluxes by an alternating current supplied from an exciting circuit not shown. The alternating magnetic fluxes are distributed intensively to the fixing nip portion N by the E-type magnetic core 334 that corresponds to the position of the fixing nip portion N. The alternating magnetic fluxes generates eddy current in an electromagnetic inductive heating layer of the fixing film 331 a fixing nip portion N. The eddy current generates Joule heat in the electromagnetic inductive heating layer by intrinsic resistance of the electromagnetic inductive heating layer. The electromagnetic inductive heating of the fixing film 331 is intensively generated at the fixing nip portion N where the alternating magnetic fluxes are intensively distributed, and thus the fixing nip portion N is heated efficiently. Temperature of the fixing nip portion N is controlled such that its temperature is kept at predetermined level by controlling the supply of the electric current to the exciting coil 333 by a temperature control system including a temperature detection portion not shown.

Temperature of a surface of the fixing film 331 is controlled to be 170° C. by a contact thermistor not shown in the fixing apparatus 9 described above. Then, the toner image is fixed to the recording medium when the recording medium on which the toner image has been transferred passes through the fixing nip portion N.

Still further, in the case of the present embodiment, the fixing apparatus 9 includes a pressure direction switching device 340, i.e., a pressure direction changing portion, and a pressure direction control portion 350 as a control portion that controls the pressure direction switching device 340. The pressure direction switching device 340 functions also a force applying portion that is capable of applying a force on the toner image passing through the fixing nip portion N in the slip direction (the direction of the plane of the recording medium, the direction of the plane referred to simply as "plane direction" herein after) orthogonal to the toner laminating direction. The pressure direction control portion 350 is capable of executing first and second modes in which spreads of the toner image widened in the slip direction (the plane direction) are different from each other, and controls the pressure direction switching device 340 such that the spreads of the toner image widened in the slip direction (the plane direction) in the first mode is greater than the spread of the toner image widened in the second mode.

That is, in the first mode, the fixing nip portion N is put into the slip fixing mode in which the slip fixing is executed by fixing the toner image by applying forces in the toner laminating direction and in the slip direction. In the second mode, the fixing nip portion N is put into the normal fixing mode in which the normal fixing is executed by fixing the toner image without applying the force in the slip direction. The fixing nip portion N is configured such that the slip fixing mode and the normal fixing mode can be switched. The configuration of the fixing apparatus 9 capable of switching the fixing process in the first and second modes will now be explained specifically.

The fixing apparatus 9 can set the pressure direction such that it is aligned with a direction $L_2$ having an angle θ with respect to a line direction $L_1$ of the normal line of the sliding surface of the sliding member 336 (substantially in the toner laminating direction) by the pressure direction switching device 340. A pressing method is not specifically limited, and a spring or the like can be used. Specifically, upon setting an angle of the heating unit 330 at θ such that the normal line direction of the adhesion surface of the fixing film 331 of the sliding member 336 is aligned with the direction $L_1$, a pressure spring 341*a*, i.e., a pressure portion, is additionally provided to the heating unit 330 in a direction of $L_2$. The pressure direction can be aligned with $L_2$ by arranging such that the heating unit 330 is pressed in the $L_2$ direction by a guide member not shown. The pressure in the abovementioned configuration is set at 600 N.

Figure 22:
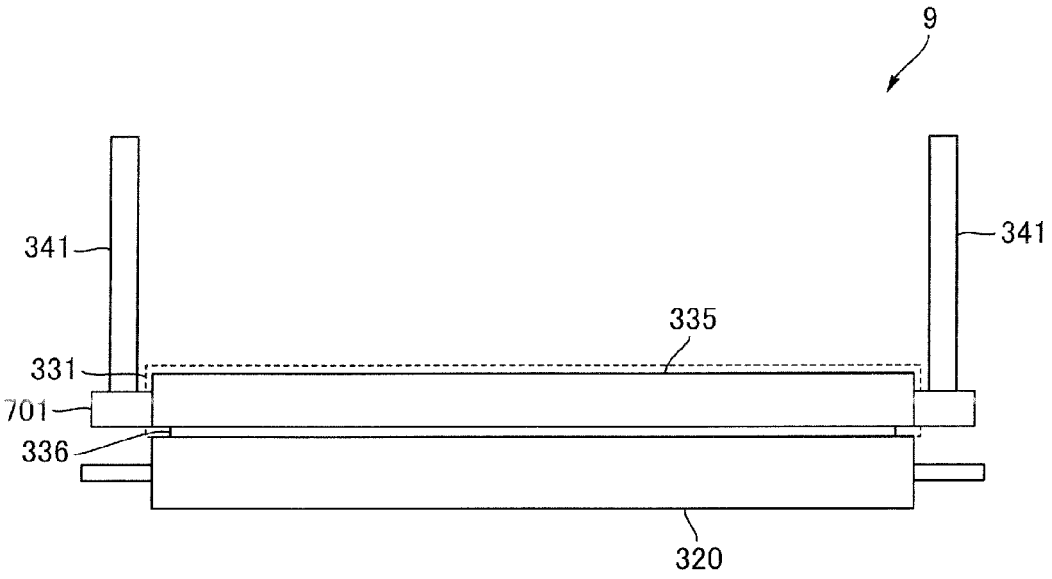
FIG. 22 is a front view schematically showing the configuration of the same fixing apparatus.

FIG. 22 illustrates the fixing apparatus 9 in FIG. 21 seen from the front side (the side where the sheet enters). Note that the fixing film 331 is made transparent in FIG. 22. FIG. 22 shows the sliding member 336, the pressing rigid stay 335, a flange member 701 and a pressure shaft 341. The fixing apparatus 9 presses the flange member 701 by a pressure spring 341*a* (see FIG. 21) through the pressure shaft 341. The flange member 701 is combined with the pressing rigid stay 335 and the sliding member 336, and the pressing rigid stay 335 and the sliding member 336 are pressurized toward the pressure roller 320 as the flange member 701 is pressurized. Then, the fixing nip portion N is formed by the pressurized sliding member 336 and the pressure roller 320.

Arrows near the fixing nip portion N in FIG. 21 indicate directions of forces acting on the fixing nip portion N, and shows a force in the $L_2$ direction and its component force. A pressure is applied in the oblique direction with respect to the toner overlap direction (laminating direction) to increase the component force (shearing force) applied to the toners in the slip direction (plane direction). Thereby, the toners spread in the slip direction, so that areas where different colors toners overlap with each other in forming a secondary color increase in particular, thus increasing chromaticness and color gamut. The more the angle θ, the more the shearing force to be applied to the toners and its effect increase. However, if the angle at θ is increased too much, a drop of fixity occurs because the pressure in the toner overlap direction becomes insufficient. It becomes also difficult in terms of the configuration of the apparatus to stably keep the highly-angled pressure direction. Therefore, the angle θ is determined by taking coloring of the secondary color and the stability of the pressure direction into account.

Figure 23A:
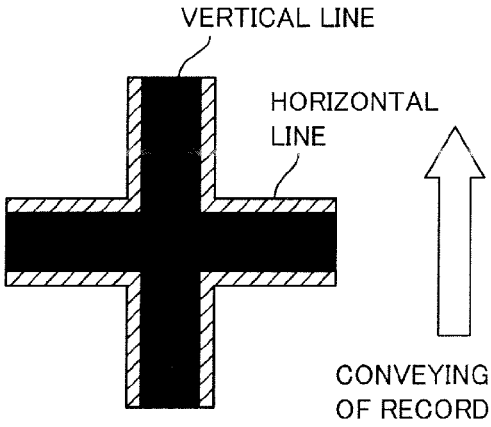
FIG. 23A is a schematic diagram explaining an increase of a total line width by the normal fixing.
Figure 23B:
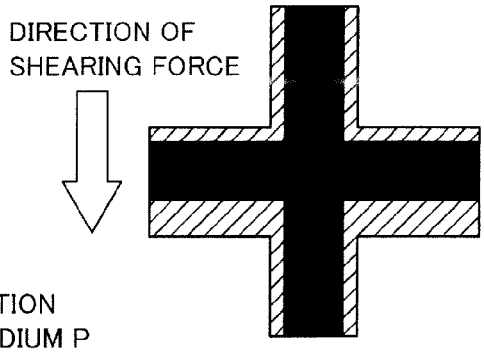
FIG. 23B is a schematic diagram explaining an increase of a total line width by the slip fixing.

In the fixing apparatus 9 of the present embodiment, an "increment of total line width" is defined as an index for assessing magnitude of the force (shearing force) of spreading the toner in the slip direction. The increment of total line width will be explained with reference to FIGS. 23A and 23B. FIG. 23A illustrates one exemplary condition of a line image before and after fixing the image when the normal fixing (θ=0) is implemented by the fixing apparatus 9. FIG. 23B illustrates one exemplary condition of a line image before and after fixing the image when the slip fixing (θ=60° in the present embodiment) is implemented by the fixing apparatus 9. Black parts indicate the lines in non-fixed states and hatched parts indicate states of the lines widened by fixation, respectively.

The toner line image is pressed substantially in the same direction with the toner overlap direction in the normal fixing shown in FIG. 23A, so that the toner line image is widened substantially uniformly regardless of directions of the line. In contrary, the shearing force is applied in the slip fixing in FIG.

23B, so that the toner line image is widened largely depending on the direction of the shearing force. Utilizing these differences, the index for assessing the shearing force applied to the fixing apparatus 9 is provided.

The line in the same direction with a conveying direction of the recording medium P will be referred as a vertical line, and the line in a direction vertical to the vertical line will be referred to as a horizontal line hereinafter. Then, measurements are carried out on resultant widths of the line after implementing the normal fixing by applying the force in the toner overlap direction and after implementing the slip fixing by applying the shearing force. The resultant line width of the normal fixing is subtracted from the resultant line width of the slip fixing for each of the vertical and horizontal lines to define as an increment of vertical line width and an increment of horizontal line width, respectively. In order to define further as a spread of the toner in the in-plane direction, not depending on the direction of the shearing force, the following equation 10 is defined as an "increment of total line width":

$$\sqrt{(\text{increment of vertical line width})^2 + (\text{increment of horizontal line width})^2} \quad (10)$$

Figure 24A:
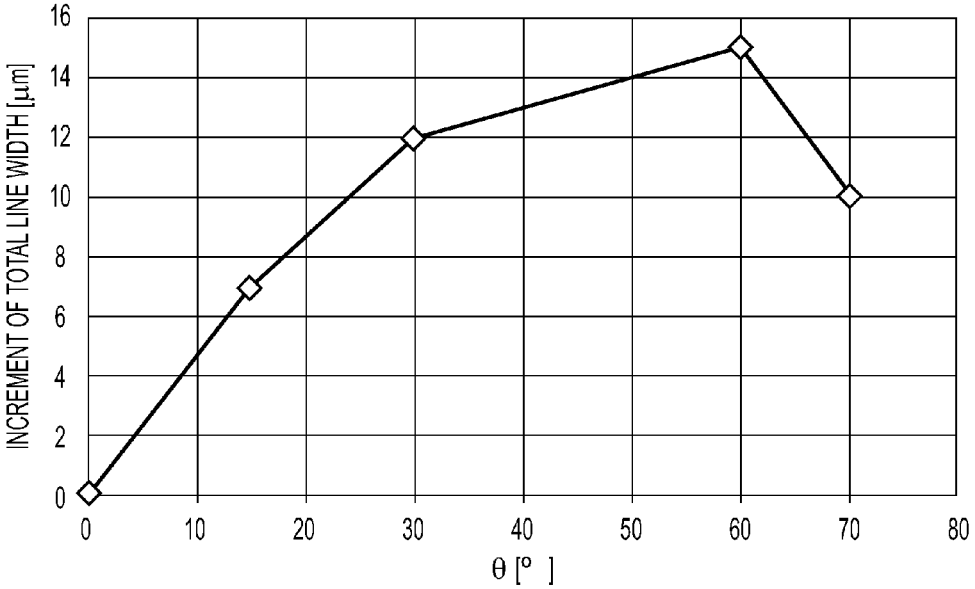
FIG. 24A is a graph showing a relationship between an angle θ of a pressure direction and an increase of a total line width.
Figure 24B:
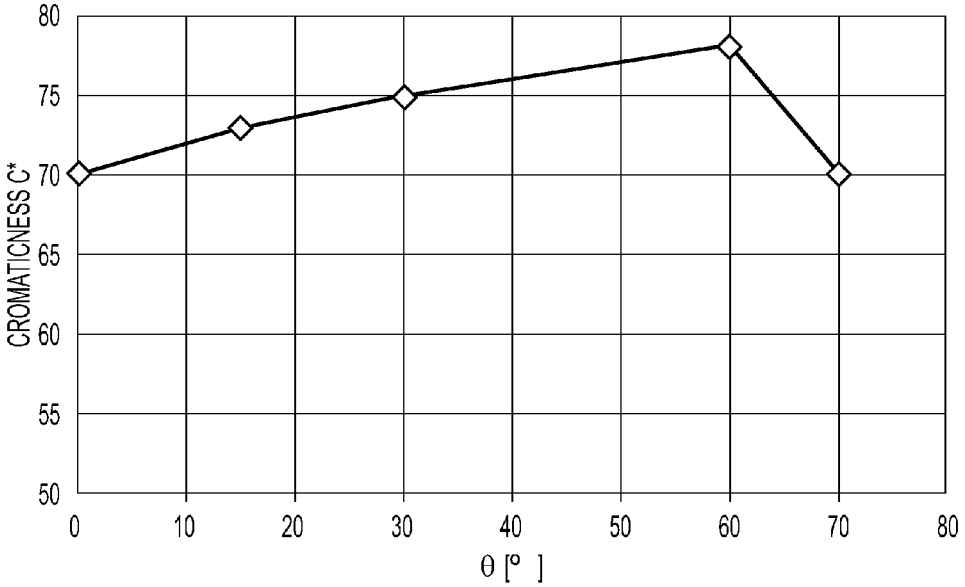
FIG. 24B is a graph showing a relationship between the angle θ of the pressure direction and vividness.

FIG. 24A is a graph indicating a relationship between the angle θ and the increment of total line width, and FIG. 24B is a graph indicating a relationship between the angle θ and chromaticness (C*) of green color obtained by superimposing solid images of yellow toners and cyan toners. The line width was measured by using a microscope or PIAS made by Quality Engineering Associates (QEA) Co.

The chromaticness C* is expressed by $C^*=\sqrt{((a^*)^2+(b^*)^2)}$ in (L*, a*, b*) which are color coordinates in a CIELAB space, i.e., a color space. The color coordinate is a value measured by Gretag Macbeth Spectro Scan (Gretag Macbeth AG: Status Code A).

An increase of the chromaticness is connected with an increase of the increment of total line width as seen from FIGS. 24A and 24B. When the increment of total line width increases, the shearing force acts on the toners, and the toners spread in the slip direction and mask the recording medium P. In particular, the areas where the different colors of toners overlap with each other in the secondary color increase, so that coloring is improved.

As described above, however, if the angle θ is increased too much, the drop of fixity occurs and coloring drops because the pressure in the toner overlap direction becomes insufficient. It becomes also difficult in terms of the configuration of the apparatus to stably keep the highly-angled pressure direction.

In view of the above conditions, the angle θ formed between the inter-axes direction $L_1$ and the pressure direction $L_2$ at 60° as one exemplary condition of the slip fixing of the present embodiment. Thereby, the chromaticness C* of the secondary color increased by about 10 as compared to the case when the angle θ is 0°. The increment of total line width which is the index of the magnitude of the shearing force was around 15 μm at this time.

Next, the pressure direction switching device 340 that changes the angle θ formed between the inter-axes direction L1 and the pressure direction L2 as described above depending on the image forming modes in the fixing apparatus 9 will be explained. As shown in FIG. 21, the fixing apparatus 9 includes the pressure direction control portion 350, the pressure direction switching device 340, and the pressure shaft 341 having the pressure spring 341*a* that bias the heating unit 330 toward the pressure roller 320. When a signal is transmitted to the pressure direction control portion 350 from the image control portion 52, the pressure direction control portion 350 control the pressure direction switching device 340 and moves the pressure shaft 341 to control the pressure direction. That is, it is possible to change the pressure direction in a direction inclined with respect to the toner laminating direction.

The pressure direction switching device 340 can set the angle θ at 0° by setting the pressure shaft 341 on the pressure direction A side. That is, this is the normal fixing condition in which the pressure is applied in the same direction with the toner overlap direction. Meanwhile, the pressure direction switching device 340 can set the angle θ at 60° by setting the pressure shaft 341 on the pressure direction B side. That is, this is the slip fixing condition in which the pressure is applied in the oblique direction with respect to the toner overlap direction.

Figure 25:
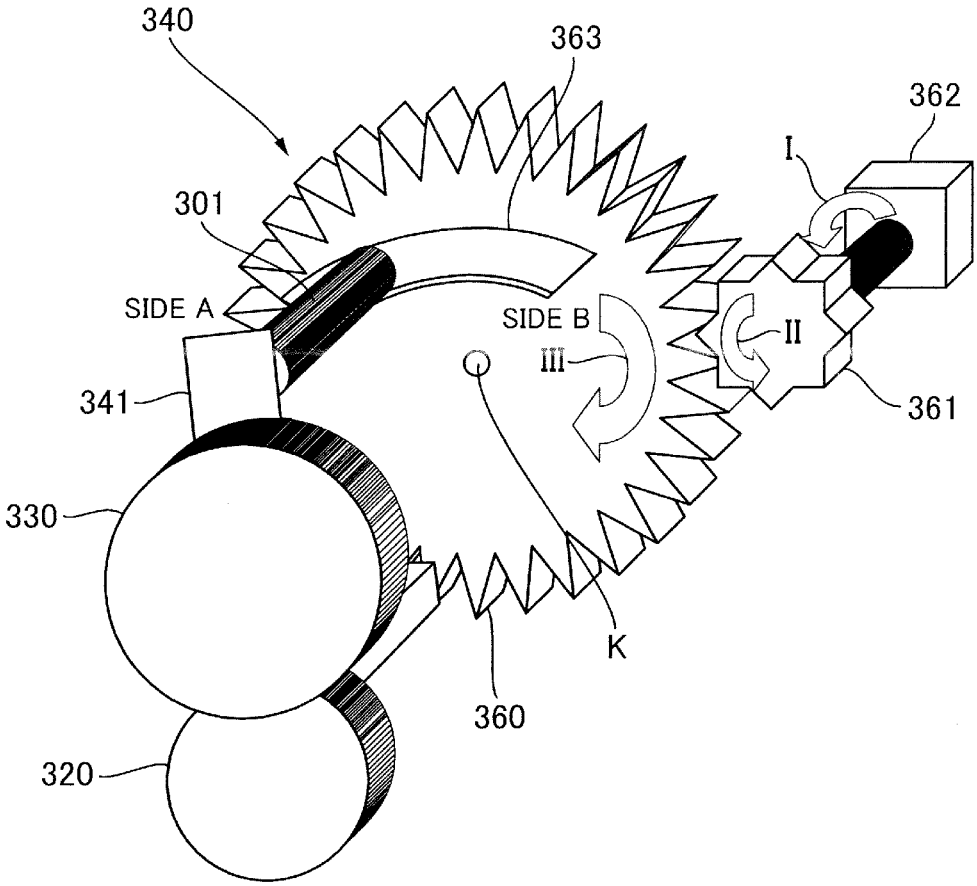
FIG. 25 is a perspective view schematically showing a configuration of changing the pressure direction of the fixing apparatus of the first embodiment.

The structure of the pressure direction switching device 340 will now be described with reference to FIG. 25. In FIG. 25, the pressure direction orients in the direction A, indicating that the fixing condition is normal. As shown in FIG. 25, the pressure direction switching device 340 includes a 362 and a small gear 361 attached at an edge of a shaft of the motor 362, and a large gear 360 which meshes with the small gear 361. When the motor 362 rotates, the small gear 361 is rotationally driven and as the small gear 361 rotates, the large gear 360 also rotates. The large gear 360 and the pressure shaft 341 are formed integrally through an intermediary of a switching shaft 301. An axial center of rotation of the large gear 360 is indicated as K in FIG. 25. When the large gear 360 rotates centering on the center of the rotational axis K, the pressure shaft 341 also rotates.

When the pressure direction is switched from the direction A to the direction B in FIG. 25, the motor 362 is rotated in a direction of an arrow I. Then, the small gear 361 rotates in a direction of an arrow II, and the large gear 360 rotates in a direction an arrow III. As a result, the pressure shaft 341 moves from the direction A to the direction B, and the pressure direction is set in the direction B.

The pressure direction switching device 340 also includes a pressure direction retaining member 363, and when the pressure shaft 341 comes to the side B at an edge of the pressure direction retaining member 363, the angle θ of the pressure direction is set at 60° as described above. The pressure direction retaining member 363 also functions as a stopper, and blocks the pressure shaft 341 from being set at more than θ=60°.

The pressure direction switching device 340 is provided on both ends of the heating unit 330, and switches the pressure direction by driving the both ends in the same manner. It is noted that the pressure direction can be switched from the B side to the A side by reversing the driving direction of the motor 362 from the case described above.

Figure 26:
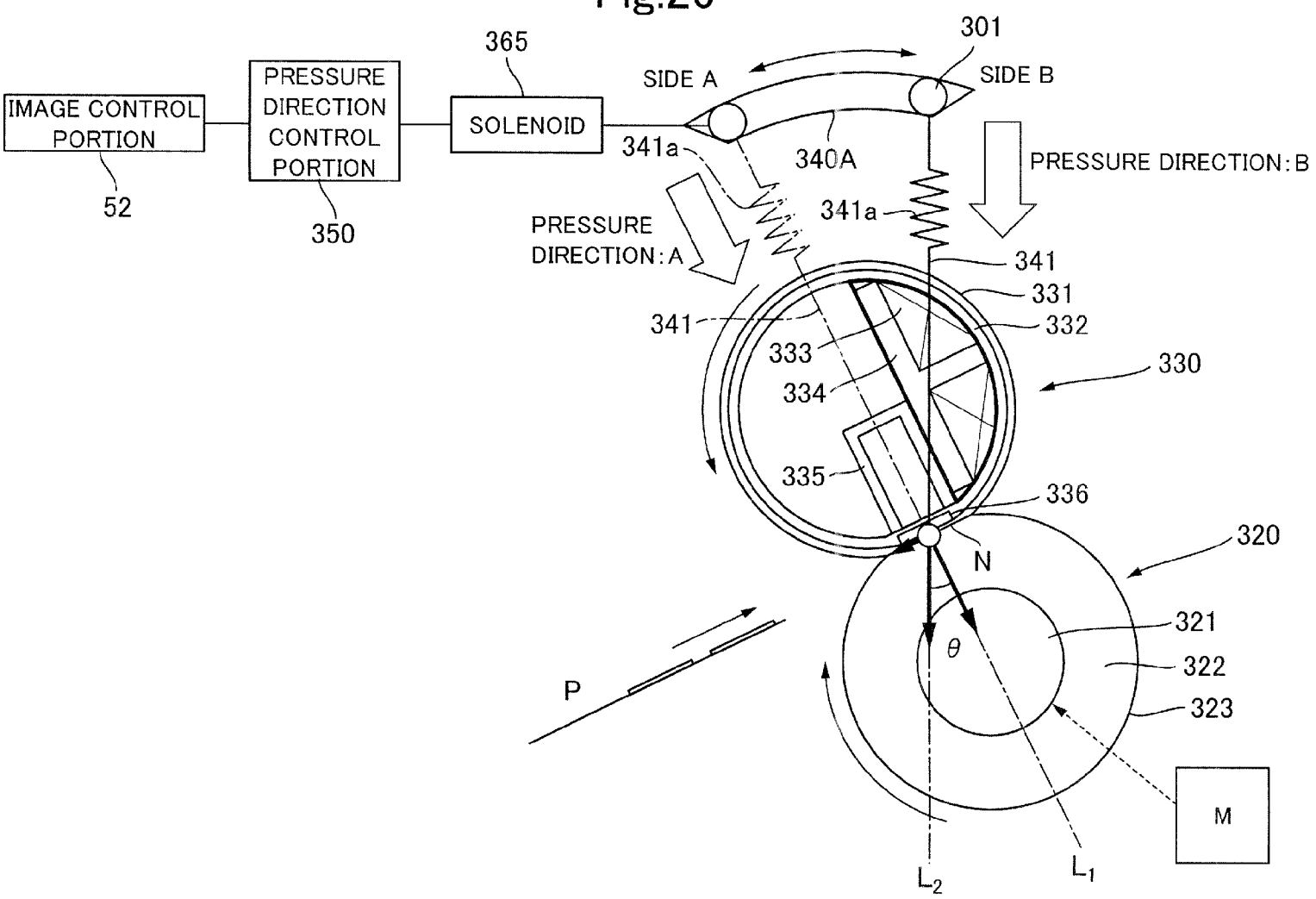
FIG. 26 is a perspective view schematically showing another configuration of changing the pressure direction of the fixing apparatus of the first embodiment.
Figure 27:
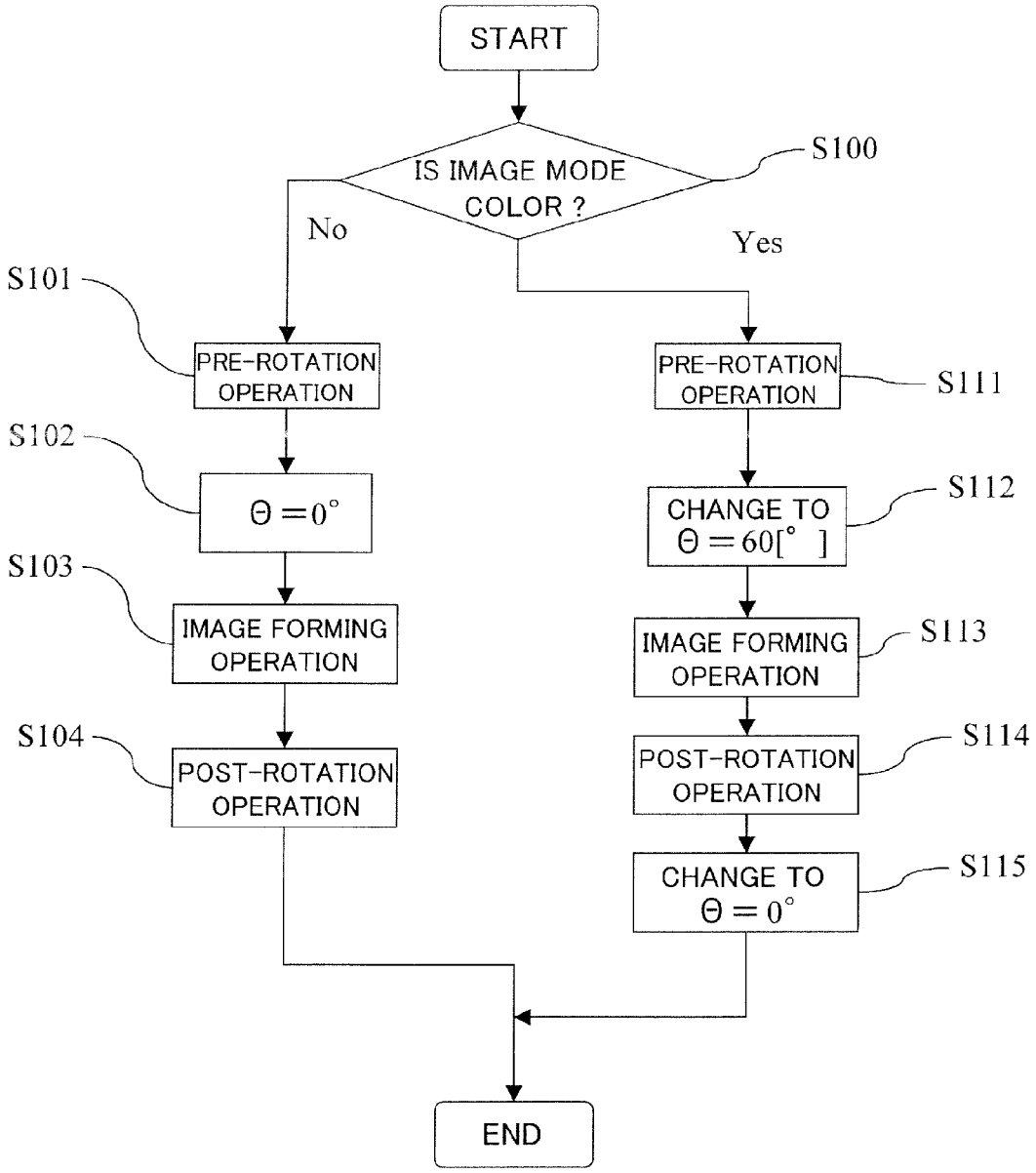
FIG. 27 is a flowchart showing image forming operations of the first embodiment.

The structure of the pressure direction switching unit as described above may be modified as shown in FIG. 26 for example. A pressure direction switching device 340A shown in FIG. 26 is configured such that an angle of the pressure shaft 341 is changed by a solenoid 365 which is an electromagnetic functional part that transforms electrical energy to a mechanical linear movement. Then, the pressure direction is in the direction A in a condition in which no voltage is applied to the solenoid 365. The solenoid 365 is configured such that when a voltage is applied to the solenoid 365, an edge shaft of the solenoid 365 jumps out and changes the pressure direction in the direction B. It is noted that this relationship may be reversed.

In any configuration, the pressure direction of the fixing apparatus 9 during standby time is the direction A, i.e., θ which is the angle of the pressure direction in the normal direction (substantially in the toner overlap direction) $L_1$ of the sliding surface of the sliding member 336 is set at 0° in the present embodiment.

It is noted that although the configuration in which the heating unit 330 is pressed toward the pressure roller 320 has been shown in the above explanation, it is possible to arrange such that the pressure roller 320 is pressed toward the heating unit 330. In this case, a direction of pressing the pressure roller 320 is made changeable by the pressure direction switching unit as described above. In short, the pressure direction switching device 340 is configured to press one member toward another member and to switch the pressure direction among the heating unit 330 and the pressure roller 320.

Next, a flow of image forming operations of the present embodiment configured as described above will be explained with reference to FIG. 27. When the image forming operation is started, the control portion 50 judges whether a document image is a color image or a monochrome image in Step S100. The method for judging whether or not the document image is a color image has been described above in connection with FIGS. 6 and 7. It is noted that there is a case when this judgment is made by the control portion 50 from an image mode selected by the user, besides the case of judging automatically from an image sent from the read image or from a personal computer. In any case, when it is judged to execute a color image forming operation, the mode is changed to the full color mode, and when it is judged to execute a monochrome image forming operation, the mode is changed to the monochrome mode, respectively in Step S100.

Here, the full color mode is the coloring preceding mode (first mode) of preceding coloring and the monochrome mode is the line image preceding mode (second mode) of enhancing the reproducibility of a line image as described above. The present embodiment is set such that the spread of the toner image in the slip direction is larger in the full color mode (first mode) than that in the monochrome mode (second mode).

Specifically, if the judgment is "No", i.e., the monochrome mode, in Step S100, a pre-rotation operation is started in Step S101, and information of the monochrome mode is transmitted to the pressure direction control portion 350 through the image control portion 52. Because the mode is the monochrome mode, the pressure direction control portion 350 does not drive the pressure direction switching device 340 and sets the pressure direction of the heating unit 330 on the side A as it is in the same manner with time during which no image is formed. That is, the pressure direction control portion 350 sets the angle θ formed between the inter-axes direction $L_1$ and the pressure direction $L_2$ at 0° in Step S102. After that, the image forming and fixing operations are carried out in Step S103, post-rotation operations are carried out in Step S104, and the operation ends.

When the judgment is "Yes", i.e., the full color mode, in Step S100, a pre-rotation operation is started in Step S111, and information of the full color mode is transmitted to the pressure direction control portion 350 through the image control portion 52. Because the mode is the full color mode, the pressure direction control portion 350 drives the pressure direction switching device 340 to move the pressure direction of the heating unit 330 to the B side after starting the pre-rotation operation and before starting the image forming operation. That is, the pressure direction control portion 350 sets the angle θ formed between the inter-axes direction $L_1$ and the pressure direction $L_2$ at 60° in Step S112. The operation for changing the angle θ is finished before starting the image forming operation.

After that, the image forming and fixing operations are carried out in Step S113 and a post-rotation operation is carried out in Step S114. During the post-rotation operation, the pressure direction control portion 350 finishes the job by changing the pressure direction of the fixing apparatus set at θ=60° in Step S112 to the side A direction, i.e., θ=0°, by the pressure direction switching device 340 in Step S115. The reason why the pressure direction is returned at θ=0° during the post-rotation is that there is a possibility of scratching a surface layer such as PFA of the heating unit 330 because the shearing force is applied also to the heating unit 330 when the pressure direction is kept at θ=60°.

The pre-rotation operation refers to a preparatory rotation in forming an image carried out after receiving an image signal and before starting an image forming operation, and is a preparatory operation necessary for printing such as stabilization of potential of the photoconductive drum and detection of resistance of the transfer roller. The image forming operation refers to a series of operations starting from the formation of a latent image of a first color on the photoconductive drum by being charged by the charger and ending by the transfer of a toner image of a fourth color to the transfer member. The post-rotation operation refers to a clearing operation after finishing the image forming operation, and is a series of operations such as discharge of a printed sheet out of a discharge tray, cleaning of the transfer roller, cleaning of residual toner on the photoconductive drum, elimination of history of sensitivity of the photoconductive drum, and the like.

The present embodiment enables to execute the first and second modes in which the spreads of toner images in the slip direction are different from each other even in the low toner laid quantity system as described above, so that it is possible to obtain a desirable image by selecting the mode suitable for an image to be formed. That is, it is possible to assure coloring by increasing the spread of the toner image in the slip direction in the full color mode in which coloring such as a secondary color is required. On the other hand, it is possible to assure reproducibility of a line image and others by reducing the spread of a toner image in the slip direction to be less than that in the full color mode in the case of the monochrome mode in which the reproducibility of a line image and other is required. As a result, it is possible to assure both the coloring and the reproducibility of a line image and others.

Specifically, the normal fixing of applying the force in the toner overlap direction is carried out in the monochrome mode in which letters and line images are frequently printed to reduce thickening and tailing of letters and/or lines and to enhance printing quality of letters. Meanwhile, the slip fixing of increasing the force applied in the oblique direction with respect to the toner overlap direction is carried out in the full color mode in which an image having a high color gamut is preferred to precede a highly colored image. Thus, it is possible to set the fixing conditions suited to the respective image modes.

It is noted that although it is possible to obtain the effect described above even if the shearing force applied on the toners and the recording medium conveying direction orient in the same direction, it is more effective when the shearing force applied on the toners and the recording medium conveying direction orient opposite directions from each other because the force of spreading the toners in the in-plane direction increases relatively as shown in FIG. 21. The effectiveness of improving coloring is also different depending mainly on the toner laid quantity, the fixing condition and the recording medium. The effect of the present embodiment is remarkable in a condition in which the toner laid quantity is small and there exist less number of areas where the toners overlap with each other. Still further, the toner spreads more in the in-plane direction and the effect increases when the fixing condition is set so that the toners fully melt, e.g., high temperature, high pressure, long time (low speed), and low viscous toner. The effect also increases when the recording medium has a smooth surface because adhesion between the fixing member and the recording medium increases and the component force in the in-plane direction is transmitted to the toners without waste.

Second Embodiment

A second embodiment of the invention will be described with reference to FIGS. 28 and 29. It is noted that because image forming operations other than those of a fixing apparatus of the present embodiment are the same with those of the first embodiment, their explanation will be omitted here.

Figure 28:
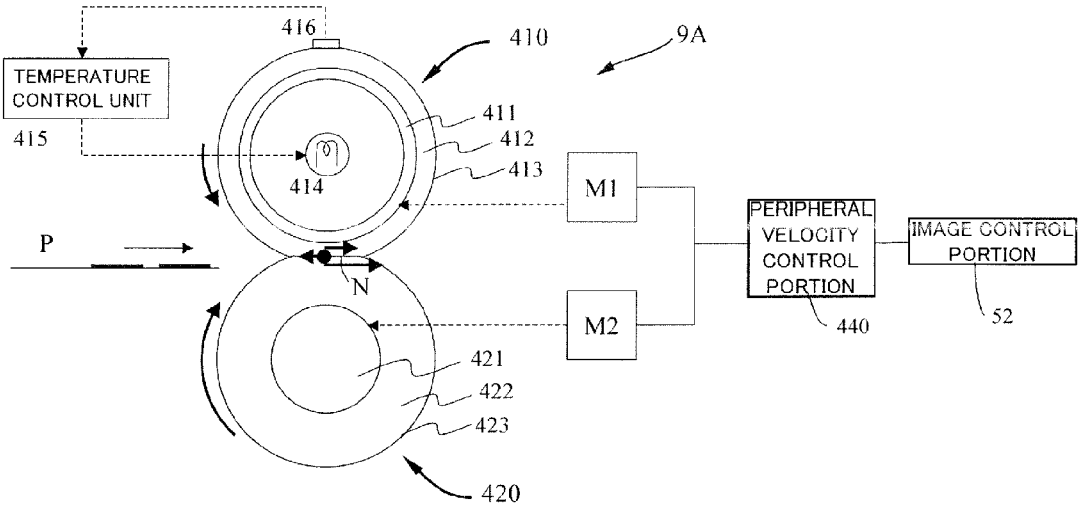
FIG. 28 is a section view schematically showing a configuration of a fixing apparatus according to a second embodiment of the invention.
Figure 29:
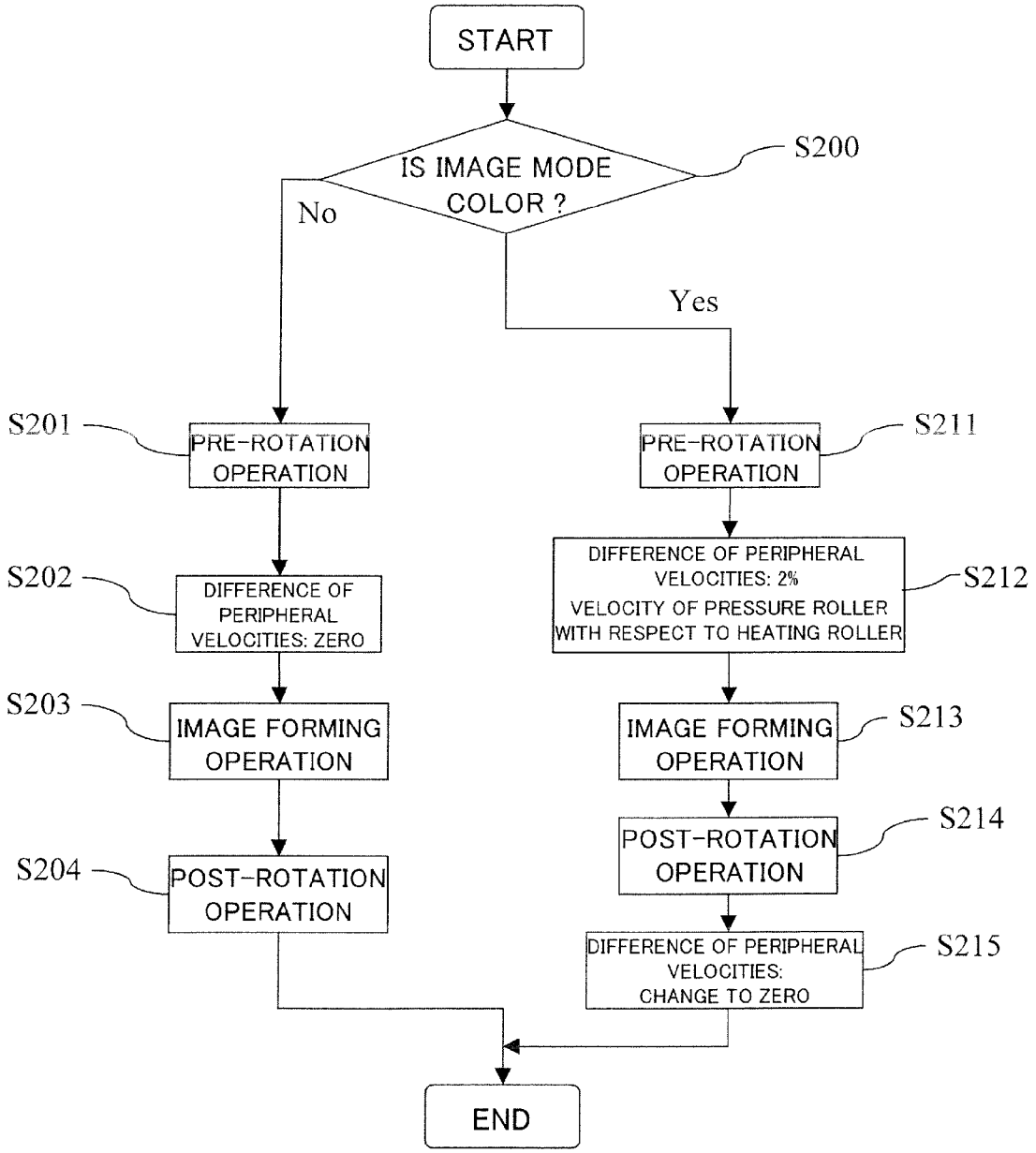
FIG. 29 is a flowchart showing image forming operations of the second embodiment.

FIG. 28 is a schematic section view of a fixing apparatus 9A of the present embodiment. The fixing apparatus 9A includes a heating roller 410 having a heat source as a rotatable heating member, and a rotatable pressure roller 420, i.e., a nip forming member, that forms a fixing nip portion N by being in pressure contact with the heating roller 410. Then, the fixing apparatus 9A heats and presses a toner image to fix on a recording medium P while pinching and conveying the recording medium P carrying the toner image at the fixing nip portion N.

The heating roller 410 includes a hollow core metal 411 made from a thermally conductive metal, e.g., aluminum and iron, an elastic layer 412 made from silicon rubber or the like provided around the hollow core metal 411, and a mold releasing layer 413 such as PFA covering a surface of the elastic layer 412. A halogen heater 414, i.e., a heat source, is disposed within the hollow core metal 411. An operation of the halogen heater 414 is controlled by a temperature control unit 415. Based on a surface temperature of the heating roller 410 detected by a thermistor 416, the temperature control unit 415 controls outputs with respect to the operation of the halogen heater 414. The temperature of the surface of the heating roller 410 is adjusted at 170° C. by the contact thermistor in the fixing apparatus 9A of the present embodiment.

The pressure roller 420 is composed of a core metal 421 made from metal such as aluminum and steel, an elastic layer 422 such as silicon rubber surround around the core metal 421, and a mold releasable layer 423 such as PFA covering a surface of the elastic layer 422.

The heating and pressure rollers 410 and 420 are rotationally driven independently from each other by driving motors M1 and M2, respectively. That is, the heating and pressure rollers 410 and 420 are rotatable in a direction of conveying a recording medium P nipped by the fixing nip portion N. The heating roller 410 is rotationally driven by the driving motor M1, i.e., a first driving portion, and the pressure roller 420 is rotationally driven by the driving motor M2, i.e., a second driving portion. The force applying portion is composed of such driving motors M1 and M2.

Arrows in FIG. 28 near the fixing nip portion N indicate directions of forces acting around the fixing nip portion N, i.e., rotational forces of the heating and pressure rollers 410 and 420 and a force generated from their difference. A shearing force for slip fixing is applied at the fixing nip portion N by making the difference (peripheral velocity) between rotational velocities of the heating roller 410 and 420 in the present embodiment. The larger the difference in the rotational velocities, the greater the shearing force become and the wider the toner spreads in the in-plane direction, so that a coloring improving effect is enhanced. However, if the difference of the rotational velocities is too large, the toner slips excessively, and a letter and line image is remarkably disordered.

In view of the circumstances described above, the rotational velocity of the heating roller 410 is set at 240 mm/sec. with respect to the rotational velocity of the pressure roller 420 of 245 mm/sec., i.e., the rotational velocity of the heating roller 410 is reduced by about 2%, in carrying out the slip fixing in the present embodiment. At this time, the heating roller 410 slides relatively with respect the pressure roller 420 by about 200 μm within a time when the recording medium P passes through the fixing nip portion N of about 10 mm. At this time, the recording medium P is conveyed also sliding against the heating roller 410. That is, the toner is fixed on the recording medium by applying the force obliquely with respect to the toner overlap direction also in the fixing apparatus 9A.

As a result, when the difference in peripheral velocities of 2% is made, a shearing force corresponding to about 15 μm of an increment of total line width is applied and chromaticness of a secondary color increased by about 10, as compared to a case when peripheral velocities of the pressure roller 420 and the heating roller 410 are the same.

Next, a mechanism for changing the difference in peripheral velocities of the pressure roller 420 and the heating roller 410 will be explained. The fixing apparatus 9A has a peripheral velocity control portion 440 as a control portion including a CPU to receive a signal from the image control portion 52 and to control the peripheral velocities of the heating and pressure rollers 410 and 420 independently. The peripheral velocity control portion 440 controls the rotational velocities of the driving motors M1 and M2 and vary the difference in peripheral velocities of the pressure roller 420 and the heating roller 410. The difference in peripheral velocities is set corresponding to a mode. It is noted that the difference in peripheral velocities of the heating and pressure rollers 410 and 420 is zero in standby time.

In the monochrome mode in which letter and line images are often formed, the normal fixing by which the increment of total line width is substantially zeroed is carried out to precede to reduce thickening and tailing of letters and/or lines and to enhance printing quality of the letters also in the fixing apparatus 9A of the present embodiment. In the full color mode in which a high color range image is preferred however, the slip fixing that increases the increment of total line width is carried out to precede a highly colored image.

Next, a flow of image forming operations of the present embodiment configured as described above will be explained with reference to FIG. 29. When the image forming operation is started, the control portion 50 judges whether a document image is a color image or a monochrome image in Step S200 in the same manner with the first embodiment as shown in the chart in FIG. 27. When it is judged to execute a color image forming operation in Step S200, the mode is changed to the full color mode, and when it is judged to execute a monochrome image forming operation, the mode is changed to the monochrome mode, respectively.

Specifically, if the judgment is "No", i.e., the monochrome mode, in Step S200, a pre-rotation operation is carried out in Step S201, and information of the monochrome mode is transmitted to the peripheral velocity control portion 440 through the image control portion 52. Because the mode is the monochrome mode, the peripheral velocity control portion 440 sets such that the heating and pressure rollers 410 and 420 rotate at equal speed (difference of peripheral velocities is zero), i.e., similarly to the speeds in the standby time, in Step S202. After that, the image forming and fixing operations are carried out in Step S203, post-rotation operations are carried out in Step S204, and the operation ends.

When the judgment is "Yes", i.e., the full color mode, in Step S200, a pre-rotation operation is started in Step S211, and information of the full color mode is transmitted to the peripheral velocity control portion 440 through the image control portion 52. Because the mode is the full color mode, the peripheral velocity control portion 440 rotates the rollers such that the velocity of the heating roller 410 is slower than the velocity of the pressure roller 420 by 2% (at 2% of difference in peripheral velocities) after starting the pre-rotation operation and before starting the image forming operation in Step S212. After that, the image forming and fixing operations are carried out in Step S213 and then a post-rotation operation is carried out in Step S214. During the post-rotation operation, the peripheral velocity control portion 440 carries out the control of changing the difference in peripheral velocities to zero from the control made in Step S212 of rotating the rollers by retarding the velocity of the heating roller 410 to that of the pressure roller 420 by 2% in Step S215. The reason why the difference in peripheral velocities of the heating and pressure rollers 410 and 420 is returned to zero during the post-rotation is that there is a possibility of scratching a surface layer such as PFA of the heating roller 410 because the shearing force is applied also to the heating roller 410 when there is the difference in peripheral velocities.

It is noted that the configuration of the fixing apparatus 9A is not limited to what described above as long as there is a difference in rotational velocities of two members that pinch and convey a recording medium. For instance, the system of the fixing apparatus may be a thermal roller system, a film (belt) system, or a combination of them. The heating method includes a halogen heater, electromagnetic induction heating, and a ceramic heater, and a plurality of heat sources may be also used.

Thus, in the monochrome mode in which letter and line images are often formed, the normal fixing of applying the force in the toner overlap direction is carried out to reduce thickening and tailing of letters and/or lines and to enhance printing quality of the letters also in the present embodiment. In the full color mode in which a high color range image is preferred, however, the slip fixing that increases the force to be applied in the oblique direction with respect to the toner overlap direction is carried out to precede a highly colored image. The present embodiment enables to set the fixing conditions suited to the respective image modes.

It is noted that although it is possible to obtain the effect described above even if the shearing force applied on the toners and the recording medium conveying direction orient in the same direction, it is more effective when the shearing force applied on the toners and the recording medium conveying direction orient opposite directions from each other as shown in FIG. 28 because the force of spreading the toners in the in-plane direction increases relatively. The effectiveness of improving coloring is also different depending mainly on the toner laid quantity, the fixing condition and the recording medium. The effect of the present embodiment is remarkable in a condition in which the toner laid quantity is small and there exist less number of areas where the toners overlap with each other. Still further, the toner spreads more in the in-plane direction and the effect increases when the fixing condition is set so that the toners fully melt, e.g., high temperature, high pressure, long time (low speed), and low viscous toner. The effect also increases when the recording medium has a smooth surface because adhesion between the fixing member and the recording medium increases and the component force in the in-plane direction is transmitted to the toners without waste.

Still further, while the difference of rotational velocities necessary to obtained the effect of the present embodiment differs depending on slidability (frictional force) between the recording medium P and the fixing and pressure members that come in contact with the recording medium, it is possible to obtain the effect of improving coloring by spreading the toner image on the recording medium P in the in-plane direction as a result. The other configuration and operations are the same with those of the first embodiment.

Third Embodiment

A third embodiment of the invention will be described with reference to FIGS. 30 through 34. It is noted that because the image forming operations other than those of a fixing apparatus of the present embodiment are the same with those of the first embodiment, their explanation will be omitted here.

Figure 30:
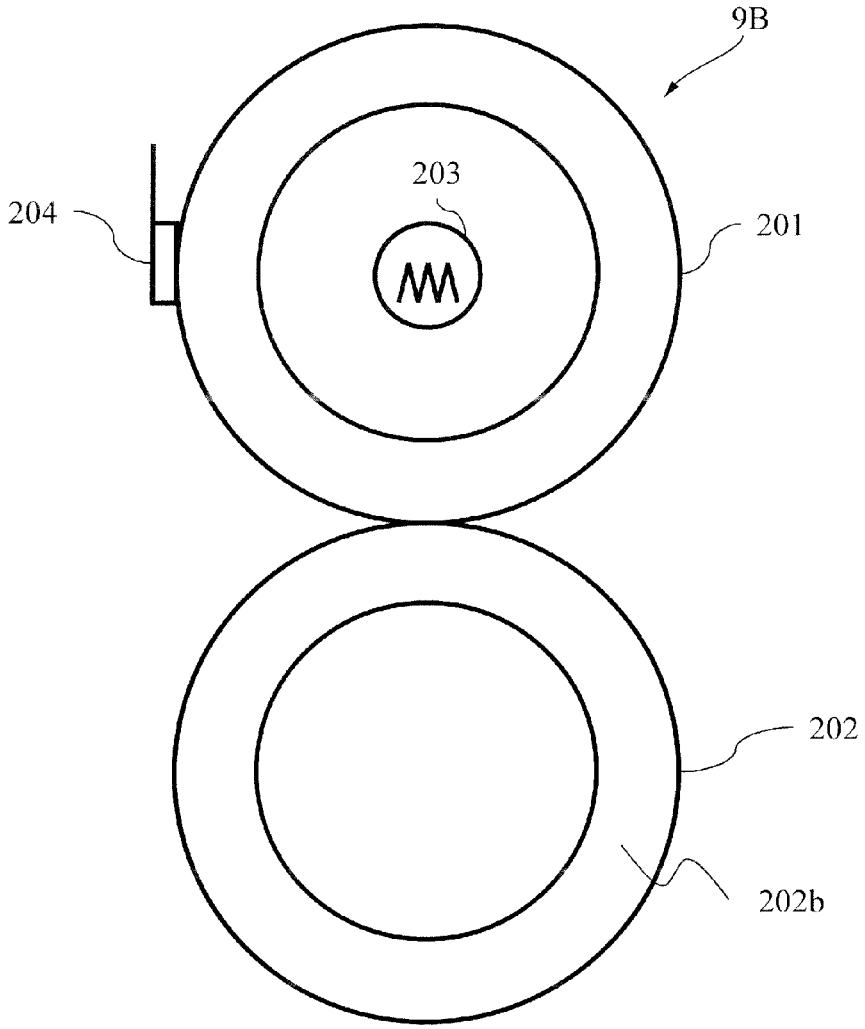
FIG. 30 is a section view schematically showing a configuration of a fixing apparatus according to a third embodiment of the invention.

The fixing apparatus 9B of the present embodiment includes a heating roller 201 and a pressure roller 202 as a pair of rotating bodies in vertically pressure contact with each other as shown in FIG. 30, and heats a toner image on a recording medium by rotating the rollers while pinching and conveying the recording medium by the rollers. Here, the heating roller 201 is a heating member, and a pressure roller 202 is a nip forming member. The fixing apparatus 9B is configured such that a generating line direction of the heating roller 201 and a generating line direction of the pressure roller 202 are relatively inclined from a parallel relationship as described later. That is, the heating roller 201 and the pressure roller 202 are put into a relationship in which their generating line directions are twisted from each other.

The heating roller 201 has a three-layered structure of a piped core metal of steel, aluminum, or the like as a base layer, a heat resistant silicon rubber layer as an elastic layer provided around the core metal, and a fluorine resin layer, i.e., a high mold releasable material, provided as a surface layer on the elastic layer. The surface layer prevents the toners from offsetting to the heating roller 201 during fixing. Accordingly, it is preferable to form this surface layer by the fluorine resin layer. The fluorine resin includes FEP (tetrafluoroethylene hexafluoropropylene copolymer), PFA (tetrafluoethylene perfluoroalkylvinylether copolymer), PTFE (polytetrafluoroethylene), and the like.

A thickness of the elastic layer is preferable to be 1 mm or more and to be 5 mm or less. When the thickness of the elastic layer is less than 1 mm, hardness of the heating roller 201 increases and it is unable to assure a nip width by deforming the heat resistant silicon rubber, so that such thickness is inappropriate as the elastic layer. When the thickness of the elastic layer exceeds 5 mm in contrary, the heat resistant silicon rubber tends to deteriorate because the heat source is located within the core metal, i.e., the base layer, and a difference of temperatures between the base layer and the surface layer increases. Accordingly, the thickness of the elastic layer is preferable to be somewhere between 1 to 5 mm.

A cylindrical core metal made from aluminum having 60 mm in diameter, 3 mm in thickness and 54 mm in inner diameter is used for the heating roller 201 of the embodiment. A silicon rubber of 2.5 mm in thickness having 20 degrees in JIS-A hardness is provided as an elastic layer around the core metal. A tube of 50 μm in thickness made from PFA (perfluoroalkoxy resin), i.e., a surface layer, is covered around the elastic layer. It is noted the tube of the surface layer may be made from FEP or PTFE.

The heating roller 201 is formed by injecting and sintering the liquid silicon rubber of 10 degrees of JIS-A hardness, that turns out to be the elastic layer, between the surface layer of the PFA resin molded into the shape of the tube and the core metal inserted into the surface layer.

Similarly to the heating roller 201, the pressure roller 202 has a three-layered structure of a piped core metal of steel, aluminum and the like, a heat resistant silicon rubber layer as an elastic layer provided around the core metal, and a fluorine resin layer, i.e., a high mold releasable material, provided as a surface layer on the elastic layer.

An elastic layer of silicon rubber of 2 mm in thickness is provided on the core metal, and a surface layer as a mold releasing layer of fluorine resin is provided around the elastic layer. The pressure roller 202 forms a nip portion with the heating roller 201 that is rotated by a driving mechanism not shown, and rotates following the heating roller 201.

In order to be able to form the nip between the heating and pressure rollers 201 and 202, the elastic layer 202*b* of the pressure roller 202 is formed on the core metal by using LTV or HTV silicon rubber. LTV is an abbreviation of Low Temperature Vulcanization, and HTV is an abbreviation of High Temperature Vulcanization.

The elastic layer 202*b* is required to have adequate elasticity because a toner image may not be fixed on an irregular sheet or resolution of an image may drop due to quench of toners if the elasticity is small. In order to keep a required nip width (length in the recording medium conveying direction) of 10 mm in the structure described above, a pressure contact force (pressure force) of the pressure roller 202 against the heating roller 201 is set at 800 N.

The core metal of the heating roller 201 is formed in a hollow cylindrical casing and a halogen heater 203, i.e., a heat generating portion, is provided within the hollow casing. The halogen heater 203 supplies heat necessary for fixing to the heating roller 201. The heating roller 201 is provided with a thermistor (temperature detecting element) 204 that measures temperature of the heating roller 201 in contact with the heating roller 201. The temperature of the heating roller 201 is controlled first by detecting the temperature of the heating roller 201 from changes of resistant values of the thermistor 204 associated with temperature change. Then, ON/OFF of the halogen heater 203 is controlled by a controller not shown to keep the temperature of the heating roller 201 at a predetermined temperature. The surface of the heating roller 201 is controlled at 170° C. by the thermistor 204 in the fixing apparatus 9B of the present embodiment.

Figure 31:
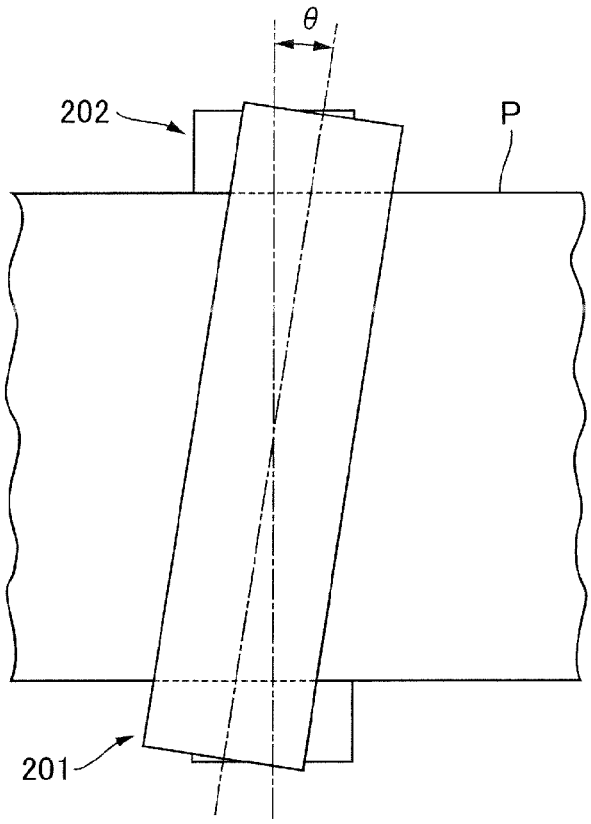
FIG. 31 is a plan view schematically showing the configuration of the fixing apparatus of the third embodiment.
Figure 32:
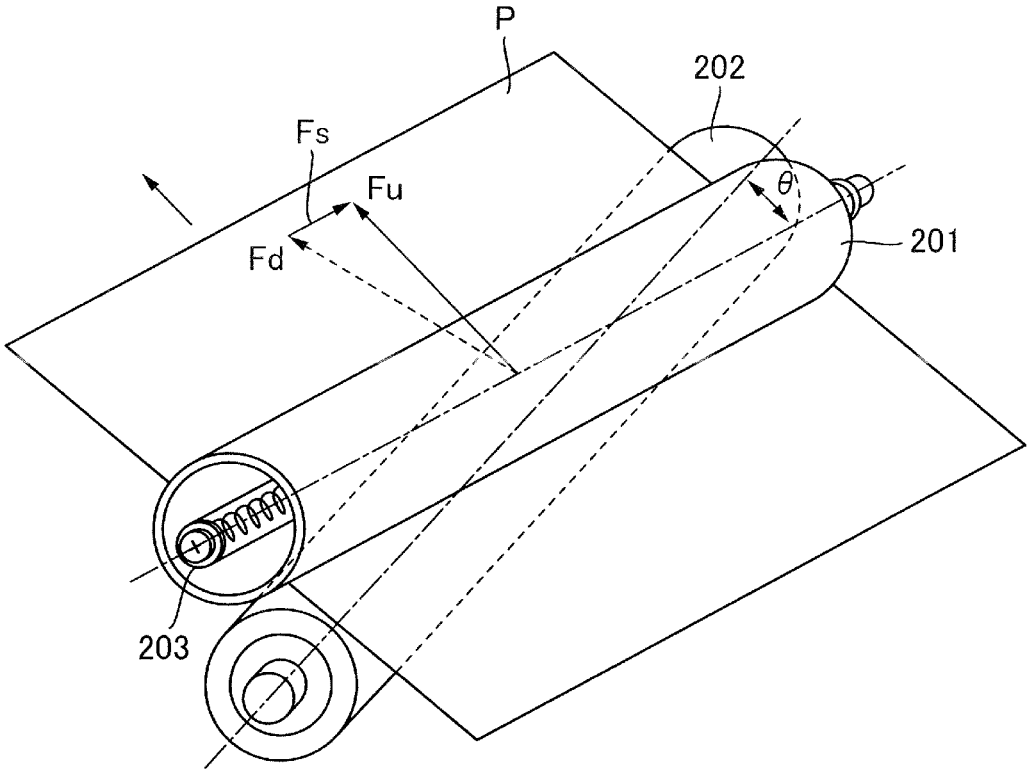
FIG. 32 is a perspective view schematically showing the configuration of the fixing apparatus of the third embodiment.

As shown in FIGS. 31 and 32, the heating and pressure rollers 201 and 202 are put into a relationship in which their core axial lines are twisted from a parallel condition. FIG. 31 is a projection view when the heating and pressure rollers 201 and 202 are seen from above, wherein the core axial lines of the heating and pressure rollers 201 and 202 are put into the relationship in which they are twisted from each other with an angle of crossing angle θ.

FIG. 32 is a perspective view in which the crossing angle θ is exaggerated for convenience of the explanation. Fu in FIG. 32 indicates a force applied on an upper surface of a sheet in a direction orthogonal to an axial line of the heating roller 201. In the same manner, Fd in FIG. 32 indicates a force applied on an under surface of the sheet in a direction orthogonal to an axial line of the pressure roller 202. Fs is a difference vector between Fd and Fu, and indicates a direction of slip stress applied within the fixing nip portion N. That is, toners within the fixing nip portion N are heated and fixed while receiving the slip stress in the direction of Fs. This slip stress causes the toners to spread in the sheet in-plane direction.

When the crossing angle θ increases, the slip stress generated within the fixing nip portion N increases, so that the force applied on the toners in the in-plane direction increases and the effect of spreading the toners within the plane increases. However, if the slip stress within the sheet surface increases, stress on the surface of the heating and pressure rollers 201 and 202 increases, so that durability of the surface layer poses a problem.

When the heating and pressure rollers having the thin core metals are pressed with each other, normally axial centers of the respective rollers receive an influence of deflection and the nip is deformed into a shape of an inverted crown in which the nip is thickened at both ends. Meanwhile, if the crossing angle is formed, the nip at the both ends is narrowed geometrically, so that it is preferable to set the crossing angle θ such that widths of the nip on the both ends become substantially equal to or more than a width of the nip at a center part. If the crossing angle θ is set at an angle greater than the deflection of the heating and pressure rollers, the widths of the nip of the both ends are thinned more than that at the center, so that such a problem that the sheet is wrinkled occurs.

Due to that, the crossing angle θ is preferable to be within a range from about 0.15 to 3.0 degrees, and the width of the nip at the center part is set to be 10 mm and that at the both ends to be 10.5 mm by setting the crossing angle at about 3.0 degrees in the present embodiment. That is, the toners are fixed on the recording medium by applying a force obliquely with respect to the toner overlap direction also in the fixing apparatus 9B of the present embodiment. As a result, when the slip fixing in which the crossing angle of 3 degrees is formed is compared with the normal fixing in which no crossing angle is formed, a shearing force corresponding to about 15 μm of an increment of total line width is applied and chromaticness of a secondary color increased by about 10.

Figure 33:
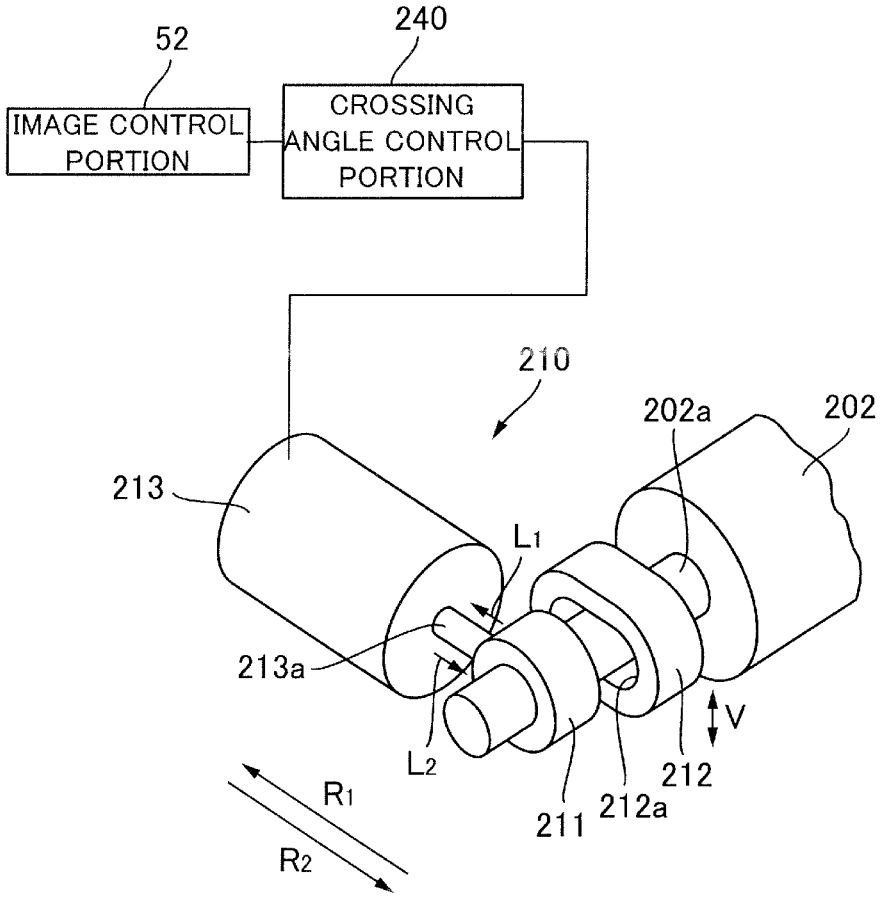
FIG. 33 is a perspective view showing a configuration of changing a crossing angle in the third embodiment.
Figure 34:
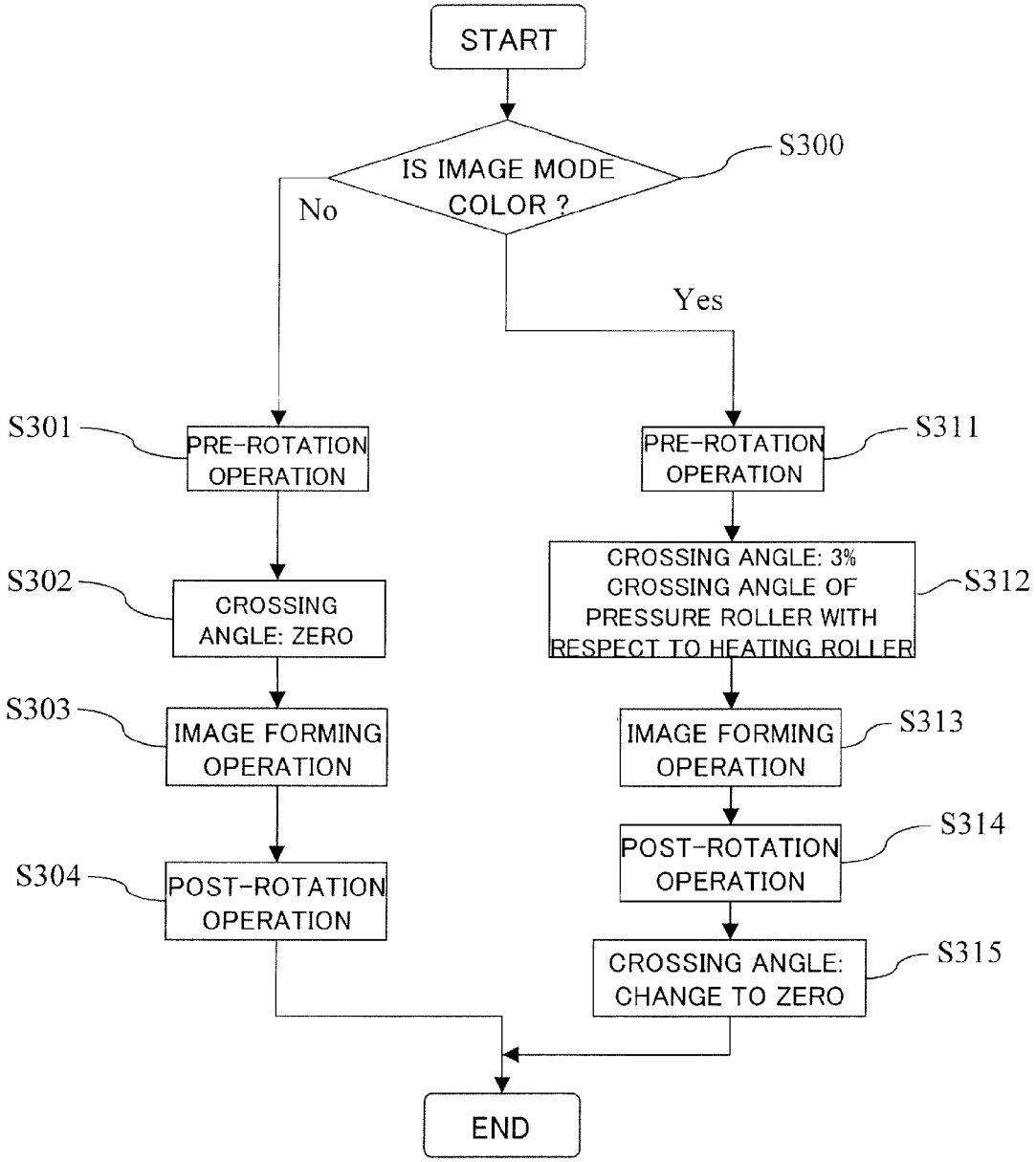
FIG. 34 is a flowchart showing image forming operations of the third embodiment.

Next, a mechanism for changing the crossing angle θ will be explained. FIG. 33 is a perspective view showing a crossing angle adjusting mechanism 210 of the pressure roller 202 as an inclining portion. The mechanism for adjusting the crossing angle of the pressure roller 202 will be explained below with reference to FIG. 33. It is noted that the crossing angle adjusting mechanism 210 is also the force applying portion.

In FIG. 33, a shaft 202*a* of the pressure roller 202 is axially and rotationally supported by a long bearing 212 fixed to a side plate not shown. The long bearing 212 is provided with a long hole 212*a* that fits with the shaft 202*a* only in a direction V in FIG. 33 and allows the shaft 202*a* to move only in directions of arrows R1 and R2 vertical to the direction V. Still further, a bearing 211 is fitted around the shaft 202*a* on opposite side of the long bearing 212 viewing from the pressure roller 202. Meanwhile, a solenoid 213, i.e., an electromagnetic functional part, that converts electrical energy into a mechanical linear movement is fixed on a side plate not shown. An output shaft 213*a* provided with a lead is attached at an edge portion of the solenoid 213, and an edge of the output shaft 213*a* is in contact with the bearing 211. A spring member not shown is in contact with the bearing 211 on opposite side of the bearing 211 viewing from the edge of the output shaft 213*a* to press the bearing 211 to the output shaft 213*a*.

The solenoid 213 moves in a direction of an arrow L2 when it is applied with voltage. That is, a front side of the pressure roller 202 can be moved in the direction of the arrow R1 or R2 by applying voltage to the solenoid 213. The structure described above is provided at both right and left sides of the pressure roller 202, and makes it possible to adjust the crossing angle by applying voltage only to one solenoid. The solenoid 213 as described above is controlled by a crossing angle control portion 240, i.e., a control portion, and changes the crossing angle between the pressure roller 202 and 201. The crossing angle θ between the heating and pressure rollers 201 and 202 of the fixing apparatus 9B when the image forming apparatus is halted such as during the standby time is zero. It is noted the crossing angle adjusting mechanism 210 as described above may be provided on the side of the heating roller 201. In short, the crossing angle adjusting mechanism 210 may be provided on either side as long as it can relatively incline the heating and pressure rollers 201 and 202. In other words, the force applying portion is an inclining portion that is capable of changing the positional relationship of the heating member and the nip forming member such that a generating line of one member is inclined relatively to a generating line of the other member.

In the monochrome mode in which letter and line images are more formed, the normal fixing by which the increment of total line width is substantially zeroed is carried out to precede to reduce thickening and tailing of letters and/or lines and to enhance printing quality of the letters also in the fixing apparatus 9B of the present embodiment. In the full color mode in which a high color range image is preferred, however, the slip fixing that increases the increment of total line width is carried out to precede a highly colored image.

Next, a flow of image forming operations of the present embodiment configured as described above will be explained with reference to FIG. 34. When the image forming operation is started, the control portion 50 judges whether a document image is a color image or a monochrome image in Step S300 in the same manner with the first embodiment as shown in the chart in FIG. 27. When it is judged to execute a color image forming operation, the mode is changed to the full color mode, and when it is judged to execute a monochrome image forming operation, the mode is changed to the monochrome mode, respectively.

Specifically, if the judgment is "No", i.e., the monochrome mode, in Step S300, a pre-rotation operation is carried out in Step S301, and information of the monochrome mode is transmitted to the crossing angle control portion 240 through the image control portion 52. Because the mode is the monochrome mode, the crossing angle control portion 240 sets such that the crossing angle between the heating and pressure rollers 201 and 202 is zeroed, i.e., similarly to the standby time, in Step S302. After that, the image forming and fixing operations are carried out in Step S303, post-rotation operations are carried out in Step S304, and the operation ends.

When the judgment is "Yes", i.e., the full color mode, in Step S300, a pre-rotation operation is started in Step S311, and information of the full color mode is transmitted to the crossing angle control portion 240 through the image control portion 52. Because the mode is the full color mode, the crossing angle control portion 240 starts to drive the solenoid 213 to set the crossing angle between the heating and pressure rollers 201 and 202 at 3 degrees after starting the pre-rotation operation and before the image forming operation. The crossing angle control portion 240 ends the operation for changing the crossing angle before starting the image forming operation in Step S312. After that, the image forming and fixing operations are carried out in Step S313, and then a post-rotation operation is carried out in Step S314. During the post-rotation operation, the crossing angle control portion 240 carries out the control of setting the crossing angle to zero from the control made in Step S312 of changing the crossing angle between the heating and pressure rollers 201 and 202 to 3 degrees in Step S315. The reason why the crossing angle between the heating and pressure rollers 201 and 202 is returned to zero during the post-rotation is that there is a possibility of scratching a surface layer such as PFA of the heating roller 201 because the shearing force is applied also to the heating roller 201 when there is the crossing angle.

Thus, in the monochrome mode in which letter and line images are more formed, the normal fixing of applying the force in the toner overlap direction is carried out to reduce thickening and tailing of letters and/or lines and to enhance printing quality of the letters also in the present embodiment. In the full color mode in which a high color range image is preferred, however, the slip fixing that increases the force to be applied in the oblique direction with respect to the toner overlap direction is carried out to precede a highly colored image. The present embodiment enables to set the fixing conditions suited to the respective image modes. The other configuration and operations are the same with those of the first embodiment.

Fourth Embodiment

A fourth embodiment of the invention will be described with reference to FIGS. 35 through 41. It is noted that because image forming operations other than those of a fixing apparatus of the present embodiment are the same with those of the first embodiment, their explanation will be omitted here.

The fixing apparatus 9C of the present embodiment moves a heating roller 550, i.e., a heating member, simultaneously in a rotational direction and in a longitudinal direction of the heating roller to slip non-fixed toners while melting them. This makes it possible to keep coloring of a secondary color at least in an equal level with conventional one even if a quantity of non-fixed toner is small (toner layer is thin). This arrangement will be below in detail.

Figure 35:
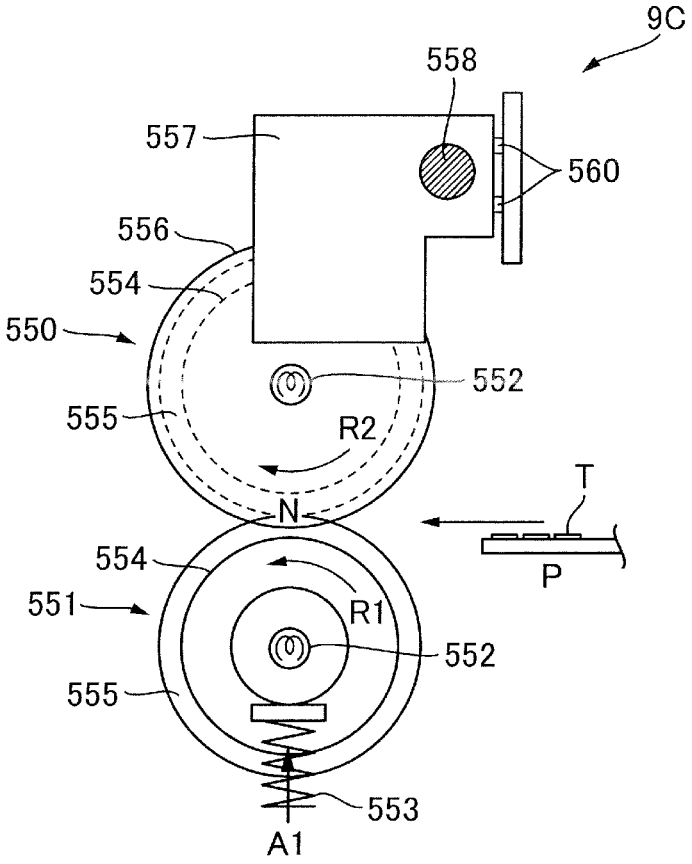
FIG. 35 is a section view schematically showing a configuration of a fixing apparatus according to a fourth embodiment of the invention.

As shown in FIG. 35, the heating roller 550 has an elastic layer 555 of 40 mm in outer diameter made from silicon rubber formed around a core metal 554 of 36 mm in diameter made from aluminum. Formed on the elastic layer 555 is a mold releasing layer of 30 μm not shown made from perfluoroalkoxy resin (PFA). A tube having excellent durability is used in the present embodiment. Besides the PFA, such fluorine resins as PTFE (polytetrafluoroethylene) and FEP (tetrafluoroetylene hexafluoropropylene resin) may be used as a material of the releasing layer.

A pressure roller 551, i.e. a nip forming member, having a similar construction with the heating roller 550 is used in the present embodiment. That is, the pressure roller 551 has an elastic layer 555 of 40 mm in outer diameter made from silicon rubber formed around a core metal 554 of 36 mm in diameter made from aluminum. Provided on an outermost layer is a mold releasing layer made from PFA not shown. The pressure roller 551 is pressed by a pressure spring 553 in a direction of an arrow A1 in FIG. 35 with a force of 400 N and is in contact with the heating roller 550 to form a fixing nip portion N of 9 mm in width. The pressure roller 551 is also rotated by a rotating portion not shown in a direction of an arrow R1 in FIG. 35 with surface velocity of 117 mm/sec. The heating roller 550 also rotates following the rotation of the pressure roller 551 in a direction of an arrow R2 in FIG. 35 with surface velocity of 117 mm/sec.

The heating and pressure rollers 550 and 551 are provided with halogen heaters 552 therein, respectively. When electricity is fed to the halogen heaters 552, they are heated and their heats warm up the core metals 554 through heat transmission through radiation or air and warm up the elastic layers 555 and the releasing layers thereafter in order. A temperature detecting element not shown is disposed in contact with a surface of the heating roller 550, and surface temperature of the heating roller 550 is adjusted by controlling an electric current flown to the halogen heater corresponding to a signal of the temperature detecting element. The temperature of the surface of the heating roller 550 is adjusted at 170° C. by the contact thermistor not shown in the fixing apparatus 9C of the present embodiment.

When the recording medium P on which a non-fixed toner image T has been transferred is conveyed to the fixing nip portion N by a conveying portion not shown, the heat of the heating roller 550 is propagated to the non-fixed toner image T and the recording medium P, and the toner image T is fixed on the surface of the recording medium P.

Figure 36:
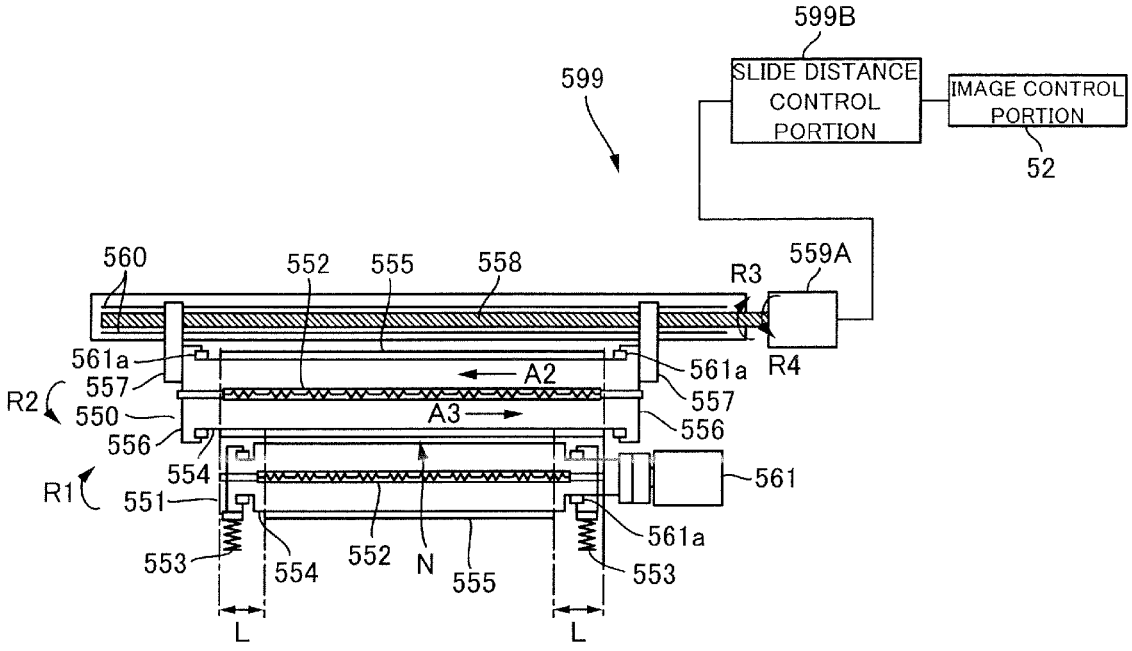
FIG. 36 is a longitudinal section view schematically showing the configuration of the fixing apparatus of the fourth embodiment.

Next, a configuration of slipping the non-fixed toner image T while melting it will be explained below. FIG. 36 is a front section view of a fixing apparatus of a type of sliding the heating roller 550 in the longitudinal direction. The pressure roller 551 is rotated by a rotating portion 561 in a direction of an arrow R1 and the heating roller 550 rotates following the pressure roller 551 in a direction of an arrow R2. Both the heating and pressure rollers 550 and 551 rotate smoothly by bearings 561*a* located on the both ends of the rollers. While the pressure roller 551 is fixed in the longitudinal direction, the heating roller 550 is movable (slidable) in the longitudinal direction.

A moving unit 599, i.e., a moving portion, that slides the heating roller 550 in the longitudinal direction, i.e., a direction orthogonal respectively to a direction for conveying the recording medium P and a toner laminating direction, with respect to the pressure roller 551, will be explained below. Side plates 556 are provided at both ends of the heating roller 550, and the side plates 556 are fixed further to move supporting plates 557. A shaft 558 penetrates through the move supporting plates 557, and the shaft 558 is provided with a motor 559A at one end thereof to rotate the shaft 558. When the motor 559A rotates in a direction of an arrow R3, the shaft 558 also rotates in the direction of the arrow R3. Along with the rotation of the shaft 558, the move supporting plates 557 smoothly move along a slide rail 560 in a direction of an arrow A2. Accordingly, the heating roller 550 fixed to the move supporting plates 557 also slides in the direction of the arrow A2. When the motor 559A rotates inversely in a direction of an arrow R4, the heating roller 550 slides in a direction of an arrow A3 by the similar mechanism described above.

The motor 559A is controlled by a slide distance control portion 599B, i.e., a control portion, and controls the moving direction and distance of the heating roller 550. It is noted that the moving unit 599 may be provided on the side of the pressure roller 551, as long as the moving unit 599 can move the heating and pressure rollers 550 and 551 relatively. In another words, the force applying portion is a moving portion that moves at least one of the heating member and the nip forming member in the direction orthogonal to the recording medium conveying direction and to the toner laminating direction in such a manner that a relative displacement is caused between the heating member and the nip forming member.

Thus, the recording medium P is passed through the fixing nip portion N while sliding the heating roller 550 in the longitudinal direction to fix the non-fixed toners on the recording medium P. At this time, during when the recording medium P is passed through the fixing nip portion N, it is necessary to arrange such that there is no area in which the surface layer of the heating roller 550 does not come in contact on the recording medium P by sliding the heating roller 550. Due to that, it is necessary to prolong the heating roller 550 in the longitudinal direction more than that of the pressure roller 551 in response to a distance to be slid. As shown in FIG. 36, the heating roller 550 is prolonged more than the pressure roller 551 by 2L (L=L+L) in the present embodiment. Here, the length L represents a length from an end of the pressure roller 551 to an end of the heating roller 550 when the longitudinal center of the heating roller 550 is aligned with that of the pressure roller 551. Setting of the length L will be described later.

When the heating roller 550 slides in the direction of the arrow A2 or A3, a shearing force in parallel with the moving direction of the heating roller 550 acts on the toners on the recording medium P at the fixing nip portion N because the pressure roller 551 is fixed and does not slide in the longitudinal direction. Only pressure vertical to the recording medium acts on the toners on the recording medium in the configuration in which the heating roller 550 is not slid in the longitudinal direction, coloring of a secondary color drops remarkably when a toner quantity is small by the mechanism described above. Instead, in the case when the pressure roller 551 is fixed in the longitudinal direction and the heating roller 550 is slid in the longitudinal direction like the present embodiment, the shearing force in the slip direction in parallel with the recording medium acts on the toners other than the pressure vertical to the recording medium. Accordingly, because it is possible to slide the toners in the longitudinal direction while melting them, it is possible to improve coloring of the secondary color even when the toner quantity is small by the mechanism described above.

Figure 37:
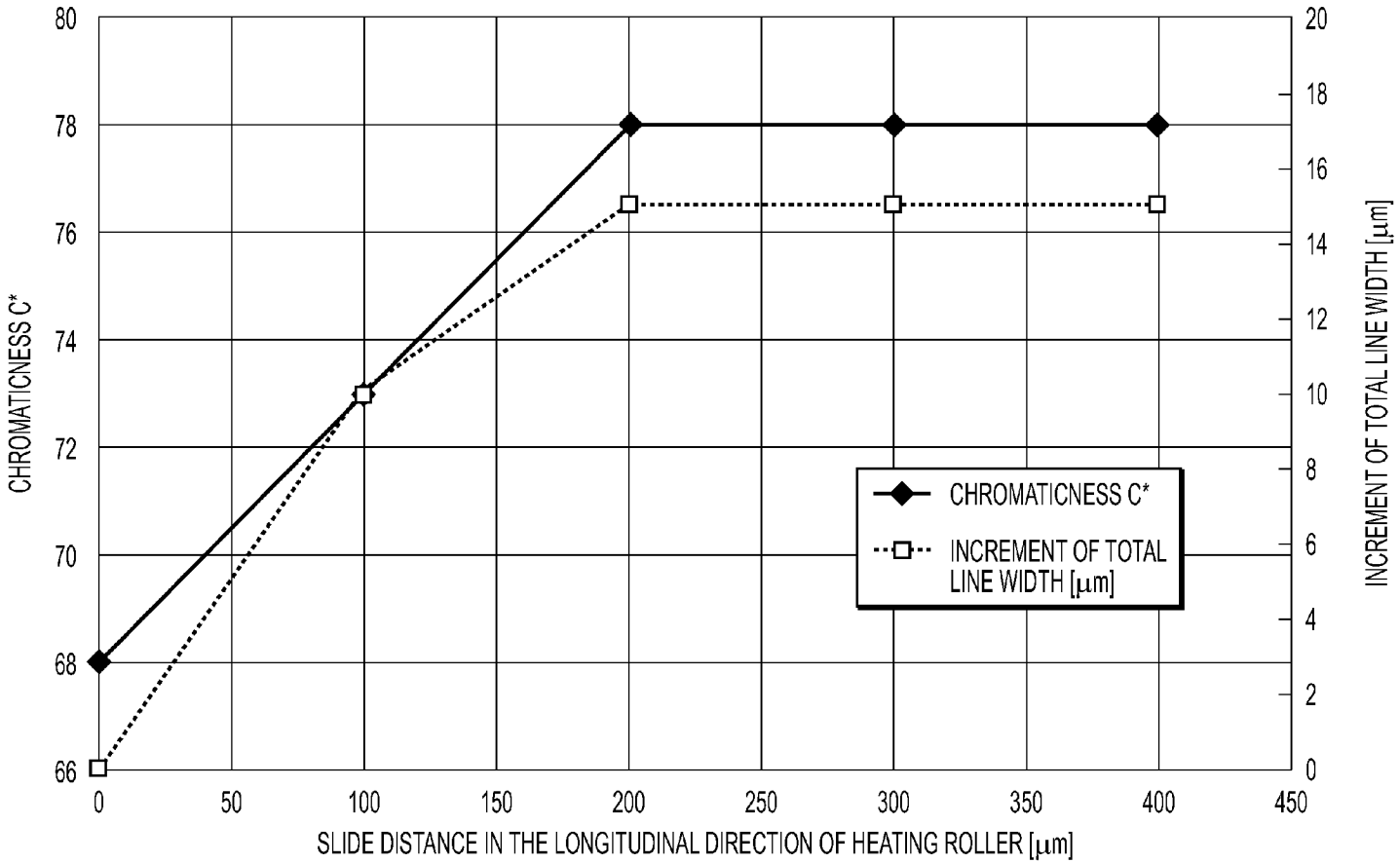
FIG. 37 is a graph showing a relationship among a degree of slip, vividness and an increase of a total line width.

FIG. 37 is a graph showing relationships of the distance when the heating roller 550 slides with coloring of a secondary color (green) of yellow and cyan and with an increment of total line width, when the non-fixed toner image on the recording medium P passes through the fixing nip portion N. When the slide distance of the heating roller increases, the coloring of green and the increment of total line width increase. However, when the slide distance increases, the chromaticness tends to saturate with a certain value or more, so that it is possible to obtain an enough effect by utilizing the slide distance by which the chromaticness starts to saturate. Because a width (width of fixing nip) in the conveying direction of the fixing nip portion N is 6.5 mm in an experiment carried out to obtain the result shown in FIG. 37, it can be seen that the chromaticness saturates with a slide distance (about 200 μm) of about 3% of the fixing nip width. That is, it is possible to obtain the enough chromaticness enhancing effect by sliding the heating roller 550 by 200 μm (about 3% of the width of the fixing nip portion) in the longitudinal direction during when the recording medium P on which the image is formed passes through the fixing nip portion. That is, the fixing apparatus of the present embodiment also fixes the tone on the recording medium by applying the force obliquely with respect to the toner overlap direction.

Therefore, because a width of the fixing nip portion N is 6.5 mm, the slide distance of the fixing apparatus 9C (slide fixing) of the present embodiment is set to be about 200 μm. As a result, a shearing force corresponding to about 15 μm of an increment of total line width was applied and the chromaticness of the secondary color increased by about 10.

What must be taken care here is that if the slide direction of the heating roller 550 is changed during when the recording medium P passes through the fixing nip portion N, the heating roller 550 does not move in the longitudinal direction in a short time during which the roller changes the direction of the slide direction. As a result, coloring of a part of the secondary color where the direction of the slide is changed drops in a fixed image. Accordingly, it is necessary to fix the slide direction of the heating roller 550 in one direction (in the direction A2 or A3) during when one recording medium P passes through the fixing nip portion N.

Here, as a specific example, a case of feeding an A4-size recording medium P through the fixing nip portion N in a lateral direction will be explained below. When a required slide distance is set at 3% of the fixing nip width from the reason described above, the heating roller 550 is slid in the direction of the arrow A2 from the state shown in FIG. 36 by 6.3 mm (=210 mm×3%) to pass one A4-size sheet through the fixing nip portion N in the lateral direction. It is noted that the moving direction may be the direction of the arrow A3. At this time, the speed for sliding the heating roller 550 is 3% of the processing speed, it is 7.4 mm/sec (=245 mm/sec×3%) in the present embodiment.

Figure 38:
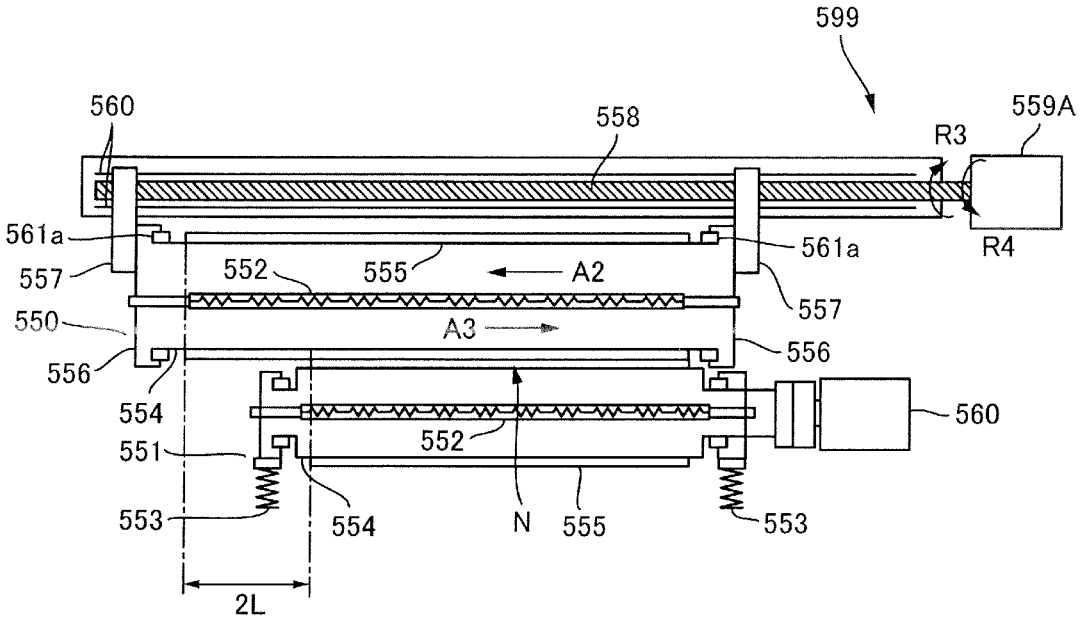
FIG. 38 is a longitudinal section view schematically showing the fixing apparatus after fixing one recording medium.
Figure 39A:
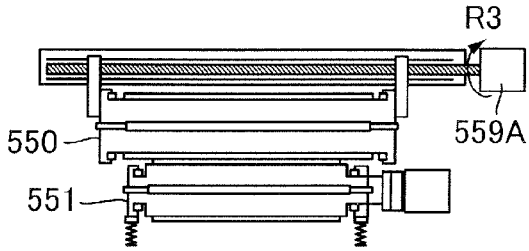
FIG. 39A is a longitudinal section view schematically showing a condition of the fixing apparatus before a first recording medium is conveyed.
Figure 39D:
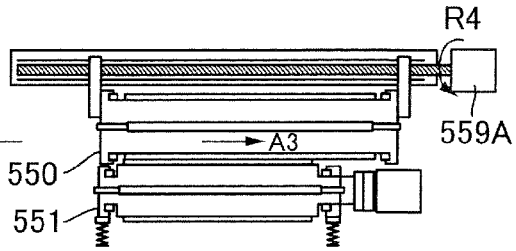
FIG. 39D is a longitudinal section view schematically showing a condition of the fixing apparatus when a third recording medium is slid-fixed.
Figure 39B:
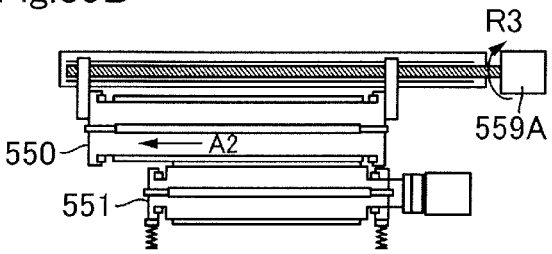
FIG. 39B is a longitudinal section view schematically showing a condition of the fixing apparatus when the first recording medium is slid-fixed.
Figure 39C:
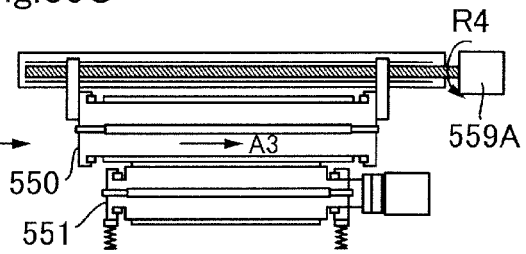
FIG. 39C is a longitudinal section view schematically showing a condition of the fixing apparatus when a second recording medium is slid-fixed.

FIG. 38 shows a state of the fixing apparatus 9C after finishing to fix one sheet. When a second sheet is to be fixed continuously, it is possible to return to the state shown in FIG. 36 by sliding the heating roller 550 by 6.3 mm reversely in the direction of the arrow A3 (in the direction A2 when the roller has been moved in the direction A3 in fixing the first sheet). When a third sheet is to be fixed continuously, the heating roller 550 may be slid in the direction A2 similarly to the case of the first sheet. However, there is a problem that if only the same part in the longitudinal direction of the heating roller 550 comes in contact with the recording media, that part deteriorates sooner. Accordingly, it is preferable to slide the heating roller 550 in the direction of the arrow A3 in feeding the third sheet. The series of operations of the heating roller 550 described above are illustrated in order of FIGS. 39A, 39B, 39C, 39D and 39A. However, these figures do not show states when the recording medium P passes through the fixing nip portion N.

As shown in FIG. 38, it is possible to assure the slide distance of 2L in maximum in the direction A2 when the end of the heating roller 550 is adjusted with the end of the pressure roller 551 before feeding a sheet. Setting of L may be determined in accordance of specifications of a product. Because a maximum recording medium to be used is 19 inches, the value of 2L is 14.5 mm (=19×25.4 mm×3%) and L is about 7.2 mm in the case of the present embodiment. The heating roller 550 may be prolonged more than the pressure roller 551 by this value.

Figure 40A:
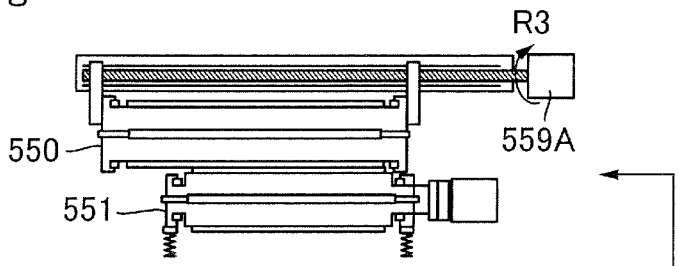
FIG. 40A is a longitudinal section view schematically showing a condition in which a heating member is positioned on one side of the slide direction in fixing the second recording medium and thereafter continuously.
Figure 40B:
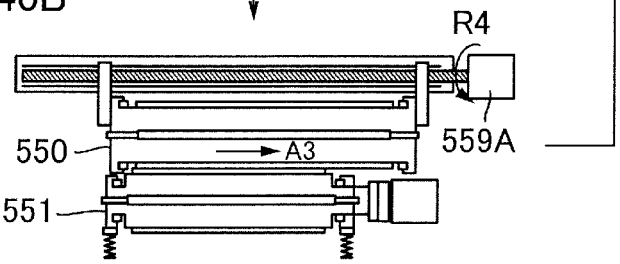
FIG. 40B is a longitudinal section view schematically showing a condition in which the heating member is positioned on an other side of the slide direction in fixing the second recording medium and thereafter continuously.
Figure 41:
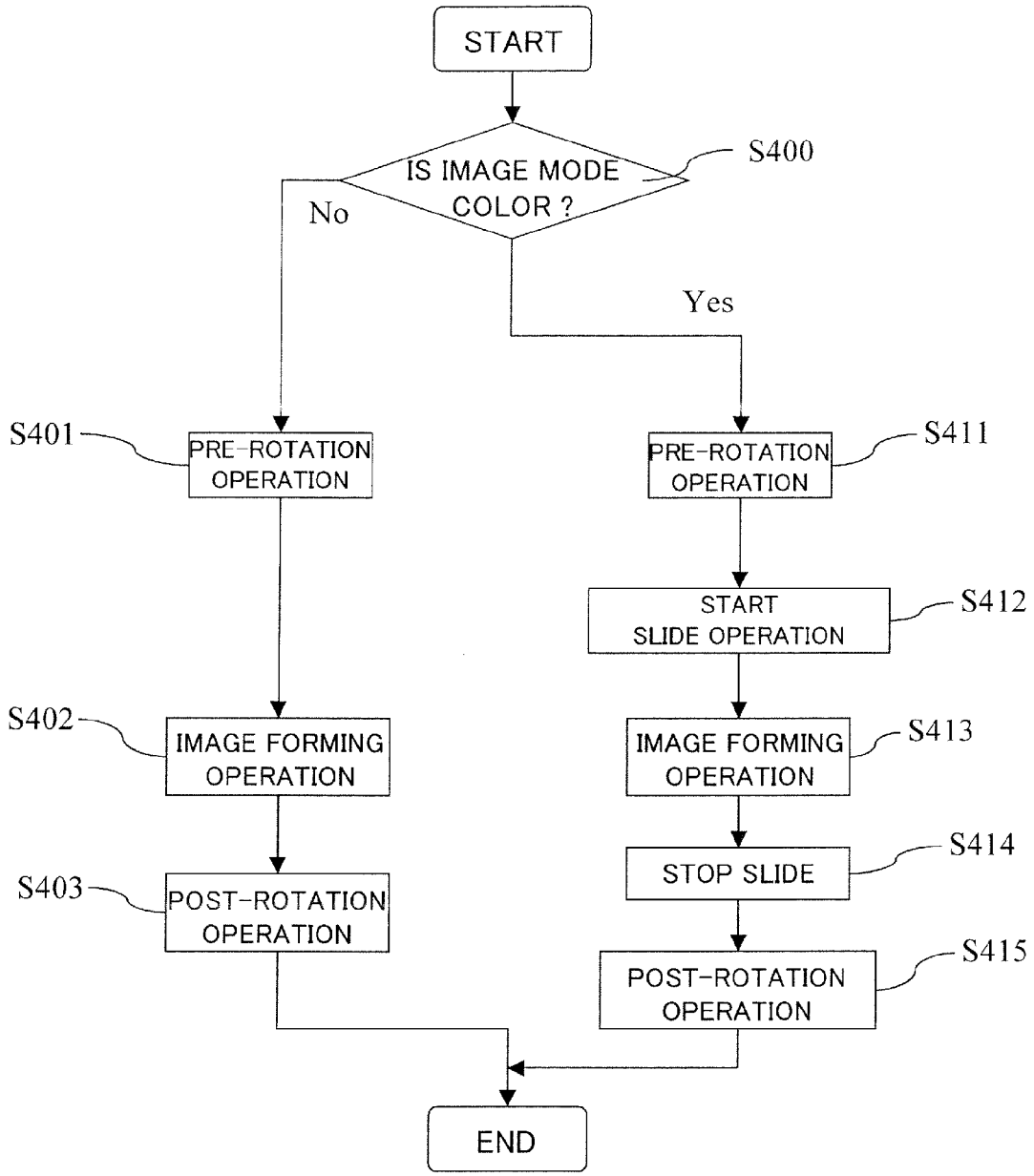
FIG. 41 is a flowchart showing image forming operations of the fourth embodiment.

Sizes of sheets fixable in the condition in which the longitudinal center of the heating roller 550 is aligned with that of the pressure roller 551, i.e., fixable by the series of operations shown in FIG. 39, are A4-, B5-, letter-, legal- and other sizes. In a case of a large sheet of size other than them up to 19 inches, the heating roller 550 is slid in the direction of the arrow A3 from the state shown in FIG. 38 in feeding a first sheet. FIGS. 40A and 40B show a series of operations in feeding a second sheet and thereafter continuously. However, a state when the recording medium P passes through the fixing nip portion N is not shown also in these figures. It is necessary to control the positional relationship between the heating and pressure rollers 550 and 551 as shown in FIG. 39A or 40A before feeding a first sheet in accordance to size of a sheet to be fixed when the sheet is fixed by the procedures as described above.

When L is set to be 14.5 mm for example besides the operations described above, it is possible to fix any sizes of sheet up to 19 inches continuously by the operations shown in FIGS. 39A through 39D by arranging such that the longitudinal center of the heating roller 550 is aligned with that of the pressure roller 551 after fixing a sheet in this case. However, the length in the longitudinal direction of the heating roller 550 is restricted by a space in which the fixing apparatus is installed, and energy-saving property is lost by heat radiation from the ends of the heating roller 550 if the heating roller 550 is too long. Accordingly, it is necessary to determine the slide portion in accordance to specifications of a product carrying the fixing apparatus. Although the slide distance is set to be 3% of the fixing nip width in the present embodiment, the rate of the slide distance may be less than 3% or may be more than 3% depending on the specifications of the product and by considering variation of the effects.

While the exemplary case when the heating roller 550 is slid in the longitudinal direction has been explained above, it is also possible to configure such that the heating roller 550 is longitudinally fixed and the pressure roller 551 is slid in the longitudinal direction. In such a case, the heating roller 550 is driven (rotated) in the circumferential direction and the pressure roller 551 is driven following the heating roller 550. Still further, in order to slide the pressure roller 551, it is necessary to prolong the pressure roller 551 more than the heating roller 550. Its configuration is what shown in FIG. 36 is reversed upside down, and the effects are the same, so that its detailed explanation will be omitted here.

The configuration in which either one of the heating and pressure rollers 550 and 551 is fixed in the longitudinal direction and the other one not fixed is slid in the longitudinal direction has been explained so far. It is also possible to slide both the heating and pressure rollers 550 and 551 to cause a shearing force to act. However, no shearing force is generated and no effect can be obtained naturally when the heating and pressure rollers 550 and 551 are slid in synchronism in the same direction. A shearing force is generated and the same effects can be obtained when the heating and pressure rollers 550 and 551 are slid in the opposite directions from each other or in asynchronism even if in the same direction. Although a recording medium meanders more or less in passing through the fixing nip portion N when either one of the heating and pressure rollers 550 and 551 is slid, there is an advantage that the meander of the recording medium is suppressed when the heating and pressure rollers 550 and 551 are slid in the opposite directions by the same distance.

As described above, it is possible to generate the shearing force in the longitudinal direction in the fixing nip portion N and to improve mixture of the secondary color by moving the heating and pressure rollers 550 and 551 relatively in the longitudinal direction.

It is noted that the rollers are used for both the heating side and pressure side in the configuration described above, the configuration is not to what uses the rollers as long as the effects of the invention described above are obtained. Still further, the halogen heater is used as the heating source in the present embodiment, it is also possible to use IH, ceramic heater or the like in accordance to a configuration to be adopted.

The heating roller of the fixing apparatus 9C is not slid during the standby time in the present embodiment. Then, in the monochrome mode in which letter and line images are often formed, the normal fixing by which the increment of total line width is substantially zeroed is carried out to precede to reduce thickening and tailing of letters and/or lines and to enhance printing quality of the letters also in the fixing apparatus 9C of the present embodiment. In the full color mode in which a high color range image is preferred however, the slip fixing that increases the increment of total line width is carried out to precede a highly colored image. The temperature control is carried out in the fixing apparatus 9C without sliding the heating roller during the standby time as described above.

Next, a flow of image forming operations of the present embodiment configured as described above will be explained with reference to FIG. 41. When the image forming operation is started, the control portion 50 judges whether a document image is a color image or a monochrome image in Step S400 in the same manner with the first embodiment as shown in the chart in FIG. 27. When it is judged to execute a color image forming operation, the mode is changed to the full color mode, and when it is judged to execute a monochrome image forming operation, the mode is changed to the monochrome mode, respectively.

Specifically, if the judgment is "No", i.e., the monochrome mode, in Step S400, a pre-rotation operation is carried out in Step S401, and information of the monochrome mode is transmitted to the slide distance control portion 599B through the image control portion 52. Because the mode is the monochrome mode, the slide distance control portion 599B does not slide the heating roller 550 similarly to the standby time. After that, the image forming and fixing operations are carried out in Step S402, post-rotation operations are carried out in Step S403, and the operation ends.

When the judgment is "Yes", i.e., the full color mode, in Step S400, a pre-rotation operation is started in Step S411, and information of the full color mode is transmitted to slide distance control portion 599B through the image control portion 52. Because the mode is the full color mode, the slide distance control portion 599B starts the operation of sliding the heating roller 550 with respect to the pressure roller 551 with speed of 7.4 mm/sec during a period after starting the pre-rotation operation and before starting the image forming operation in Step S412. After that, the image forming and fixing operations are carried out in Step S413. Then, at the timing when the fixing operation ends, i.e., a rear end in the conveying direction of the recording medium P slip out of the fixing nip portion N, the slide operation is finished in Step S414. After that, a post-rotation operation is carried out in Step S415, and then the operation is finished.

Thus, in the monochrome mode in which letter and line images are often formed, the normal fixing of applying the force in the toner overlap direction is carried out to reduce thickening and tailing of letters and/or lines and to enhance printing quality of the letters also in the present embodiment. In the full color mode in which a high color range image is preferred, however, the slip fixing that increases the force to be applied in the oblique direction with respect to the toner overlap direction is carried out to precede a highly colored image. The present embodiment enables to set the fixing conditions suited to the respective image modes. The other configurations and operations of the present embodiment are the same with those of the first embodiment described above.

Fifth Embodiment

Figure 43:
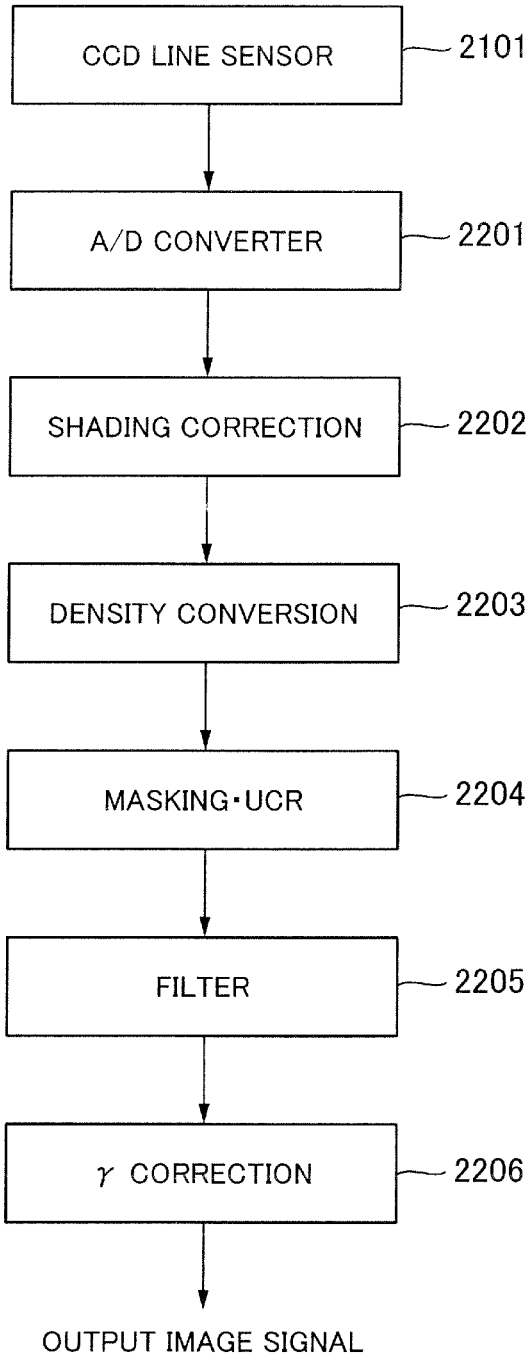
FIG. 43 is a block diagram showing an internal structure of an image control portion according to the fifth embodiment.
Figure 44:
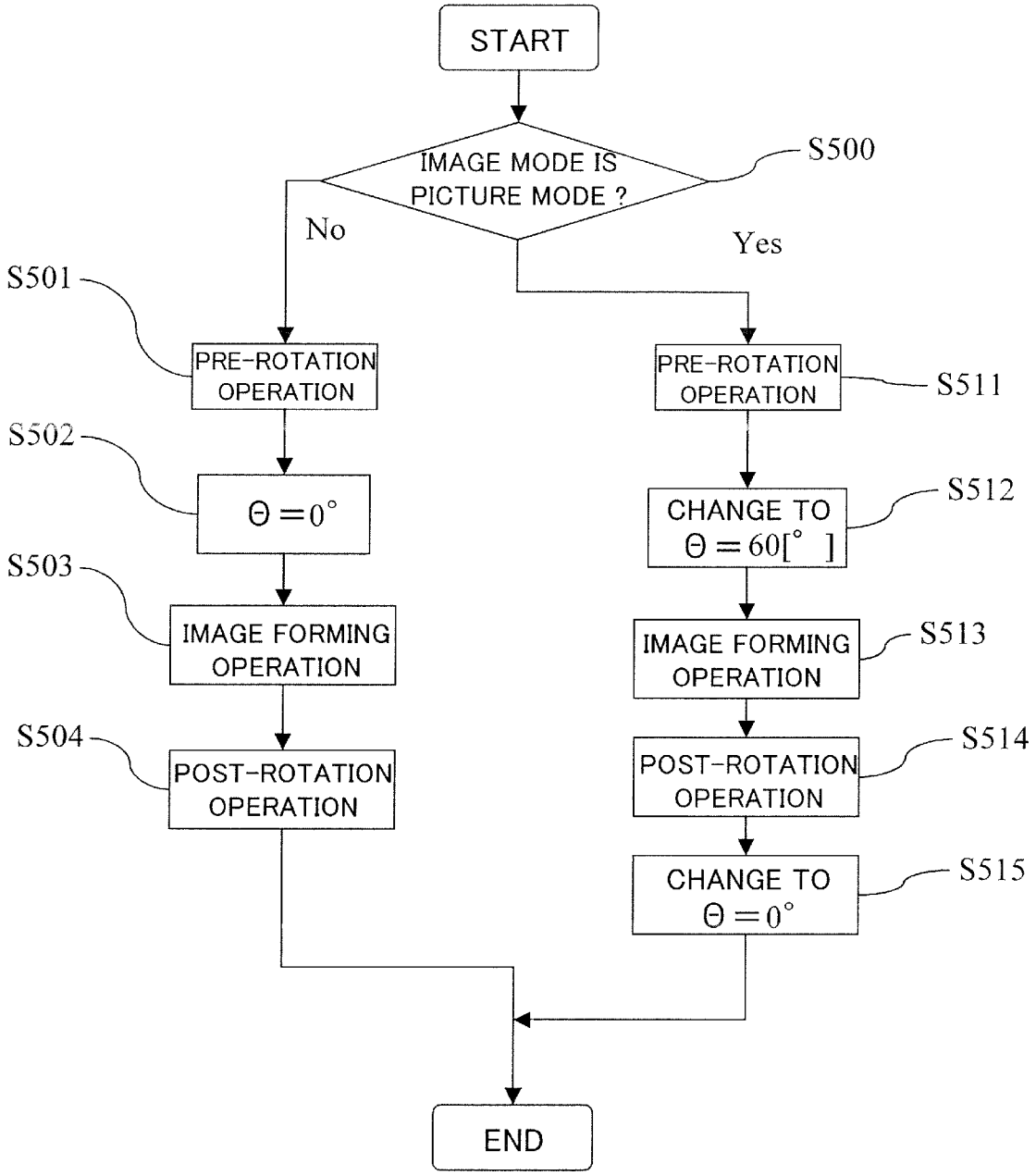
FIG. 44 is a flowchart showing image forming operations of the fifth embodiment.

A fifth embodiment of the invention will be described with reference to FIGS. 42 through 44. An image forming apparatus of the present embodiment has a letter/map mode enabling to clearly output profiles of letters in a letter/map image, and a picture mode enabling to smoothly output gradation in a photographic image.

Here, the picture mode is the coloring preceding mode (first mode) preceding coloring and the letter/map mode is the line image preceding mode (second mode) enhancing reproducibility of a line image. The present embodiment is configured such that a spread of a toner image in a slip direction in the picture mode (first mode) is greater than that in the letter/map mode (second mode).

Figure 42:
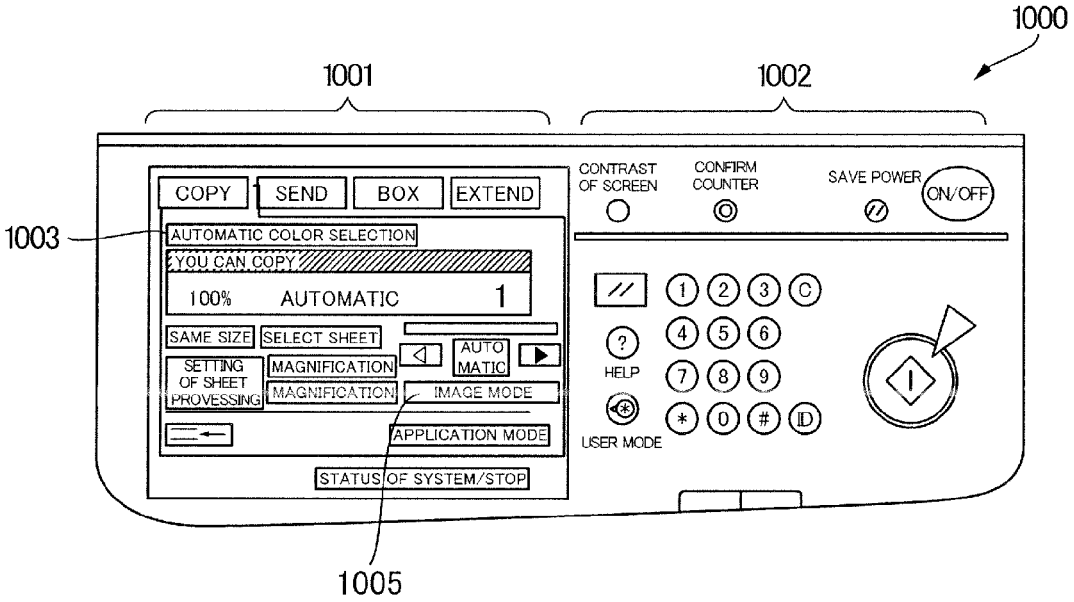
FIG. 42 illustrates one exemplary control portion (control panel) according to a fifth embodiment of the invention.

The image forming apparatus is configured such that the user can select an image processing mode suited to a document image such as the letter/map mode and the picture mode by pressing an image mode change button 1005 of the control panel 1000 shown in FIG. 42.

Operations of the image forming apparatus will be explained below in connection with the respective modes. FIG. 43 is a block diagram showing an internal structure of the image control portion 52 (see FIG. 1 and others). In FIG. 43, the image control portion 52 includes an A/D convertor 2201, a shading correction circuit 2202, a density converting circuit 2203, a masking UCR circuit 2204, a filtering circuit 2205, and γ correction circuit 2206. Color separation image signals of red, green and blue (R, G and B) input from a CCD line sensor 2101 that reads an original are converted into digital signals by the A/D convertor 2201. Then, after correcting a light quantity distribution by the shading correction circuit 2202 and correcting nonuniformity of sensitivity of the CCD line sensor 2101, the brightness signals RGB are converted into density signals of cyan, magenta and yellow (C, M, and Y) by the density converting circuit 2203.

The masking UCR circuit 2204 generates a black signal (K) from the CMY signal, and executes a masking calculation and under color removal (UCR) to correct color. To the CMYK signals thus obtained, the filtering circuit 2205 performs an edge enhancement or smoothing (flattening) process, and corrects non-linearity of an output from the γ correction circuit 2206.

The filtering circuit 2205 implements an edge enhancing process, a smoothing process, and others to pixels within image data. The filtering circuit 2205 performs the edge enhancement process when the letter/map mode is selected, and performs the smoothing process when the picture mode is selected.

Specifically, the edge enhancing process is performed as follows. Pixels to which the edge enhancing process is to be performed are detected by forming matrices into which density gradation, e.g., values of 0 to 255 in a case of monochrome 256 gradations, of a certain area centering on a subject pixel, e.g., 7×7 or 9×9 pixels, are assigned. Then, the matrices called a filter are multiplied with each other. Such a filter that performs integral multiplication on the subject pixel and multiplies a coefficient with gradation values of surrounding pixels and subtracts (differential filter) is selected as the filter. If a calculated value is as large as exceeding a predetermined threshold value, it is possible to judge that density is largely different from that of the surrounding pixels, i.e., an edge part), and a process of enhancing the density of the subject pixel is carried out. This makes it possible to form an image of a letter whose profile is clear.

Meanwhile, the smoothing process is carried out by forming matrices into which density gradations having pixels of a certain area, e.g., 7×7 or 9×9 pixels, centering on the subject pixel are assigned. Then, such matrices are multiplied with a matrix (integration filter) which performs fraction multiplication (summing all of the fractions equals 1) on the subject pixel and surrounding pixels, respectively, and sums. This makes it possible to change the density gradation of the subject pixel so that a difference of densities between the subject pixel and the surrounding pixels is reduced and to smooth the change of density of an image, and to form a color image having beautiful gradation in the photographic image.

Then, in the present embodiment, the letter/map mode for outputting letters and line images in high quality is carried out by the normal fixing by which an increment of total line width is substantially zeroed as described in the first embodiment to precede to reduce thickening and tailing of letters and/or lines and to enhance printing quality of the letters. In the picture mode in which a high color range image is output, however, the slip fixing that increases the increment of total line width is carried out to precede a highly colored image. The configurations of the image forming apparatus and the fixing apparatus of the present embodiment are the same with those of the first embodiment, so that their explanation will be omitted here.

Next, a flow of image forming operations of the present embodiment configured as described above will be explained with reference to FIG. 44. When the image forming operation is started, the control portion 50 judges whether a mode selected by the use is the picture mode or the letter/map mode in Step S500. When it is judged to be "No", i.e., the letter/map mode, in Step S500, a pre-rotation operation is started in Step S501, and information of the letter/map mode is transmitted to the pressure direction control portion 350 through the image control portion 52. Because the mode is the letter/map mode, the pressure direction control portion 350 does not drive the pressure direction switching unit 340 and keeps the pressure direction of the heating unit 330 on the side A similarly to the case of forming no image. That is, the angle θ formed between the inter-axes direction $L_1$ and the pressure direction $L_2$ is zeroed in Step S502. After that, the image forming and fixing operations are carried out in Step S503, post-rotation operations are carried out in Step S504, and the operation ends.

When the judgment is "Yes", i.e., the picture mode, in Step S500, a pre-rotation operation is started in Step S511, and information of the picture mode is transmitted to the pressure direction control portion 350 through the image control portion 52. Because the mode is the picture mode, the pressure direction control portion 350 drives the pressure direction switching unit 340 to move the pressure direction of the heating unit 330 on the side B after starting the pre-rotation operation and before starting the image forming operation. That is, the angle θ formed between the inter-axes direction $L_1$ and the pressure direction $L_2$ is set at 60° in Step S512. The operation of changing the angle θ described above is finished before starting the image forming operation.

After that, the image forming and fixing operations are carried out in Step S513 and a post-rotation operation is carried out in Step S514. During the post-rotation operation, the pressure direction control portion 350 finishes the job by changing the pressure direction of the fixing apparatus set at θ=60° in Step S512 to the side A direction, i.e., θ=0°, by the pressure direction switching device 340 in Step S515. The reason why the pressure direction is returned at θ=0° during the post-rotation is that there is a possibility of scratching a surface layer such as PFA of the heating unit 330 because the shearing force is applied also to the heating unit 330 when the pressure direction is kept at θ=60°.

Thus, in the letter/map mode in which letter and line images are often formed, the normal fixing of applying the force in the toner overlap direction is carried out to reduce thickening and tailing of letters and/or lines and to enhance printing quality of the letters also in the present embodiment. In the picture mode in which a high color range image is preferred, however, the slip fixing that increases the force to be applied in the oblique direction with respect to the toner overlap direction is carried out to precede a highly colored image. The present embodiment enables to set the fixing conditions suited to the respective image modes. The other configurations and operations of the present embodiment are the same with those of the first embodiment described above.

Sixth Embodiment

Figure 45:
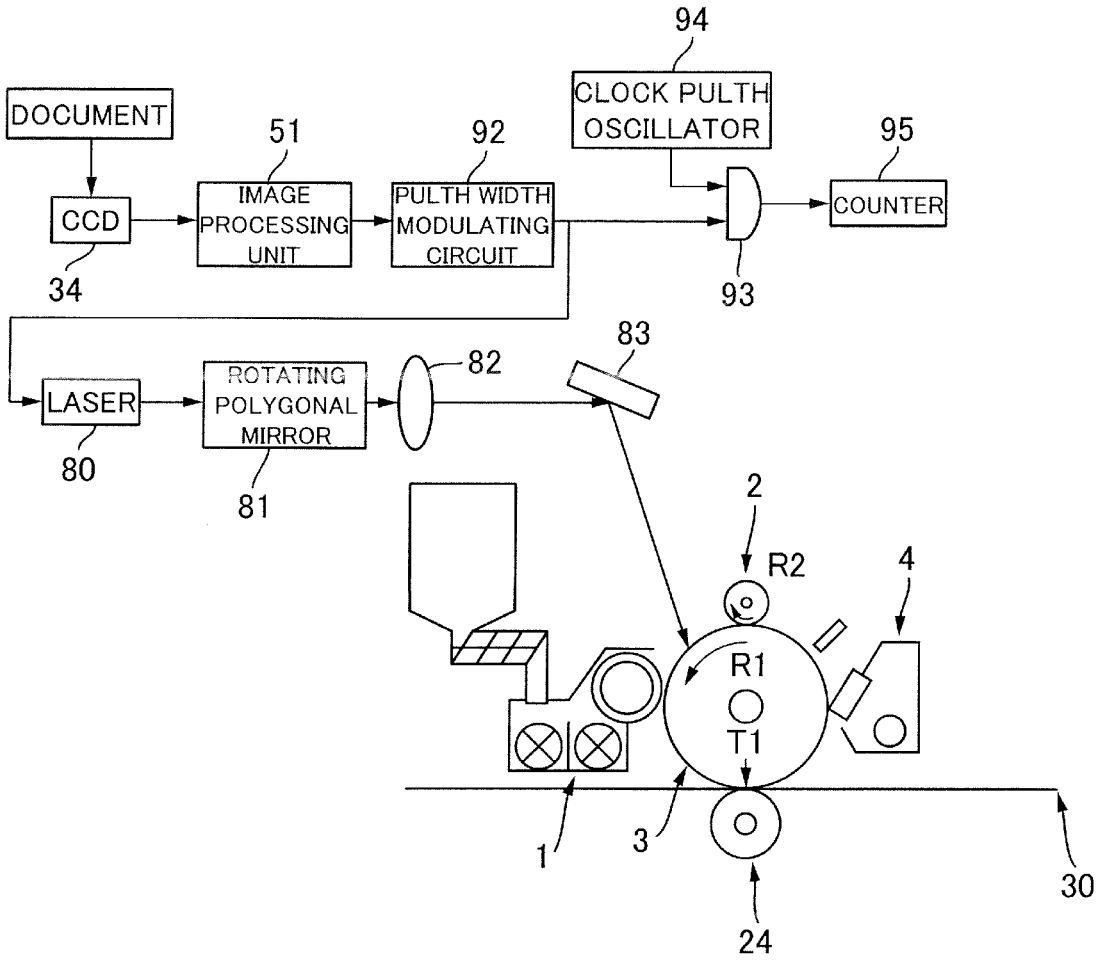
FIG. 45 is a block diagram schematically showing a structure of an image forming apparatus according to a sixth embodiment of the invention.
Figure 46:
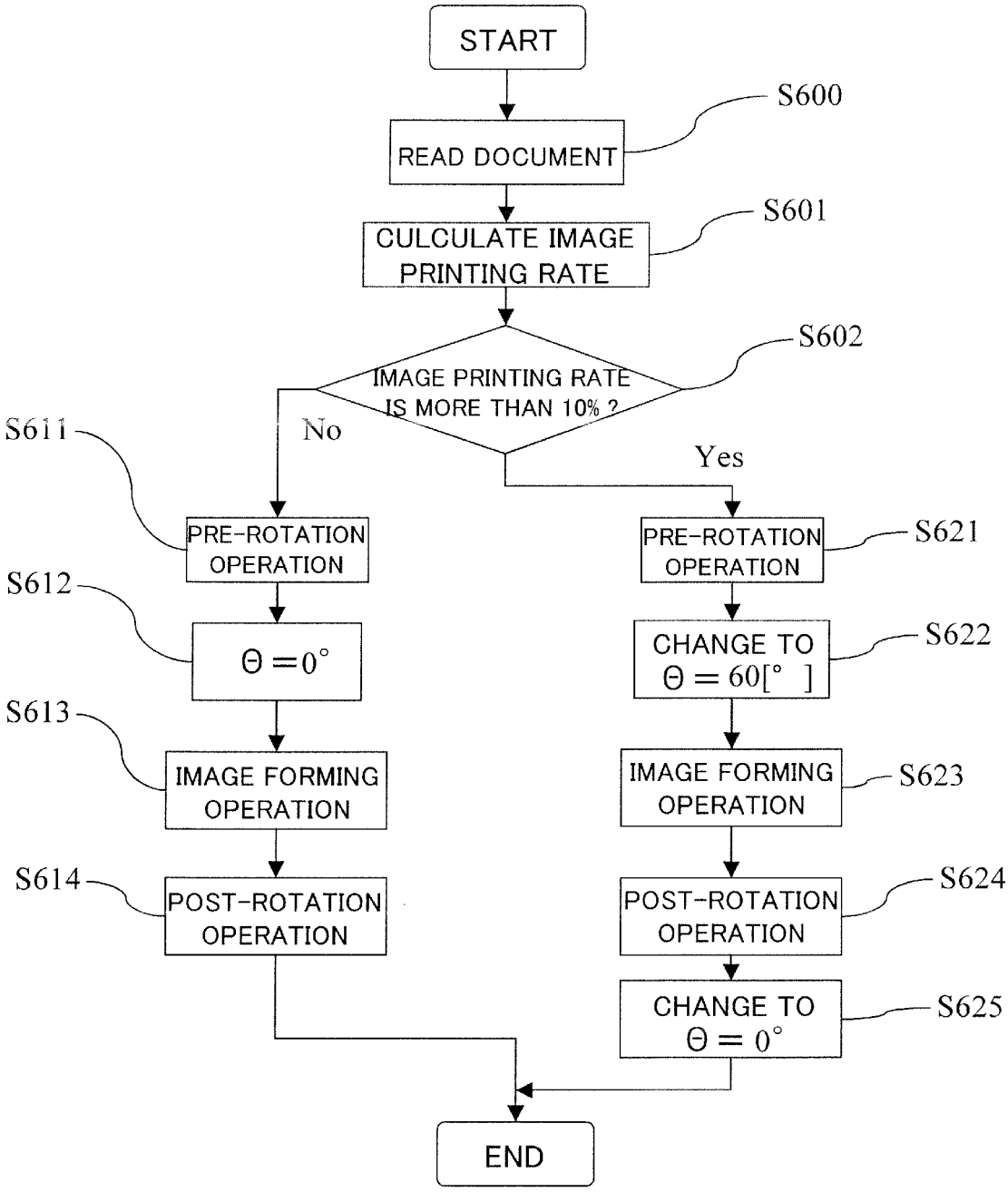
FIG. 46 is a flowchart showing image forming operations of the sixth embodiment.

A sixth embodiment of the invention will be described with reference to FIGS. 45 and 46. Whether the slip fixing is to be carried out or the normal fixing is to be carried out is switched in accordance to a rate of print image (referred to as an "image printing rate" hereinafter) to be output in the present embodiment. The image printing rate is a rate of a domain in which an image is formed with respect to an image forming domain of one sheet (one page) of a recording medium. That is, concerning image data of one page, the printing rate is 0% in a state of a blank sheet having no image within the image forming domain of one page, and the printing rate in a state filled by toners is 100%. The image printing rate is defined also as a rate of an image forming area and a non-image forming area in the image forming domain. For instance, the printing rate of an image of one white color is 0%, and the printing rate of a solid image whose entire domain is one single color other than white is 100%. The printing rate of an image in which a half of area within its printing domain is an image having no white part and the remaining part is a white image is 50%. The printing rate may be expressed by an expression of: number of black pixels/total number of pixels (number of white pixels+number of black pixels)×100.

Here, a method for calculating the image printing rate (number of counts of video) will be explained below. FIG. 45 is a block diagram of an image forming unit shown in connection with the explanation the image printing rate. At first, a laser 80 is driven by laser driving pulse corresponding to a printing pixel image signal transmitted from a pulse width modulating circuit 92 shown in FIG. 45. Then, laser light from the laser 80 is scanned by a rotating polygonal mirror 81 and is irradiated on a surface of a photoconductive drum 3 through a fθ lens 82 and a reflecting mirror 83. Meanwhile, laser drive pulse is supplied to one input of an AND gate 93, and a clock pulse from a clock pulse oscillator 94 is supplied to another input of the AND gate 93. Accordingly, a number of clock pulses corresponding to density of each pixel is output from the AND gate 93. A counter 95 accumulates this number of clock pulses per each image to calculate the video count number. Thus, the pulse accumulation signal (video count number) per each image from the counter 95 corresponds to a toner quantity consumed by the developing device 1 (see FIG. 3 and others) to form one toner image of a document.

Therefore, when the video count number is large, the image printing rate is high and more toner is consumed. Therefore, it is possible to judge that a highly coloring image is required to output in such case. When a text or the like is output, the image printing rate is often less than 10%.

Accordingly, whether the slip fixing of applying force in an oblique direction with respect to the toner overlap direction should be set or the normal fixing of applying force in the toner overlap direction should be set is determined properly in response to the image printing rate in the image forming apparatus of the present embodiment.

The slip fixing is set in a high image printing rate mode in which the image printing rate is high and relatively high coloring is required, and the normal fixing is set in a low image printing rate mode in which the image printing rate is low and an image such as a text is output.

That is, the high image printing rate mode is the coloring preceding mode (first mode) preceding coloring and the low image printing rate mode is the line image preceding mode (second mode) enhancing reproducibility of a line image. The present embodiment is configured such that a spread of a toner image in the slip direction in the high image printing rate mode (first mode) is greater than that in the low image printing rate mode (second mode).

Specifically, the low image printing rate mode in which the image printing rate is less than 10% and an increment of total line width is substantially zero is carried out by the normal fixing to reduce thickening and tailing of letters and/or lines and to precede to output a high definition image. Meanwhile, in the high printing rate mode in which the image printing rate is 10% or more and a high color range image is to be output, the slip fixing that increases the increment of total line width is carried out to precede a highly colored image. The configurations of the image forming apparatus and the fixing apparatus of the present embodiment are the same with those of the first embodiment, their explanation will be omitted here.

Next, a flow of image forming operations of the present embodiment configured as described above will be explained with reference to FIG. 46. When the image forming operation is started, the image reading portion reads a document in Step S600. After that, the image printing rate is calculated from the document information as described above in Step S601. The image printing rate is calculated in the same manner even when image information is sent from a personal computer. The control portion 50 judges whether or not the calculated image printing rate is 10% or more in Step S602. If the judgment is No, i.e., the image printing rate is less than 10%: low image printing rate mode, in Step S602, a pre-rotation operation is started in Step S611, and information of the low image printing rate mode is transmitted to the pressure direction control portion 350 through the image control portion 52. Because the mode is the low image printing rate mode, the pressure direction control portion 350 does not drive the pressure direction switching unit 340 and keeps the pressure direction of the heating unit 330 on the side A similarly to the case of forming no image. That is, the angle θ formed between the inter-axes direction $L_1$ and the pressure direction $L_2$ is zeroed in Step S612. After that, the image forming and fixing operations are carried out in Step S613, post-rotation operations are carried out in Step S614, and the operation ends.

When the judgment is "Yes", i.e., the image printing rate is 10% or more: the high image printing mode, in Step S602, a pre-rotation operation is started in Step S621, and information of the high printing rate mode is transmitted to the pressure direction control portion 350 through the image control portion 52. Because the mode is the high printing rate mode, the pressure direction control portion 350 drives the pressure direction switching unit 340 and moves the pressure direction of the heating unit 340 on the side B after starting the pre-rotation operation and before starting the image forming operation. That is, the angle θ formed between the inter-axes direction $L_1$ and the pressure direction $L_2$ is set at 60° in Step S622. The operation of changing the angle θ described above is finished before starting the image forming operation.

After that, the image forming and fixing operations are carried out in Step S623 and a post-rotation operation is carried out in Step S624. During the post-rotation operation, the pressure direction control portion 350 finishes the job by changing the pressure direction of the fixing apparatus set at θ=60° in Step S622 to the side A direction, i.e., θ=0°, by the pressure direction switching device 340 in Step S625. The reason why the pressure direction is returned at θ=0° is that there is a possibility of scratching a surface layer such as PFA of the heating unit 330 because the shearing force is applied also to the heating unit 330 when the pressure direction is kept at θ=60°.

Thus, the low image printing rate mode in which the image printing rate is less than 10% and a high definition image is to be output is carried out by the normal fixing of applying the force in the toner overlap direction to reduce thickening and tailing of letters and/or lines and to precede to output the high definition image in the present embodiment. In the high printing rate mode in which the image printing rate is 10% or more and a high color range image is to be output, however, the slip fixing that increases the force to be applied in the oblique direction with respect to the toner overlap direction is carried out to precede a highly colored image. The present embodiment enables to set the fixing conditions suited to the respective image modes. The other configurations and operations are the same with those of the first embodiment described above.

It is noted that the respective embodiments described above may be carried out by adequately combining them or by changing the combination. The present invention is applicable also to a system configured to directly transfer a toner image from a photoconductive drum to a recording medium. In this case, the photoconductive drum functions as the image carrier.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-135499, filed on Jun. 15, 2012, which is hereby incorporated by reference herein in its entirety.

What is claimed is:

1. An image forming apparatus, comprising:

an image forming portion configured to form a toner image such that a relationship of $M \leq \rho\pi L/(30\sqrt{3})$ is satisfied, where a volume average particle size of a toner is L (μm), density of the toners is ρ (g/cm$^3$), and a maximum toner laid quantity per unit area of a single color toner image on a recording medium is M (mg/cm$^2$);

a heating member that heats the toner image formed on the recording medium by the image forming portion;

a nip forming member that comes in contact with the heating member and forms a fixing nip portion configured to fix the toner image on the recording medium by heating and pressing the toner image which has been formed on the recording medium passing through the fixing nip portion;

a force applying portion capable of applying a force to the toner image on the recording medium passing through the fixing nip portion in a direction of a plane of the recording medium; and a control portion configured to execute first and second modes in which spreads of the toner image widened in the direction of the plane of the recording medium are different from each other, and to control the force applying portion such that the spread of the toner image widened in the direction of the plane of the recording medium in the first mode is greater than the spread of the toner image widened in the direction of the plane of the recording medium in the second mode.

2. The image forming apparatus according to claim 1, wherein the first mode is a coloring preceding mode of preceding coloring; and the second mode is a line image preceding mode of enhancing reproducibility of a line image.

3. The image forming apparatus according to claim 1, wherein the first mode is a full color mode of forming an image by a plurality of color toners; and the second mode is a monochrome mode of forming an image by single color toner.

4. The image forming apparatus according to claim 1, wherein the first mode is a picture mode of forming a photographic image; and the second mode is a letter/map mode of forming a letter or map image.

5. The image forming apparatus according to claim 1, wherein the first mode is a high image printing rate mode of forming an image with a high image printing rate of 10% or more; and the second mode is a low image printing rate mode of forming an image with a low image printing rate less than 10%;

where, the image printing rate is a rate of an area in which the image is formed with respect to an image forming area of one recording medium.

6. The image forming apparatus according to claim 1, wherein the force applying portion is a pressure direction changing portion configured to change a pressure direction in which one member among the heating member and the nip forming member is pressed to the other in a direction inclined with respect to a toner laminating direction; and the control portion is configured to control the pressure direction changing portion.

7. The image forming apparatus according to claim 1, wherein the heating member and the nip forming member are configured to be able to rotate in a direction of conveying the recording medium pinched by the fixing nip portion;

the force applying portion includes a first driving portion that rotationally drives the heating member and a second driving portion that rotationally drives the nip forming member; and the control portion is configured to control the first and second driving portions and to vary a difference in peripheral velocities of the heating member and the nip forming member.

8. The image forming apparatus according to claim 1, wherein the force applying portion is an inclining portion that is capable of changing a positional relationship of the heating member and the nip forming member such that a generating line of one member among the heating member and the nip forming member is inclined relatively to a generating line of the other member; and the control portion is configured to control the inclining portion.

9. The image forming apparatus according to claim 1, wherein the force applying portion is a moving portion that moves at least one of the heating member and the nip forming member in a direction orthogonal to a recording medium conveying direction and to a toner laminating direction in such a manner that a relative displacement is caused between the heating member and the nip forming member; and the control portion is configured to control the moving portion.

* * * * *